US006367914B1

(12) United States Patent
Ohtaka et al.

(10) Patent No.: US 6,367,914 B1
(45) Date of Patent: Apr. 9, 2002

(54) ELECTROSTATIC INK-JET HEAD AND METHOD OF PRODUCTION OF THE SAME

(75) Inventors: Kouichi Ohtaka, Miyagi; Eiichi Ohta, Kanagawa; Mitsugu Irinoda, Miyagi; Yohichiro Miyaguchi, Kanagawa; Takeshi Takemoto, Kanagawa; Kenichiro Hashimoto, Kanagawa; Makoto Tanaka, Kanagawa; Yutaka Ebi, Kanagawa, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/550,408

(22) Filed: Apr. 14, 2000

(30) Foreign Application Priority Data

| | | |
|---|---|---|
| Apr. 15, 1999 | (JP) | 11-107490 |
| Jul. 14, 1999 | (JP) | 11-199746 |
| Jul. 26, 1999 | (JP) | 11-210858 |
| Aug. 9, 1999 | (JP) | 11-224797 |

(51) Int. Cl.[7] ..... B41J 2/04
(52) U.S. Cl. ..... 347/54
(58) Field of Search ..... 347/54, 68, 69, 347/70, 71, 72, 50; 399/261; 361/700; 29/890.1; 310/328–330

(56) References Cited

U.S. PATENT DOCUMENTS 6,117,698 A * 9/2000 Atobe et al. ..... 347/54

FOREIGN PATENT DOCUMENTS

| | | |
|---|---|---|
| JP | 61-59911 | 12/1986 |
| JP | 2-51734 | 11/1990 |
| JP | 6-71882 | 3/1994 |
| JP | 7-214770 | 8/1995 |
| JP | 9-39235 | 2/1997 |
| JP | 9-193375 | 7/1997 |

* cited by examiner

*Primary Examiner*—Raquel Yvette Gordon
(74) *Attorney, Agent, or Firm*—Greenberg Traurig, LLP

(57) ABSTRACT

An electrostatic ink-jet head includes an oscillation plate which defines a bottom of a pressurizing chamber. An electrode substrate is bonded to the oscillation plate and includes a recessed portion that defines an internal space between the oscillation plate and the electrode substrate. A curved electrode is arranged on the recessed portion so as to face the oscillation plate via the internal space. When a driving voltage is applied to the electrode, the electrode actuates the oscillation plate via an electrostatic force, so as to pressurize ink in the pressurizing chamber, thereby ejecting an ink drop onto the recording paper. In the ink-jet head, a dielectric layer is provided on at least one of the electrode and the oscillation plate, and the recessed portion of the electrode substrate has a generally concave cross-section taken along shorter sides of the oscillation plate, such that a gap between the electrode and the oscillation plate is gradually decreased from a middle point to ends of the shorter sides.

44 Claims, 29 Drawing Sheets

ELECTROSTATIC INK-JET HEAD AND METHOD OF PRODUCTION OF THE SAME

BACKGROUND OF THE INVENTION

1. Field of the Invention

The present invention relates to an electrostatic ink-jet head which ejects an ink drop from a pressurizing chamber onto recording paper through a nozzle opening by pressurizing the ink in the pressurizing chamber with an oscillation plate that is electrostatically actuated by an electrode opposite to the oscillation plate. Further, the present invention relates to a method of production of an electrostatic ink-jet head having an electrostatic actuator.

2. Description of the Related Art

Ink-jet heads are provided for ink-jet recording systems, which are included in various image forming systems such as printers, facsimiles, copiers, plotters, and other such image forming devices. In a typical, ink-jet head, an ink drop is ejected from a pressurizing chamber onto recording paper through a nozzle by pressurizing the ink in the pressurizing chamber. The pressurizing chamber communicates with the nozzle. An energy generating device is provided to generate energy used to pressurize the ink in the pressurizing chamber. When a driving voltage is applied to the energy generating device, the energy generating device generates the energy so that the ink-jet head ejects an ink drop from the nozzle onto the recording paper by pressurizing the ink in the pressurizing chamber. Currently, the on-demand ink-jet head is dominant in the related art. In ink-jet heads of this type, the head ejects ink drops onto the recording paper only when recording is required.

For example, as disclosed in Japanese Published Patent Application No. 2-51734, a conventional ink-jet head includes a plurality of nozzle openings arranged parallel to each other so as to eject ink drops therefrom, a plurality of pressurizing chambers respectively attached to the nozzle openings, each pressurizing chamber having walls one of which is arranged to function as a diaphragm, a plurality of piezoelectric elements respectively attached to the corresponding diaphragms, and a common ink cavity for supplying ink to each of the pressurizing chambers.

When a driving voltage is applied to any one of the piezoelectric elements in the above-mentioned ink-jet print head, the diaphragm corresponding to the one of the piezoelectric elements is mechanically deflected so that the volume of the pressurizing chamber corresponding to the diaphragm is instantaneously reduced and the ink in the pressurizing chamber is pressurized. As a result, an ink drop is ejected from the corresponding nozzle opening onto the recording paper.

However, the above piezoelectric type ink-jet print head requires much time and labor for mounting the piezoelectric elements on the pressurizing chambers because the piezoelectric elements must be attached to the outside of the pressurizing chambers through glass or resin plates forming the diaphragms or must be arranged in the inside of the pressurizing chambers. Further, it is very difficult for the piezoelectric ink-jet head to achieve high-speed, high-quality printing because the piezoelectric ink-jet head must be equipped with a larger number of nozzle openings for ejecting ink drops.

Further, as disclosed in Japanese Published Patent Application No.61-59911, another conventional ink-jet head is also known. In this ink-jet head, the ink in the pressurizing chamber is heated by a heater, so that the pressure in the pressurizing chamber is increased by the bubbles generated by evaporation of the ink. As a result, the ink-jet head ejects ink drops from the pressurizing chambers.

However, the above-mentioned heating system has a problem in that the operational life of the head is comparatively short because the heating resistors are damaged by the repetition of heating/cooling and by the shock at the time of the breaking of bubbles in the ink.

In order to eliminate the problems of the above conventional heads, an electrostatic ink-jet head has been proposed. As disclosed in Japanese Laid-Open Patent Application No. 6-71882, the electrostatic ink-jet head includes a plurality of nozzle openings, a plurality of pressurizing chambers respectively attached to the nozzle openings, diaphragms respectively disposed in the corresponding pressurizing chambers, a plurality of driving electrodes for respectively driving the corresponding diaphragms, and a common ink cavity for supplying ink to the plurality of pressurizing chambers. Each of the diaphragms defines a bottom of one of the pressurizing chambers. The diaphragms and the pressurizing chamber walls are arranged parallel to each other, and a parallel gap is provided between each diaphragm and the corresponding pressurizing chamber.

In the above-mentioned ink-jet print head, when driving pulses are applied to the driving electrodes, the driving electrodes respectively actuate the diaphragms via an electrostatic force in a direction to increase the pressures in the respective pressurizing chambers to eject ink drops from the nozzle openings onto recording paper.

In the electrostatic ink-jet head of the above type, the amount of displacement of the diaphragm and the electrostatic attraction pressure on the diaphragm, when the diaphragm is driven, are calculated as follows.

Suppose that the diaphragm has a rectangular shape including a short-side length "2*a*" and long-side length "*b*". The amount of displacement δ (m) of the thin plate (the diaphragm) is represented by $$\delta = k\cdot\{12(1-\nu^2)/Eh^2\}\cdot Pa^4 \quad (1)$$

where "k" is a constant, "ν" is Poisson's ratio, "E" is Young's modulus ($N/m^2$), "h" is a thickness (m) of the diaphragm, and "P" is an electrostatic attraction pressure ($N/m^2$) between the diaphragm and the electrode.

Further, in the electrostatic inkjet head of the above type, the electrostatic attraction pressure P ($N/m^2$) between the diaphragm and the electrode is represented by:

$$P = (1/2)\cdot\in\cdot(V/t)^2 \quad (2)$$

where "∈" is a dielectric constant (F/m), "V" is the applied voltage (V), and "t" is a distance (m) between the diaphragm and the electrode.

In order to mount a larger number of nozzle openings on the electrostatic ink-jet head of the above type for achieving high-speed, high-quality printing, it is necessary to reduce the short-side length "a" of each of the diaphragms. However, as is apparent from the above equation (1), if the length "a" is reduced, the amount of displacement of the diaphragm is greatly decreased. Hence, the short-side length "a" of the diaphragm must be maintained at a certain level.

In order to allow adequate amount of displacement of the diaphragm for ejecting a proper amount of ink while maintaining the short-side length "a" of the diaphragm at a certain level, it is necessary to meet any of the following requirements in accordance with the equations (1) and (2): (i) the diaphragm thickness "h" must be reduced; (ii) the distance "t" between the diaphragm and the electrode must be reduced; and (iii) the driving voltage "V" must be increased.

Regarding the requirement (i) above, if the thickness "h" of the diaphragm is reduced, the rigidity of the diaphragm is greatly decreased, which will significantly lower the ink ejecting pressure of the diaphragm. Regarding the requirement (ii) above, if the distance "t" is reduced, the maximum amount of displacement of the diaphragm is decreased, which will considerably reduce the amount of ink drops ejected by the head and will cause defective printing on the recording paper. Regarding the requirement (iii) above, if the driving voltage "V" is increased the cost is considerably increased.

Accordingly, it is desired to provide an electrostatic ink-jet head which has a construction that overcomes the problems described above and achieves adequate amount of displacement of the diaphragm for ejecting a proper amount of ink while maintaining the short-side length of the diaphragm at a certain level.

Japanese Laid-Open Patent Application No. 9-39235 discloses an electrostatic ink-jet head in which a pressurizing chamber is provided and a bottom wall of the pressuring chamber partially defines an oscillation plate. Driving electrodes are arranged on step-wise surfaces of a base substrate, which face the oscillation plate on the bottom of the pressurizing chamber. The step-wise surfaces of the base substrate are arranged in a staircase configuration with steps having different heights. Hence, step-wise gaps are provided between the driving electrodes and the oscillation plate, and the step-wise gaps are decreased in the distance between each of the respective electrodes and the oscillation plate in a direction away from the position just below the nozzle opening.

Japanese Laid-Open Patent Application No.9-193375 discloses an electrostatic ink-jet head in which a pressurizing chamber is provided and a bottom wall of the pressuring chamber partially defines an oscillation plate. A driving electrode is provided on a linearly sloped surface of a base substrate, which faces the oscillation plate on the bottom of the pressurizing chamber. The linearly sloped surface of the base substrate, on which the electrode is mounted, is arranged in a non-parallel manner relative to the oscillation plate, and the gap between the electrode and the oscillation plate is linearly decreased in a direction away from the nozzle opening.

The above-mentioned ink-jet print heads have an advantage in that the oscillation plate can be actuated with a low driving voltage applied to the electrode because the displacement of the oscillation plate generated by the electrostatic force can start from a position where the distance (the gap) between the electrode and the oscillation plate is relatively small. However, the above-mentioned heads have a difficulty in providing efficient low-voltage actuation of the oscillation plate as well as a proper amount of ink ejected by the actuation of the oscillation plate.

Japanese Laid-Open Patent Application No.7-214770 discloses an electrostatic ink-jet head in which an electrode is brought into contact with an oscillation plate when a driving voltage applied to the electrode is above a certain voltage. The ink-jet head has an advantage in that the amount of ink ejected by the head becomes stable. However, it is difficult for the above ink-jet head to provide appropriate ink ejection characteristics that achieve high-speed, high-quality printing.

SUMMARY OF THE INVENTION

In order to overcome the problems described above, preferred embodiments of the present invention provide an improved ink-jet head that is constructed and arranged to provide a low-voltage actuation of the oscillation plate as-well as a precise amount of ink ejected by the low-voltage actuation of the oscillation plate.

Further, preferred embodiments of the present invention provide a method of manufacturing an ink-jet head to provide a low-voltage actuation of the oscillation plate as well as a precise amount of ink ejected by the low-voltage actuation of the oscillation plate.

According to one preferred embodiment of the present invention, an ink-jet head is provided with an electrostatic actuator which includes an oscillation plate which defines a bottom of a pressurizing chamber of the ink-jet head, the oscillation plate having a generally rectangular shape with longer sides and shorter sides, the shorter sides having a middle point and peripheral ends, an electrode substrate which is bonded to the oscillation plate, the electrode substrate having a recessed portion that defines an internal space between the oscillation plate and the electrode substrate, and a curved electrode which is provided on the recessed portion of the electrode substrate to face the oscillation plate via the internal space, such that upon application of a driving voltage to the electrode, the electrode actuates the oscillation plate by electrostatic force, so as to pressurize ink in the pressurizing chamber, thereby ejecting an ink drop onto recording paper, wherein a dielectric layer is provided on at least one of the electrode and the oscillation plate, and the recessed portion of the electrode substrate has a generally concave cross-section taken along the shorter sides of the oscillation plate, such that a gap between the electrode and the oscillation plate is reduced from an approximate middle point to the ends of the shorter sides.

According to another preferred embodiment of the present invention, an ink-jet head preferably includes a nozzle opening which ejects an ink drop therefrom onto recording paper, a pressurizing chamber which is attached to the nozzle opening and contains ink therein, an oscillation plate which is provided to define a bottom of the pressurizing chamber, and pressurizes the ink in the pressurizing chamber when the oscillation plate is actuated, the oscillation plate have a substantially rectangular shape with longer sides and shorter sides, the longer sides having a middle point, a first end and a second end, an electrode substrate which is bonded to the oscillation plate, the electrode substrate having a recessed portion that defines an internal space between the oscillation plate and the electrode substrate, and an electrode which is arranged on the recessed portion to face the oscillation plate via the internal space, upon application of a driving voltage to the electrode, the electrode actuating the oscillation plate via electrostatic force, so that the ink-jet head ejects an ink drop from the nozzle opening onto the recording paper by pressurizing the ink in the pressurizing chamber, wherein the electrode has a cross-section taken along the longer sides of the oscillation plate, such that a gap between the electrode and the oscillation plate is reduced from the middle point to at least one of the first and second ends of the longer sides, and the cross-section of the electrode includes a bottom flat region surrounding the middle point and at least one slope region extending from the bottom flat region to one of the first and second ends of the longer sides.

According to another preferred embodiment of the present invention, an ink-jet head preferably, includes a nozzle opening which ejects an ink drop therefrom onto recording paper; a pressurizing chamber which is attached to the nozzle opening and contains ink therein, a substantially rectangular oscillation plate which defines a bottom of the pressurizing chamber, and pressurizes the ink in the pressurizing chamber when the oscillation plate is actuated, the oscillation plate having longer sides and shorter sides, the shorter sides having a middle point, a first end and a second end, an electrode substrate which is bonded to the oscillation plate, the electrode substrate having a recessed portion that defines an internal space between the oscillation plate and the electrode substrate, and a curved electrode which is arranged on the recessed portion to face the oscillation plate via the internal space, such that upon application of a driving voltage to the electrode, the electrode actuates the oscillation plate by electrostatic force, so that the ink-jet head ejects an ink drop from the nozzle opening onto the recording paper by pressurizing the ink in the pressurizing chamber, wherein the recessed portion of the electrode substrate has a cross-section taken along the shorter sides of the oscillation plate, such that a rate of reduction of a gap between the electrode and the oscillation plate in a first direction from the middle point to t he first end of the shorter sides differs from a rate of reduction of the gap in a second direction from the middle point to the second end.

According to another preferred embodiment of the present invention, an ink-jet head preferably includes a nozzle opening which ejects an ink drop therefrom onto recording paper, a pressurizing chamber which is attached to the nozzle opening for containing ink therein, a substantially rectangular oscillation plate which defines a bottom of the pressurizing chamber, and pressurizes the ink in the pressurizing chamber when the oscillation plate is actuated, an electrode substrate which is bonded to the oscillation plate, the electrode substrate having a recessed portion that defines an internal space between the oscillation plate and the electrode substrate, and a curved electrode which is provided on the recessed portion to face the oscillation plate via the internal space, such that upon application of a driving voltage to the electrode, the electrode actuates the oscillation plate by electrostatic force, wherein the recessed portion of the electrode substrate has a first cross-section taken along shorter sides of the oscillation plate, such that a gap between the electrode and the oscillation plate is reduced from a middle point to peripheral ends of the shorter sides, and wherein a protective layer is provided on the electrode, and at least one of the protective layer and the electrode is brought into tangential contact with the oscillation plate at the peripheral ends of the shorter sides.

According to another preferred embodiment of the invention, a method of production of an ink-jet head provided with an electrostatic actuator, the electrostatic actuator including an oscillation plate defining a bottom of a pressurizing chamber of the ink-jet head, the oscillation plate having a substantially rectangular shape with longer sides and shorter sides, an electrode substrate bonded to the oscillation plate, the electrode substrate having a recessed portion that defines an internal space between the oscillation plate and the electrode substrate, and a curved electrode arranged on the recessed portion of the electrode substrate to face the oscillation plate via the internal space, includes the steps of forming a photo-resist layer on the electrode substrate, forming a recess in the photo-resist layer through a photolithography process, the recess corresponding to the recessed portion of the electrode substrate, and producing the recessed portion of the electrode substrate through an etching process by using the photo-resist layer with the recess, wherein the recessed portion of the electrode substrate is configured with a generally concave cross-section taken along the shorter sides of the oscillation plate, such that a gap between the electrode and the oscillation plate is reduced from a middle point to peripheral ends of the shorter sides.

According to another preferred embodiment of the invention, a method of production of an ink-jet head, the ink-jet head including a substantially rectangular oscillation plate defining a bottom of a pressurizing chamber, an electrode substrate bonded to the oscillation plate, the electrode substrate having a recessed portion that defines an internal space between the oscillation plate and the electrode substrate, and a curved electrode provided on the recessed portion to face the oscillation plate via the internal space, includes the steps of forming a photoresist layer on the electrode substrate, performing a photolithographic process to form a recess in the photoresist layer by using a photoresist, the photoresist including a light-transmitting portion having different transmittances and producing the recessed portion of the electrode substrate through an etching process by using the photo-resist layer with the recess, wherein the oscillation plate has shorter sides with a middle point, a first end and a second end, and the recessed portion of the electrode substrate is configured with a cross-section taken along the shorter sides of the oscillation plate, such that a rate of reduction of a gap between the electrode and the oscillation plate in a first direction from the middle point to the first end of the shorter sides differs from a rate of reduction of the gap in a second direction from the middle point to the second end of the shorter sides.

In the ink-jet head of preferred embodiments of the present invention and the method of production of the same, the recessed portion of the electrode substrate preferably has a concave cross-section taken along the shorter sides of the oscillation plate, such that the gap between the electrode and the oscillation plate is reduced from the middle point to the ends of the shorter sides. The oscillation plate can be easily and properly actuated with a low driving voltage applied to the electrode because the displacement of the oscillation plate generated by electrostatic force can start from the peripheral positions where the distance (the gap) between the electrode and the oscillation plate is relatively small. The ink-jet head of preferred embodiments of the present invention is efficient in providing a low-voltage actuation of the oscillation plate as well as a proper amount of ink ejected by the low-voltage actuation of the oscillation plate. Further, it is possible for the ink-jet head production method of preferred embodiments of the present invention to easily produce the ink-jet head with low cost by suitably using photolithography and etching processes.

BRIEF DESCRIPTION OF THE DRAWINGS

Other features, elements, characteristics and advantages of the present invention will be apparent from the following detailed description of preferred embodiments thereof when read in conjunction with the accompanying drawings in which:

FIG. 31A, FIG. 31 B and FIG. 31C are diagrams showing examples of the photoresist patterns with different transmittances;

DETAILED DESCRIPTION OF PREFERRED EMBODIMENTS

A description will now be provided, of preferred embodiments of the present invention with reference to the accompanying drawings.

Figure 1:
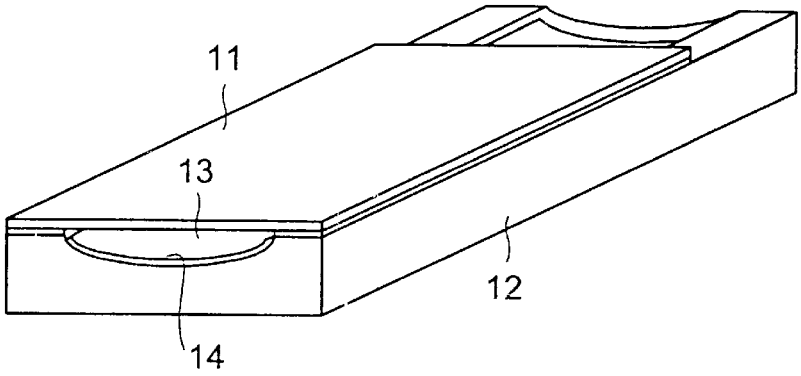
FIG. 1 is a perspective diagram of an electrostatic actuator in one preferred embodiment of the ink-jet head of the invention.

FIG. 1 is a perspective diagram of an electrostatic actuator in one preferred embodiment of the ink-jet head of the invention.

As shown in FIG. 1 the electrostatic actuator in the ink-jet head of the present preferred embodiment preferably includes an oscillation plate 11, an electrode substrate 12, an electrode 14, and a gap 13 between the oscillation plate 11 and the electrode 14.

The oscillation plate 11 defines a bottom of a pressurizing chamber (not shown) of the ink-jet head. The oscillation plate 11 preferably has a substantially rectangular shape with longer sides extending in the longitudinal direction and shorter sides extending in the lateral direction.

The electrode substrate 12 is bonded to the oscillation plate 11 at the peripheral ends. The electrode substrate 12 has a recessed portion that defines an internal space between the oscillation plate 11 and the electrode substrate 12. The recessed portion extends along the longer sides of the oscillation plate 11 and the shorter sides thereof in a different manner, which will be described later.

As shown in FIG. 1, the electrode 14 is curved and arranged on the recessed portion of the electrode substrate 12 to face the oscillation plate 11 via the internal space. When a driving voltage is applied between the electrode 14 and the oscillation plate 11, the electrode 14 actuates the oscillation plate 11 by electrostatic force, so that the ink-jet head ejects an ink drop from a nozzle opening onto recording paper by pressurizing the ink in the pressurizing chamber.

In the present preferred embodiment, the oscillation plate 11 is preferably made of silicon single crystals, which is suitable for providing a long-term durability of the oscillation plate 11. Alternatively, when a long-term durability of the oscillation plate 11 is not demanded, the oscillation plate 11 may be made of polysilicon or other suitable material.

Generally, a suitable thickness of the oscillation plate 11 is selectively determined from a range between about 1.0 $\mu$m and about 20 $\mu$m, depending on the purpose of application of the oscillation plate 11 and on the permissible range of displacement of the oscillation plate 11. In the present preferred embodiment, the thickness of the oscillation plate 11 is preferably about 3 $\mu$m. In most cases, the oscillation plate 11 preferably includes a silicon substrate of silicon single crystals. The oscillation plate 11 in the present preferred embodiment is formed by stopping the forming of the pressurizing chamber using an anisotropic etching process when a corresponding depth of the pressurizing chamber for the oscillation plate 11 is reached. Before the etching process, the oscillation plate 11 is preferably doped with p-type dopants or impurities, such as boron (B). When the depth for the oscillation plate 11 is reached during the etching process, the forming of the pressurizing chamber is stopped.

In a case in which the oscillation plate 11 is made of polysilicon, the electrode substrate 12 including the electrode 14 and the gap 13 defined therein is first prepared. Then, the surface of the electrode substrate 12 corresponding to the gap 13 is formed into a flat surface by depositing aluminum (Al) thereon. A thin layer of silicon is formed on the surface of the electrode substrate 12, and then, the aluminum is removed from the electrode substrate 12, so that the oscillation plate 11 is formed above the recessed portion of the electrode substrate 12.

In the electrostatic actuator of the present preferred embodiment, a dielectric layer is provided on at least one of the electrode 14 and the oscillation plate 11. That is, the dielectric layer may be provided on the bottom surface of the oscillation plate 11 which faces the electrode 14 via the gap 13. The dielectric layer for that case is made of, for example, silicon dioxide ($SiO_2$) or silicon nitride ($Si_3N_4$). Alternatively, the dielectric layer may be provided on the electrode 14 facing the oscillation plate 11 via the gap 13.

As shown in FIG. 1, the recessed portion of the electrode substrate 12 is configured with a generally concave cross-section taken along the shorter sides of the oscillation plate 11, such that the gap 13 between the electrode 14 and the oscillation plate 11 is gradually reduced in both directions from the middle point to the peripheral ends of the shorter sides.

The electrode substrate 12 may be formed of silicon single crystals, glass materials or other suitable materials. When a 4-inch silicon wafer of silicon single crystals is used, the electrode substrate 12 with a thickness of about 500 $\mu$m is often prepared by grinding the silicon wafer. When a 6-inch silicon wafer of silicon single crystals is used, the electrode substrate 12 with a thickness of about 600 $\mu$m is often prepared by grinding the silicon wafer. When a glass or ceramic material, other than silicon, is used for the electrode substrate 12, it is required that the difference in the thermal expansion coefficient between the material of the electrode substrate 12 and the material of the oscillation plate 11 is as small as possible. Such a glass material that meets the requirement may be used for the electrode substrate 12.

A suitable adhesive agent may be used for the bonding of the electrode substrate 12 to the oscillation plate 11. However, when both the oscillation plate 11 and the electrode substrate 12 are made of silicon single crystals, a direct bonding method using an oxidation layer ($SiO_2$) is more suitable to obtain an adequate level of the bonding with high reliability. In this case, it is desired that a heat-resistant glass layer is disposed in the bonded areas and the bonded areas are doped with p-type dopants. Further, when the electrode substrate 12 is made of a glass material and the oscillation plate 11 is made of silicon single crystals, the bonded areas are doped with p-type dopants.

In the ink-jet head including the electrostatic actuator of the above-described preferred embodiment, the oscillation plate 11 can be easily and properly actuated by the electrostatic force generated by a low driving voltage applied to the electrode 14 because the displacement of the oscillation plate 11 by the electrostatic force can start from the peripheral positions where the distance (the gap 13) between the electrode 14 and the oscillation plate 11 is relatively small. Therefore, the ink-jet head of the present preferred embodiment is efficient in providing a low-voltage actuation of the oscillation plate as well as a proper amount of ink ejected by the low-voltage actuation of the oscillation plate.

In the above-described preferred embodiment, the dielectric layer is provided on at least one of the electrode 14 and the oscillation plate 11. As a result, no short-circuit occurs on the electrostatic actuator even when the oscillation plate 11 is brought into contact with the electrode 14. Hence, the oscillation plate 11 can be strongly actuated to such a degree that the oscillation plate 11 contacts the electrode 14 by application of a driving voltage to the electrode 14.

Figure 2:
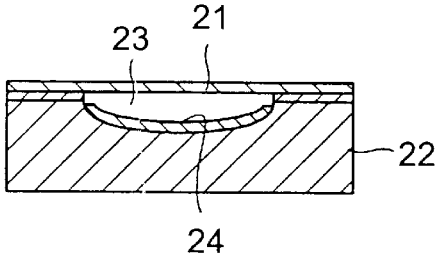
FIG. 2 is a diagram showing one example of a gap in the electrostatic actuator of FIG. 1.

FIG. 2 is a diagram showing one example of the gap of the electrostatic actuator of FIG. 1. The electrostatic actuator in this example generally includes an oscillation plate 21, an electrode substrate 22, an electrode 24, and a gap 23 provided between the oscillation plate 21 and the electrode 24.

The oscillation plate 21 preferably is made of silicon single crystals, and has a thickness of about 8 $\mu$m. The oscillation plate 21 also preferably has a substantially rectangular shape with longer sides that are about 3,000 $\mu$m long and shorter sides 130 $\mu$m long.

The electrode substrate 22 is formed from a silicon [100] wafer of silicon single crystals, and has a thickness of about 525 $\mu$m. The recessed portion of the electrode substrate 22 is configured to have a generally concave cross-section taken along the shorter sides of the oscillation plate 21, such that the gap 23 between the electrode 24 and the oscillation plate 21 is reduced in both directions from the middle point to the peripheral ends of the shorter sides. The, gap 23 at the middle point has a depth of about 0.3 $\mu$m. As shown in FIG. 2, the cross-section of the recessed portion of the electrode substrate 22 has an arc-like region that substantially extends from one of the ends of the shorter sides to the other. The electrode 24 is preferably made of a thin film of TiN with a thickness of about 3000 Å. The film of TiN is deposited on the recessed portion of the electrode substrate 22 by performing a radio-frequency (RF) sputtering. As a preliminary matter, a silicon oxide layer (not shown) is formed on the recessed portion of the electrode substrate 22 as the base layer of the electrode 24. Further, the electrode 24 is covered with a protective layer of silicon nitride (with a thickness of 5000 Å) which is formed via a plasma CVD method. The bonded areas of the oscillation plate 21 and the electrode substrate 22 are produced by performing the direct bonding method using an oxidation layer ($SiO_2$).

FIG. 5A, FIG. 5B, FIG. 5C, FIG. 5D and FIG. 5E show a forming process of a gap in the electrode substrate, shown in FIG. 2, in a method of production of the ink-jet head of the present preferred embodiment.

Figure 5A:
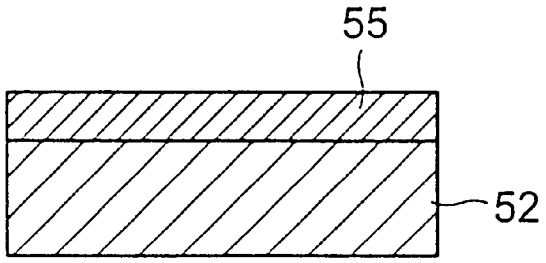
FIG. 5A, FIG. 5B, FIG. 5C, FIG. 5D and FIG. 5E are diagrams for explaining a process for forming a gap in the electrode substrate, shown in FIG. 2, in a method of production of the electrostatic actuator including the gap shown in FIG. 2.

As shown in FIG. 5A, at a start of the forming process, a photoresist (e.g., OFPR-800 from Tokyo-Oka) 55 is formed on an electrode substrate 52, which is prepared from a silicon wafer, and the photoresist 55 has a thickness of about 1 $\mu$m.

Figure 5B:
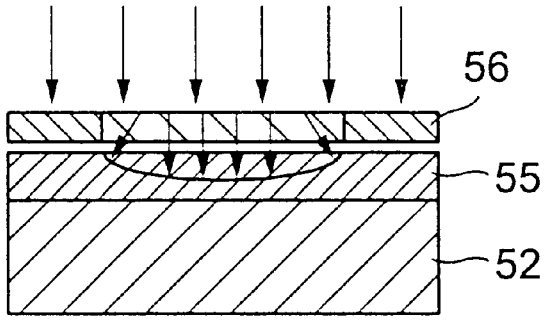

As shown in FIG. 5B, a photoresist 56 is formed on the photoresist 55, and the photoresist 55 is exposed to UV light through the photoresist 56. The photoresist 56 includes a substantially rectangular transparent region in the middle thereof, and the photoresist 56 is formed so that the light incident to the middle point of the transparent region passes through the photoresist 56 but the light incident to the peripheral ends of the transparent region is largely scattered.

Figure 5C:
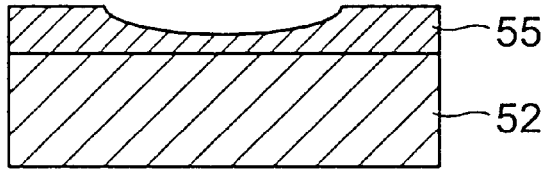

As shown in FIG. 5C, the unwanted portions of the photoresist 55 are removed by dissolving the photoresist 56. The intensity and exposure time of the light are suitably adjusted so that the recessed portion of the photoresist 55 does not reach the electrode substrate 52 at the time of the development.

Figure 5D:
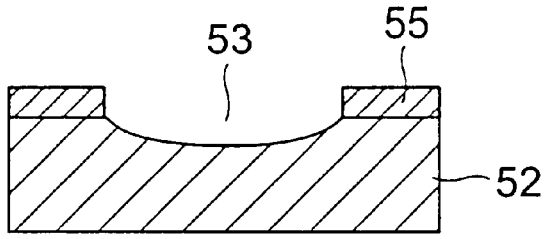

As shown in FIG. 5D, an anisotropic dry etching is performed on the photoresist 55 and the electrode substrate 52. The pattern of the recessed portion of the photoresist 55 is transferred to the electrode substrate 52 by the etching process. A mixture of $O_2$ and $SF_6$ gases is preferably used as the etching gas. The etching conditions are adjusted so that the rate of etching of the photoresist 55 is substantially equal to the rate of etching of the electrode substrate 52. Hence, a recessed portion 53 of the electrode substrate 52 is produced to have a generally concave cross-section.

Figure 5E:
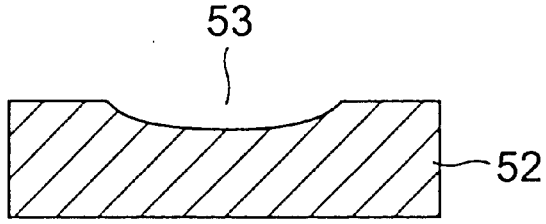

As shown in FIG. 5E, after the etching is performed, the photoresist 55 remaining on the electrode substrate 52 is removed. In order to protect the peripheral surfaces of the electrode substrate 52 which are bonded to the oscillation plate, the photoresist 55 has been left there. If no problem arises on the bonding of the electrode substrate 52 and the oscillation plate, the photoresist 55 can be completely removed as shown in FIG. 5E.

Figure 3:
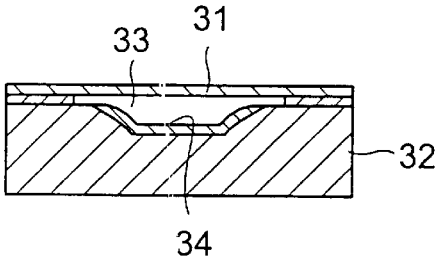
FIG. 3 is a diagram showing another example of the gap in the electrostatic actuator of FIG. 1.

FIG. 3 is a diagram showing another example of the gap of the electrostatic actuator of FIG. 1. The electrostatic actuator in this example generally includes an oscillation plate 31, an electrode substrate 32, an electrode 34, and a gap 33 provided between the oscillation plate 31 and the electrode 34.

The oscillation plate 31 is preferably made of silicon single crystals, and has a thickness of about 5 $\mu$m. The oscillation plate 31 preferably has a substantially rectangular shape with longer sides of about 3,000 $\mu$m long and shorter sides of about 130 $\mu$m long.

The electrode substrate 32 is formed from a glass material (Pyrex glass#7740), and has a thickness of about 1 mm. The recessed portion of the electrode substrate 22 preferably has a substantially concave cross-section along the shorter sides of the oscillation plate 31, such that the gap 33 between the electrode 34 and the oscillation plate 31 is reduced in both directions from the middle point to the peripheral ends of the shorter sides. The gap 33 at the middle point has a depth of about 0.5 $\mu$m. As shown in FIG. 3, the cross-section of the recessed portion of the electrode substrate 32 has a flat region surrounding the middle point and convex regions each extending from the flat region to one of the ends of the shorter sides. The electrode 34 is preferably formed by a thin film of Al with a thickness of about 3,000 Å. The film of Al is deposited on the recessed portion of the electrode substrate 32 by performing a radio-frequency (RF) sputtering. Further, the electrode 34 is covered with a protective layer of silicon nitride (with a thickness of 5000 Å) which is formed by performing a plasma CVD method. The bonded areas of the oscillation plate 31 and the electrode substrate 32 are doped with p-type dopants.

FIG. 6A, FIG. 6B, FIG. 6C, FIG. 6D and FIG. 6E show a forming process of the gap in the electrode substrate, shown in FIG. 3, in the method of production of the ink-jet head of the present preferred embodiment.

Figure 6A:
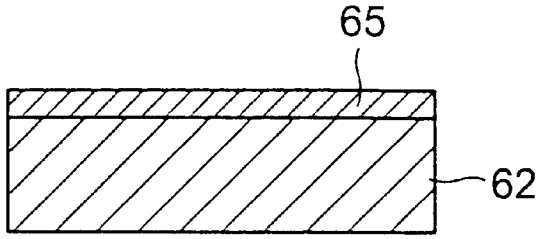
FIG. 6A, FIG. 6B, FIG. 6C, FIG. 6D and FIG. 6E are diagrams for explaining a process for forming a gap in the electrode substrate, shown in FIG. 3, in a method of production of an ink-jet head according to a preferred embodiment.

As shown in FIG. 6A, at a start of the forming process, a photoresist 65 (e.g., OFPR-800 from Tokyo-Oka) is formed on an electrode substrate 62, which is prepared from the glass material (Pyrex glass #7740). The photoresist 65 has a thickness of about 1 $\mu$m.

Figure 6B:
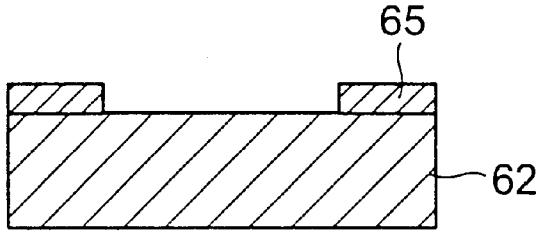

As shown in FIG. 6B, a photoresist (not shown) is formed on the photoresist 65, and the photoresist 65 is exposed to UV light through the photoresist. The unwanted portion of the photoresist 65 is removed by dissolving the photoresist. In this case, the removed portion of the photoresist 65 reaches the electrode substrate 62, and the corresponding portion of the electrode substrate 62 appears.

Figure 6C:
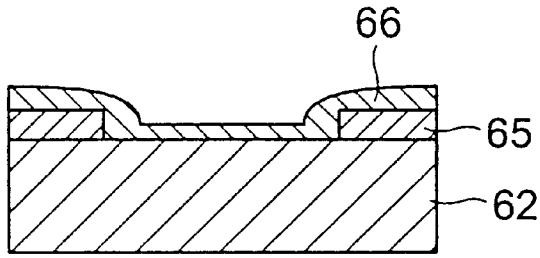

As shown in FIG. 6C, a photoresist 66 is formed on the remaining photoresist 65 and the portion of the electrode substrate 62, and the portion of the electrode substrate 62 is exposed to UV light through the photoresist 66. The photoresist 66 includes a substantially rectangular transparent region in the middle thereof, and the photoresist 66 is formed so that the light incident upon the middle point of the transparent region passes. Further, the photoresist 66 includes a flat region surrounding the middle point and convex regions at the peripheral positions corresponding to the remaining portions of the photoresist 65.

Figure 6D:
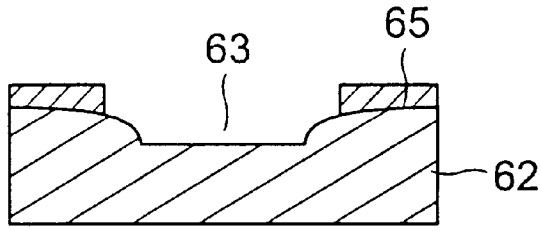

As shown in FIG. 6D, an anisotropic dry etching is performed to the photoresist (65, 66) and the electrode substrate 62. The pattern of the photoresist 66 is transferred to the electrode substrate 62 by the etching process. A mixture of $O_2$ and $CF_4$ gases is used as the etching gas. The etching conditions are adjusted so that the rate of etching of the photoresist (65, 66) is substantially equal to the rate of etching of the electrode substrate 62. Hence, a recessed portion 63 of the electrode substrate 62 has a substantially concave cross-section.

Figure 6E:
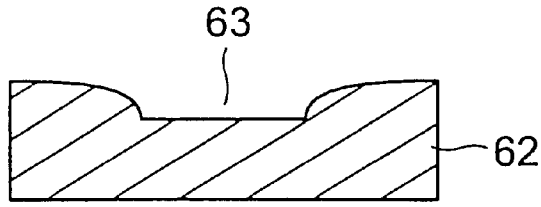

As shown in FIG. 6E, after the etching is performed, the photoresist 65 remaining on the electrode substrate 62 is removed. In order to protect the peripheral surfaces of the electrode substrate 62 which are bonded to the oscillation plate, the photoresist 65 has been left there. If no problem arises on the bonding of the electrode substrate 62 and the oscillation plate, the photoresist 65 can be completely removed as shown in FIG. 6E.

Figure 4:
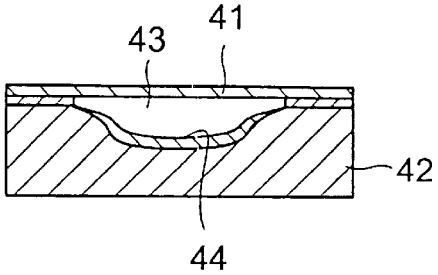
FIG. 4 is a diagram showing another example of the gap in the electrostatic actuator of FIG. 1.

FIG. 4 is a diagram showing another example of the gap of the electrostatic actuator of FIG. 1. The electrostatic actuator in this example preferably includes an oscillation plate 41, an electrode substrates 42, an electrode 44, and a gap 43 provided between the oscillation plate 41 and the electrode 44.

The oscillation plate 41 is made of silicon single crystals, and has a thickness of about 8 $\mu$m. The oscillation plate 41 preferably has a substantially rectangular with longer sides of about 3,000 $\mu$m long and shorter sides of about 130 $\mu$m long.

The electrode substrate 42 is formed from a silicon [100] wafer of silicon single crystals having a thickness of about 525 $\mu$m. The recessed portion of the electrode substrate 42 preferably has a substantially a generally concave cross-section taken along the shorter sides of the oscillation plate 41, such that the gap 43 between the electrode 44 and the oscillation plate 41 is reduced in both directions from the middle point to the peripheral ends of the shorter sides. The gap 43 at the middle point preferably has a depth of about 0.3 $\mu$m. As shown in FIG. 4, the cross-section of the recessed portion of the electrode substrate 42 has a central arc-like region surrounding the middle point and convex regions each extending from the arc-like region to one of the ends of the shorter sides. The electrode 44 is formed by a thin film of TiN with a thickness of about 3,000 Å. The film of TiN is deposited on the recessed portion of the electrode substrate 42 by performing the RF sputtering. As a preliminary matter, a silicon oxide layer (not shown) is formed on the recessed portion of the electrode substrate 42 as the base layer of the electrode 44. Further, the electrode 44 is covered with a protective layer of silicon nitride (with a thickness of 5,000 Å) which is formed by performing a plasma CVD method. The bonded areas of the oscillation plate 41 and the electrode substrate 42 are produced by the direct bonding method using the oxidation layer of silicon oxide.

FIG. 7A, FIG. 7B, FIG. 7C, FIG. 7D, FIG. 7E and FIG. 7F show a process of forming the gap in the electrode substrate, shown in FIG. 4, in the method of production of the ink-jet head according to a preferred embodiment of the present invention.

Figure 7A:
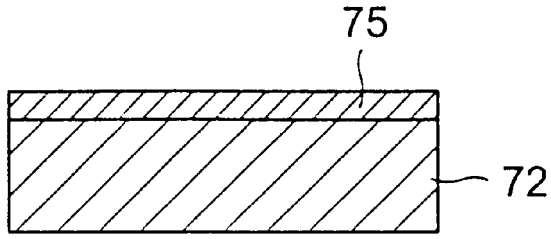
FIG. 7A, FIG. 7B, FIG. 7C, FIG. 7D, FIG. 7E and FIG. 7F are diagrams for explaining a process of forming a gap in the electrode substrate, shown in FIG. 4, in a method of production of the ink-jet head according to a preferred embodiment.

As shown in FIG. 7A, at a start of the forming process, a photoresist (OFPR-800) 75 is formed on an electrode substrate 72, which is prepared from a silicon [100] wafer of silicon single crystals, and the photoresist 75 has a thickness of about 1 $\mu$m.

Figure 7B:
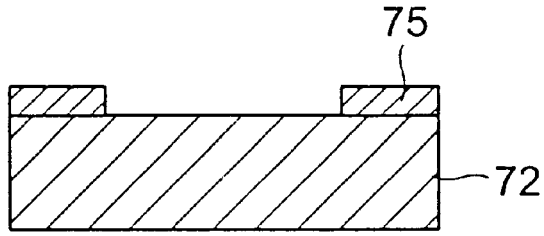

As shown in FIG. 7B, a photoresist (not shown) is formed on the photoresist 75, and the photoresist 75 is exposed to UV light through the photoresist. The unwanted portion of the photoresist 75 is removed by dissolving the photoresist. In this case, the removed portion of the photoresist 75 reaches the electrode substrate 72, and the corresponding portion of the electrode substrate 72 appears.

Figure 7C:
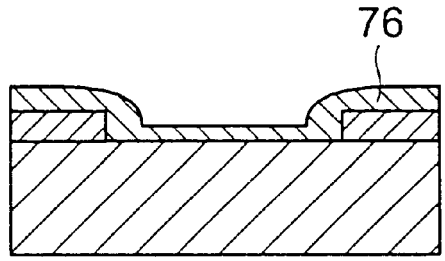

As shown in FIG. 7C, a photoresist 76 is formed on the remaining photoresist 75 and the portion of the electrode substrate 72, and the photoresist 76 is heated to a temperature that allows a flow of the photoresist 76 to take place.

Figure 7D:
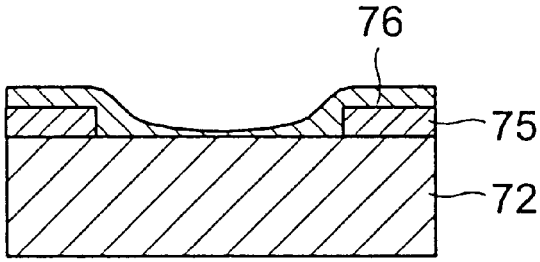

As shown in FIG. 7D, due to the heating, the photoresist 76 includes an arc-like region surrounding the middle point and convex regions at the peripheral positions corresponding to the remaining portions of the photoresist 75.

Figure 7E:
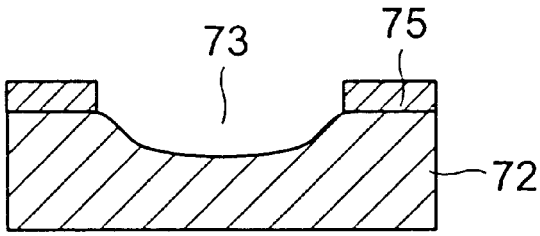

As shown in FIG. 7E, an anisotropic dry etching is performed on the photoresist (75, 76) and the electrode substrate 72. The pattern of the photoresist 76 is transferred to the electrode substrate 72 by the etching process. A mixture of $O_2$ and $SF_6$ gases is used as the etching gas. The etching conditions are adjusted so that the rate of etching of the photoresist (75, 76) is substantially equal to the rate of etching of the electrode substrate 72. Hence, a recessed portion 73 of the electrode substrate 72 is formed with a generally concave cross-section.

Figure 7F:
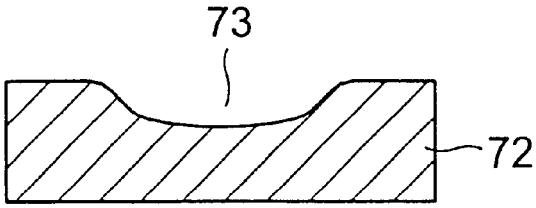

As shown in FIG. 7F, after the etching is performed, the photoresist 75 remaining on the electrode substrate 72 is removed. In order to protect the peripheral surfaces of the electrode substrate 72 which are bonded to the oscillation plate, the photoresist 75 has been left there. If no problem arises on the bonding of the electrode substrate 72 and the oscillation plate, the photoresist 75 can be completely removed as shown in FIG. 7F.

Figure 8A:
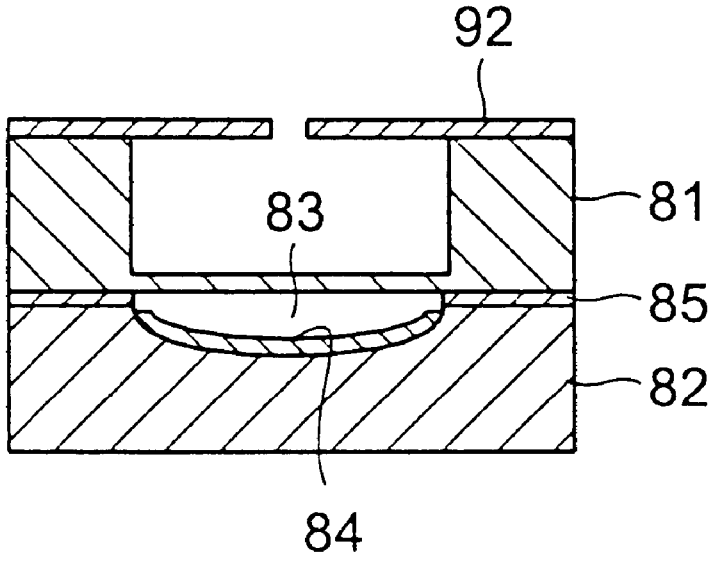
FIG. 8A and FIG. 8B are diagrams showing the ink-jet head incorporating the electrostatic actuator of a preferred embodiment of the present invention.
Figure 8B:
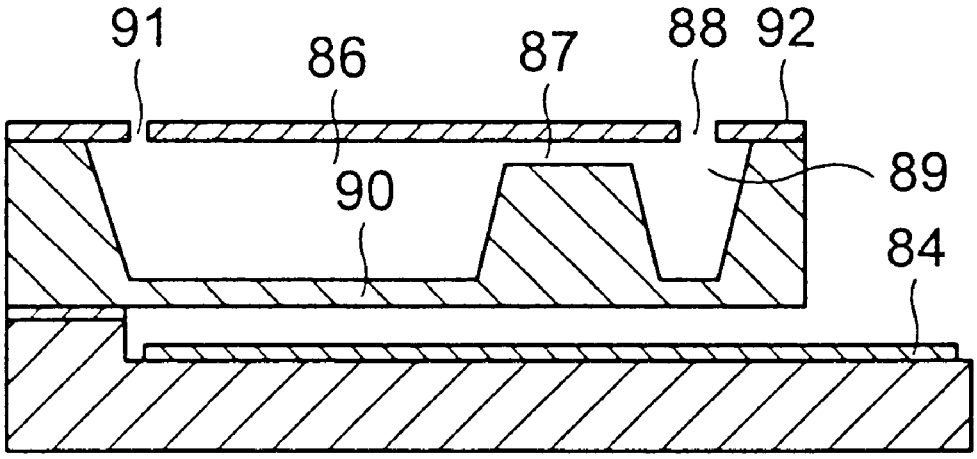

FIG. 8A and FIG. 8B show an ink-jet head of the present preferred embodiment which incorporates the electrostatic actuator of FIG. 1 therein. FIG. 8A is a cross-sectional view of the ink-jet head taken along a lateral line thereof. FIG. 8B is a crosssectional view of the ink-jet head taken along a longitudinal line thereof.

As shown in FIG. 8A and FIG. 8B, the ink-jet head of the present preferred embodiment includes a pressurizing-chamber member 81 arranged to define a pressuring chamber 86. A bottom of the pressurizing-chamber member 81 is partially formed as an oscillation plate 90 of the above-described electrostatic actuator. The pressuring-chamber member 81 is produced by performing an anisotropic etching of a silicon [110] wafer. The oscillation plate 90 may be formed by using silicon single crystals, and the oscillation plate 90 preferably has a thickness of about 3 $\mu$m.

An electrode substrate 82 is provided by using a silicon [100] wafer. The recessed portion of the electrode substrate 82 is configured to have a cross-section, taken along the shorter sides of the oscillation plate 90, such that a gap 83 between an inwardly curved electrode 84 and the oscillation plate 90 is reduced from the middle point to the ends of the shorter sides.

The cross-section of the recessed portion of the electrode substrate 82 includes an arc-like region substantially extending from one of the ends of the shorter sides to the other. The gap 83 preferably has a depth of about 0.8 μm.

The electrode 84 is provided on the recessed portion of the electrode substrate 82. The electrode 84 is formed by a thin film of TiN having a thickness of about 0.3 μm on the insulating layer (not shown) which is formed on the electrode substrate 82. The electrode 84 is covered with a protective layer (not shown) of SiN having a thickness of about 0.15 μm. The protective layer of SiN is formed by performing a plasma CVD (chemical vapor deposition) process.

An oxidation layer 85 is provided to bond the electrode substrate 82 to the pressurizing-chamber member 81. The oxidation layer 85 has a thickness of about 0.2 μm. The bonding of the electrode substrate 82 to the pressurizing-chamber member 81 is performed by, for example, a direct bonding method using silicon dioxide.

The pressurizing chamber 86 is provided to pressurize the ink in the pressurizing chamber 86 when the oscillation plate 90 is actuated. The pressurizing chamber 86 preferably has a substantially rectangular shape with a longer-side length of about 3,500 μm and a shorter-side length of about 130 μm. An ink-transfer passage 87 is provided to connect the pressurizing chamber 86 and a common ink cavity 89. The ink-transfer passage 87 has a length of about 200 μm and a cross-sectional area of about 1,200 μm. The common ink cavity 89 is arranged to supply ink to each of a plurality of individual pressurizing chambers provided in the ink-jet head. The common ink cavity 89 preferably has a length of about 1,500 μm.

The oscillation plate 90 is preferably made of silicon single crystals and has a thickness of about 3 μm. The oscillation plate 90 is formed by stopping the forming of the pressurizing chamber 86 using an anisotropic etching process when a corresponding depth of the pressurizing chamber is reached. Before the etching process, the oscillation plate 90 is doped with p-type dopants such as boron (B). When the depth for the oscillation plate 90 is reached during the etching process, the forming of the pressurizing chamber in the member 81 is stopped.

A nozzle plate 92 is provided on the pressurizing-chamber member 81. The nozzle plate 92 includes a nozzle opening 91 and an ink-supply opening 88. The nozzle plate 92 is produced by performing an electrocasting of Ni. A hydrophobic surface treatment is applied to the nozzle plate 86. The ink-supply opening 88 is open to the common ink cavity 89. The nozzle opening 91 is open to the pressurizing chamber 86. The nozzle opening 91 is provided to eject an ink drop therefrom onto recording paper and preferably has a diameter of about 25 μm.

In the ink-jet head of the present preferred embodiment, upon application of a driving voltage to the electrode 84, the electrode 84 actuates the oscillation plate 90 by electrostatic force, so as to pressurize the ink in the pressurizing chamber 86, so that an ink drop is ejected from the nozzle opening 91 onto recording paper. After the ink drop is ejected, ink is supplied from the common ink cavity 89 through the ink-transfer passage 87 to the pressurizing chamber 86. The amount of ink ejected by the ink-jet head is controlled by the amount of displacement of the oscillation plate 90 by the actuation of the electrode 84.

In the ink-jet head of the present preferred embodiment, the oscillation plate 90 can be easily and properly actuated with a low driving voltage applied to the electrode 84 because the displacement of the oscillation plate 90 via an electrostatic force can start from the peripheral positions where the distance (the gap) between the electrode 84 and the oscillation plate 90 is relatively small. Further, the dielectric layer (the oxidation layer 85) is provided between the electrode 84 and the oscillation plate 90, and the oscillation plate 90 can be strongly actuated upon application of the driving voltage to the electrode 84, so as to contact the electrode 84.

The ink-jet head in the present preferred embodiment of FIG. 8A and FIG. 8B is illustrated as a single-head device, for the sake of simplicity of description. However, the ink-jet head of the present preferred invention can be easily constructed as a multiple ink-jet head array in which a plurality of ink-jet heads are provided on the same substrate.

Figure 9:
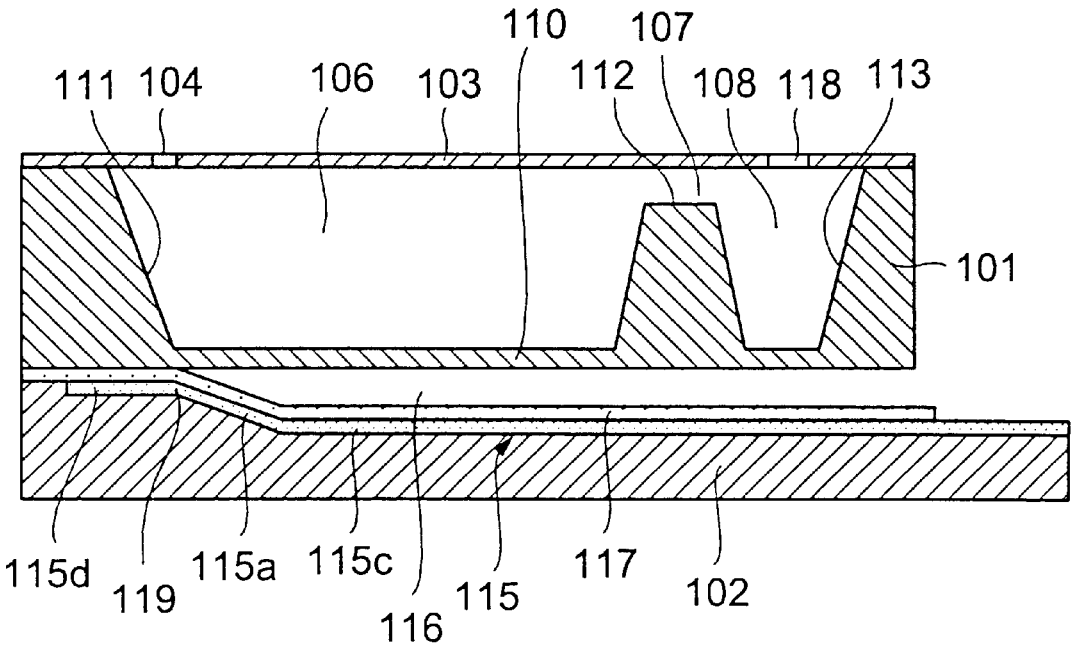
FIG. 9 is a cross-sectional view taken along a longitudinal line of the ink-jet head according to another preferred embodiment of the ink-jet head of the present invention.
Figure 10:
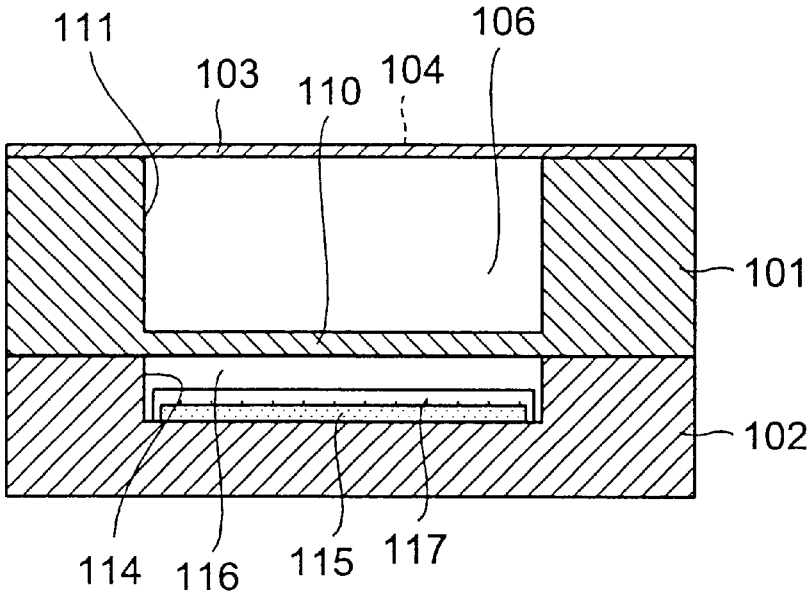
FIG. 10 is a cross-sectional view of the ink-jet head of FIG. 9 taken along a lateral line of the ink-jet head.
Figure 11:
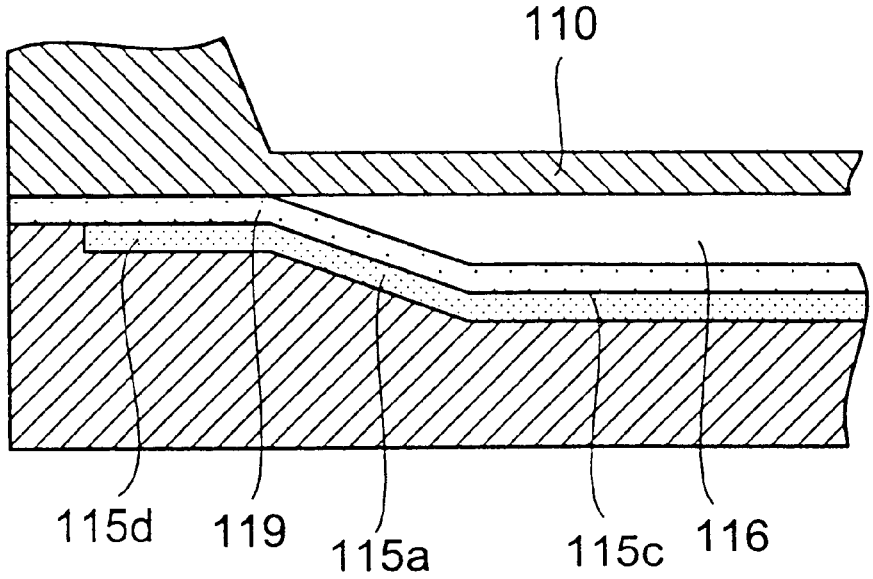
FIG. 11 is an enlarged view of a portion of the ink-jet head of FIG. 9.
Figure 12:
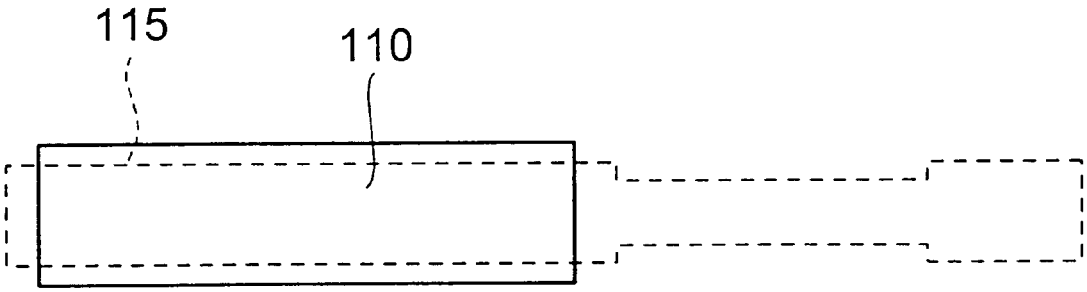
FIG. 12 is a diagram for explaining a relationship between an electrode and an oscillation plate in the ink-jet head of FIG. 9.

Next, FIG. 9 is a cross-sectional view of another preferred embodiment of the ink-jet head of the invention taken along a longitudinal line of the ink-jet head. FIG. 10 is a cross-sectional view of the ink-jet head of FIG. 9 taken along a lateral line of the ink-jet head. FIG. 11 is an enlarged view of an essential part of the ink-jet head of FIG. 9. FIG. 12 is a diagram for explaining a relationship between the electrode and the oscillation plate in the ink-jet head of FIG. 9.

As shown in FIG. 9 through FIG. 12, the ink-jet head of the present preferred embodiment includes a pressurizing-chamber member 101 arranged to define a pressuring chamber 106. A bottom of the pressurizing-chamber member 101 is partially formed as an oscillation plate 110. The pressurizing-chamber member 101 is produced by performing, for example, an anisotropic etching for a silicon [110] wafer. The oscillation plate 110 may be formed by using silicon single crystals, and the oscillation plate 110 preferably has a thickness of about 3 μm.

An electrode substrate 102 is provided by using, for example, a silicon [100] wafer. The electrode substrate 102 includes a recessed portion that defines an internal space between the oscillation plate 110 and the electrode substrate 102. The recessed portion of the electrode substrate 102 is defined by inside walls 114 of the substrate 102. The recessed portion of the electrode substrate 102 is configured to have a cross-section, taken along the longer sides of the oscillation plate 110, such that a gap 116 between an electrode 115 and the oscillation plate 110 is reduced from the middle point to one of peripheral ends of the longer sides of the oscillation plate 110.

The electrode 115 is provided on the recessed portion of the electrode substrate 102. The electrode 115 is formed by using either a metallic material (e.g., Al, Al alloys, Cr, Ni, Ni—Cr alloys, Pt, Au, Mo, Ti, TiN, W, etc.) or a conductive ceramic material (e.g., polysilicon) on the insulating layer (not shown) which is formed on the electrode substrate 102, and the electrode 115 preferably has a thickness that ranges from about 0.3 μm to about 1.0 μm. A dielectric protective layer 117 is provided on the electrode 115, and the protective layer 117 has a thickness that preferably ranges from about 0.5 μm to about 5 μm. For example, the protective layer 117 may be formed by performing a plasma CVD (chemical vapor deposition) process. The gap 116 between the electrode 115 and the oscillation plate 110 at the middle point of the longer sides thereof has a depth that preferably ranges from about 0.1 μm to about 0.8 μm.

The pressurizing chamber 106 is arranged to pressurize the ink in the pressurizing chamber 106 when the oscillation plate 110 is actuated. The pressurizing chamber 106 is defined by inside walls 111 of the member 101. The pressurizing chamber 106 preferably has a substantially rectangular shape a longer-side length within a range of 200 $\mu$m to about 4,000 $\mu$m and a short-side length in a range of about 60 $\mu$m to about 500 $\mu$m. An ink-transfer passage 107 is arranged to connect the pressurizing chamber 106 and a common ink cavity 108. The ink-transfer passage 107 is defined by a grooved portion 112 of the member 101. The common ink cavity 108 is arranged to supply ink to each of a plurality of individual pressurizing chambers provided in the ink-jet head. The common ink cavity 108 is defined by a nozzle plate 103 and inside walls 113 of the member 101.

The oscillation plate 110 is made of, for example, silicon single crystals. The oscillation plate 110 is formed by stopping the forming of the pressurizing chamber 106 using an anisotropic etching process when a corresponding depth of the pressurizing chamber for the oscillation plate 110 is reached. Before the etching process, the oscillation plate 110 is doped with p-type dopants or impurities, such as boron (B). When the depth for the oscillation plate 110 is reached during the etching process, the forming of the pressurizing chamber is stopped.

The nozzle plate 103 is provided on the pressurizing-chamber member 101. The nozzle plate 103 includes a nozzle opening 104 and an ink-supply opening 118. The nozzle plate 103 is produced by performing, for example, an electrocasting of Ni. A hydrophobic surface treatment is applied to the nozzle plate 103. The ink-supply opening 118 is open to the common ink cavity 108. The nozzle opening 104 is open to the pressurizing chamber 106. The nozzle opening 104 is arranged to eject an ink drop therefrom onto recording paper.

As shown in FIG. 9 and FIG. 11, in the ink-jet head of the present preferred embodiment, the electrode 115 is configured with a cross-section taken along the longer sides of the oscillation plate 110, such that the gap 116 between the electrode 115 and the oscillation plate 110 is reduced in the direction from the middle point to one of the peripheral ends of the longer sides of the oscillation plate 110. The cross-section of the electrode 115 includes a bottom flat region 115*c* surrounding the middle point and a slope region 115*a* extending from the bottom flat region 115*c* to one of the peripheral ends of the longer sides. Further, the cross-section of the electrode 115 includes an upper flat region 115*d* extending from the slope region 115*a*. The dielectric protective layer 117 at a boundary 119 between the upper flat region 115*d* and the slope region 115*a* is brought in contact with the oscillation plate 110 at the end of the longer sides thereof.

In the ink-jet head of the present preferred embodiment, upon application of a driving voltage to the electrode 115, the electrode 115 actuates the oscillation plate 110 via an electrostatic force, so that the ink-jet head ejects an ink drop from the nozzle opening 104 by pressurizing the ink in the pressurizing chamber 106. After the ink drop is ejected, ink is supplied from the common ink cavity 108 through the ink-transfer passage 107 to the pressurizing chamber 106. The amount of ink ejected by the ink-jet head is controlled by the amount of displacement of the oscillation plate 110 by the actuation of the electrode 115.

In the ink-jet head of the present preferred embodiment, the oscillation plate 110 can be easily and properly actuated with a low driving voltage applied to the electrode 115 because the displacement of the oscillation plate 110 via an electrostatic force can start from the peripheral positions where the distance (the gap) between the electrode 115 and the oscillation plate 110 is relatively small. Further, the dielectric layer 117 is provided between the electrode 115 and the oscillation plate 110, and the oscillation plate 110 can be strongly actuated upon application of the driving voltage to the electrode 115, so as to contact the electrode 115.

Accordingly, the ink-jet head of the present preferred embodiment is efficient in providing a low-voltage actuation of the oscillation plate 110 as well as a proper amount of ink ejected by the low-voltage actuation of the oscillation plate 110.

Figure 13:
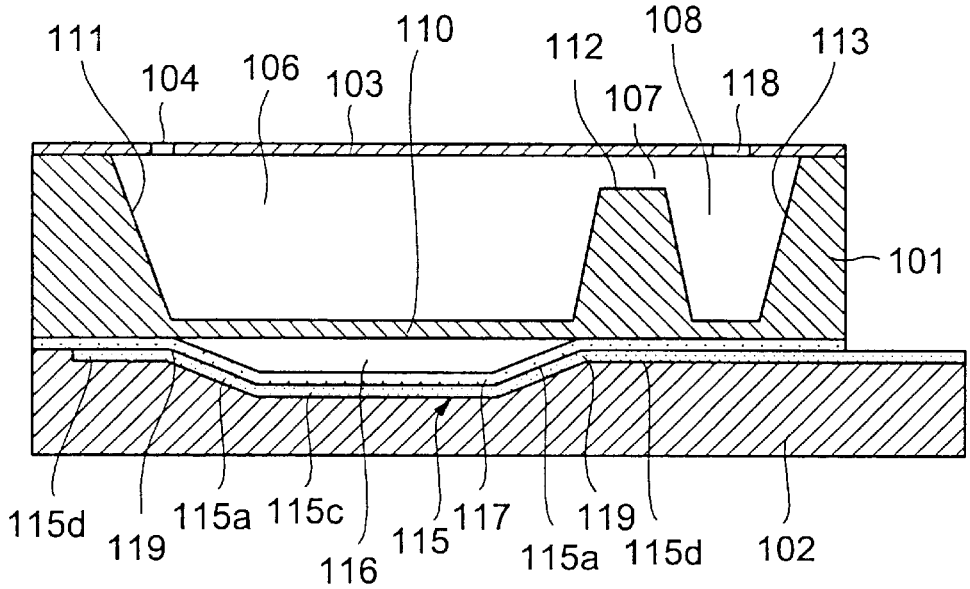
FIG. 13 is a cross-sectional view of a variation of the ink-jet head of FIG. 9 taken along a longitudinal line of the ink-jet head.
Figure 14:
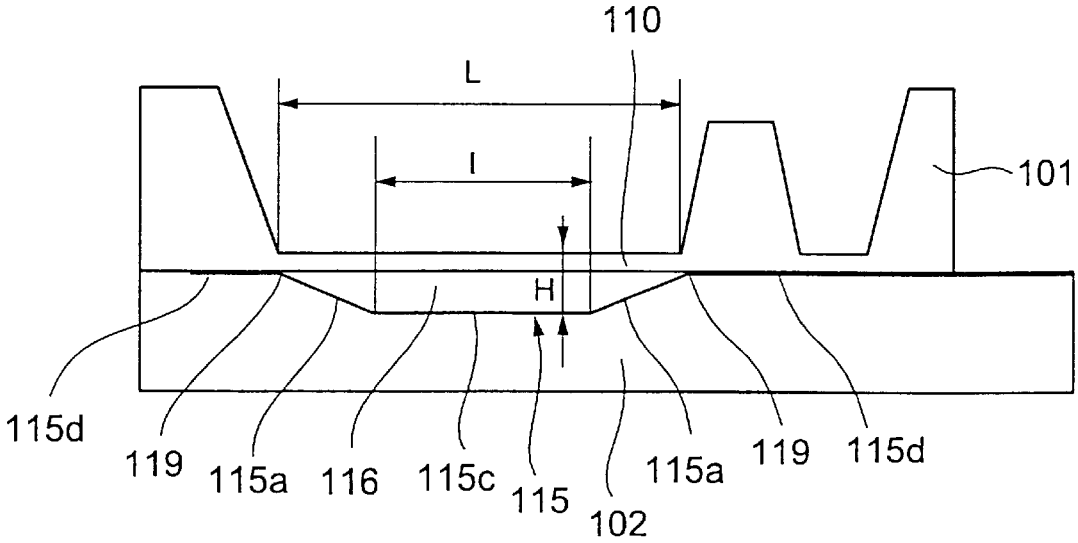
FIG. 14 is a diagram for explaining a configuration of the ink-jet head of FIG. 13.

FIG. 13 is a cross-sectional view of a variation of the ink-jet head of FIG. 9 taken along a longitudinal line of the ink-jet head. FIG. 14 is a plan view of the electrode and the oscillation plate for explaining a relationship between the electrode and the oscillation plate in the ink-jet head of FIG. 13.

As shown in FIG. 13, the ink-jet head of the present preferred embodiment is configured in a manner similar to the previous preferred embodiment of FIG. 9. In FIG. 13, the elements which are essentially the same as corresponding elements in FIG. 9 are designated by the same reference numerals, and a description thereof will be omitted.

In the ink-jet head of the present preferred embodiment, the electrode 115 is configured with a cross-section taken along the longer sides of the oscillation plate 110, such that the gap 116 between the electrode 115 and the oscillation plate 110 is reduced in both the directions from the middle point of the longer sides to a first end (near the nozzle opening 104) of the longer sides and to a second end (near the ink-supply opening 118) of the longer sides. The cross-section of the electrode 115 includes a bottom flat region 115*c* surrounding the middle point and a pair of slope regions 115*a* each extending from the bottom flat region 115*c* to one of the first and second ends of the longer sides. Further, the cross-section of the electrode 115 includes a pair of upper flat regions 115*d* each extending from one of the slope regions 115*a*. The dielectric protective layer 117 at boundaries 119 between the upper flat regions 115*d* and the slope regions 115*a* is arranged to contact the oscillation plate 110 at the first and second ends of the longer sides thereof.

In the ink-jet head of the present preferred embodiment, upon application of a driving voltage to the electrode 115, the electrode 115 actuates the oscillation plate 110 via an electrostatic force, so that the ink-jet head ejects an ink drop from the nozzle opening 104 by pressurizing the ink in the pressurizing chamber 106. After the ink drop is ejected, ink is supplied from the common ink cavity 108 through the ink-transfer passage 107 to the pressurizing chamber 106. The amount of ink ejected by the ink-jet head is controlled by the amount of displacement of the oscillation plate 110 by the actuation of the electrode 115.

In the ink-jet head of the present embodiment, the oscillation plate 110 can be easily and properly actuated with a low driving voltage applied to the electrode 115 because the displacement of the oscillation plate 110 by electrostatic force can start from the peripheral positions where the distance (the gap) between the electrode 115 and the oscillation plate 110 is relatively small. Further, the dielectric layer 117 is provided between the electrode 115 and the oscillation plate 110, and the oscillation plate 110 can be strongly actuated upon application of the driving voltage to the electrode 115, so as to contact the electrode 115.

Accordingly, the ink-jet head of the present embodiment is efficient in providing a low-voltage actuation of the oscillation plate 110 as well as a proper amount of ink ejected by the low-voltage actuation of the oscillation plate 110.

As shown in FIG. 14, in the ink-jet head of the present embodiment, it is preferred to configure the ink-jet head such that a length "L" of the longer sides of the oscillation plate 110, a length "I" of the bottom flat region 115*c* of the electrode 115 and a distance "H"between the oscillation plate 110 and the bottom flat region 115*c* of the electrode 115 meet the conditions: $I/L \geqq 1/10$ and $2H/(L-I) < 1/10$. If the above conditions are not met, the ink-jet head may have a difficulty in providing a low-voltage actuation of the oscillation plate 110 as well as a proper amount of ink ejected by the low-voltage actuation of the oscillation plate 110.

Figure 15:
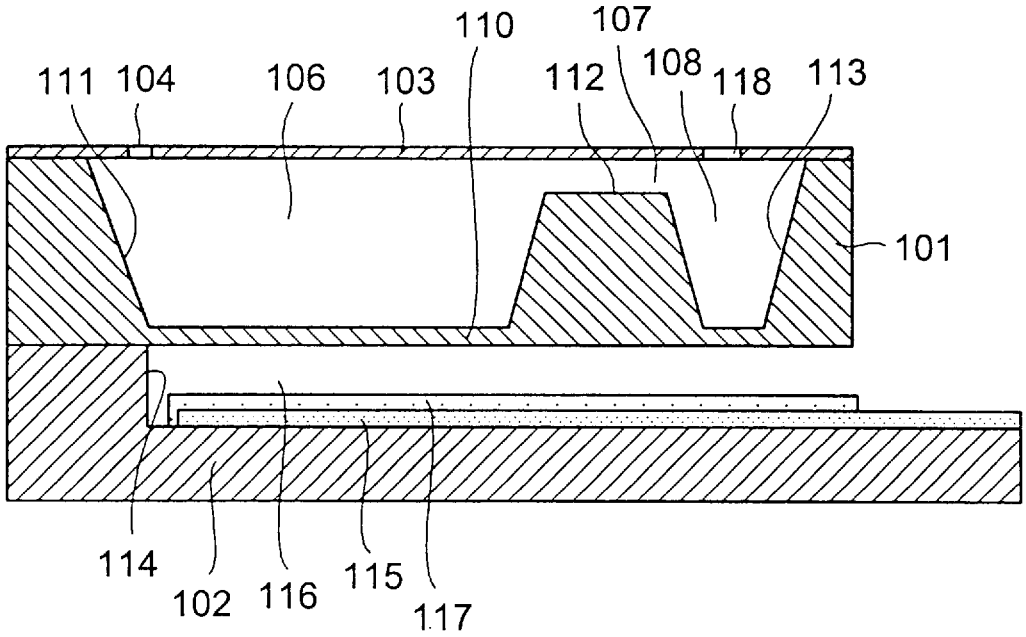
FIG. 15 is a cross-sectional view of another variation of the ink-jet head of FIG. 9 taken along a longitudinal line of the ink-jet head.
Figure 16:
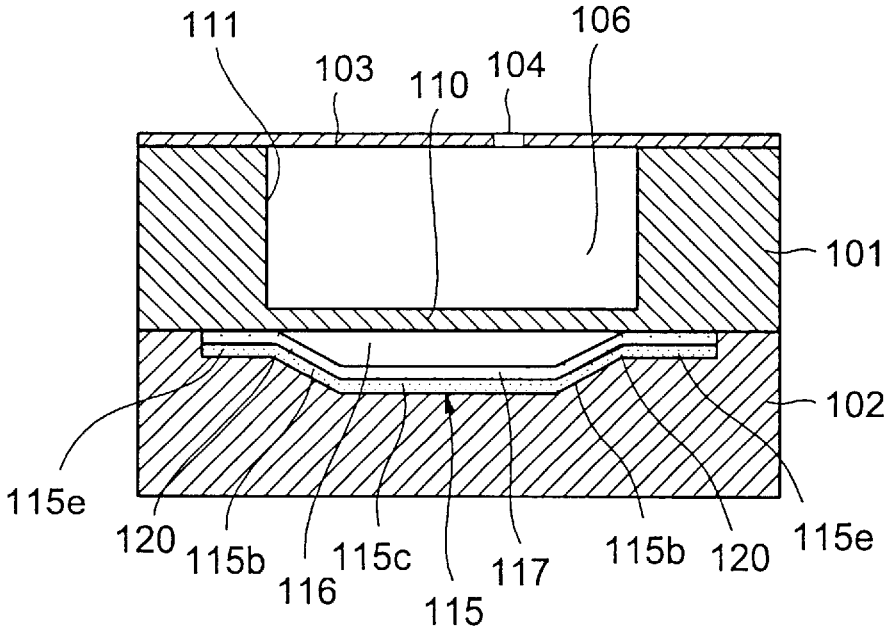
FIG. 16 is a cross-sectional view of the ink-jet head according to a preferred embodiment taken along a lateral line of the ink-jet head.
Figure 17:
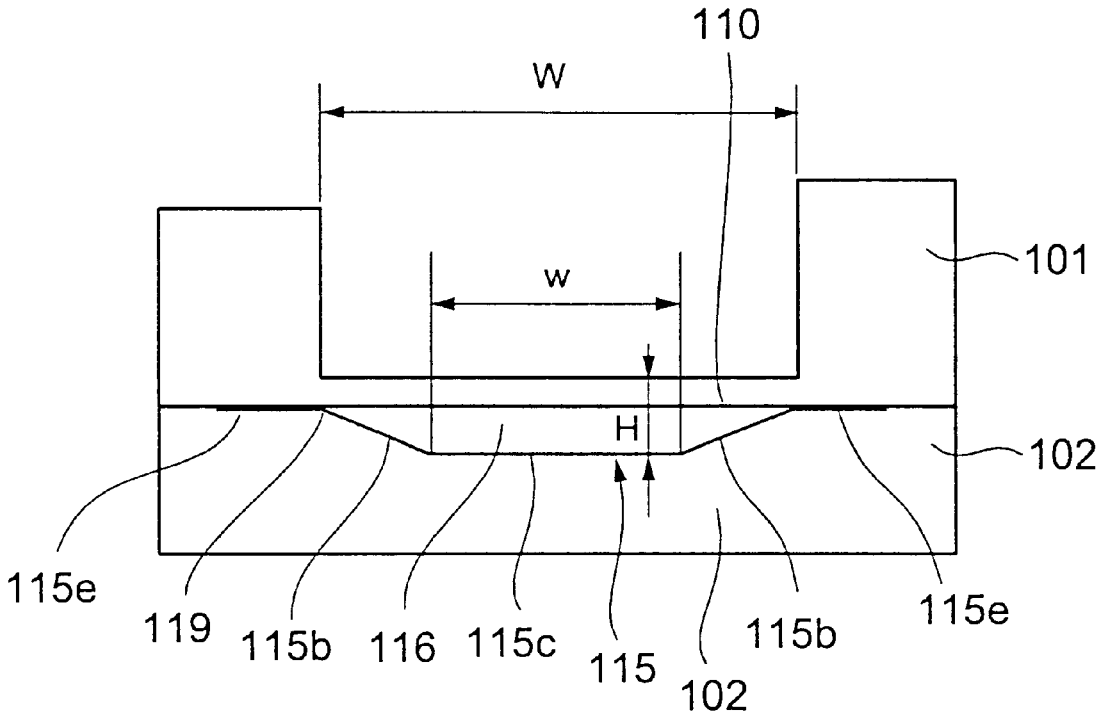
FIG. 17 is a diagram for explaining a configuration of the ink-jet head of FIG. 15.
Figure 18:
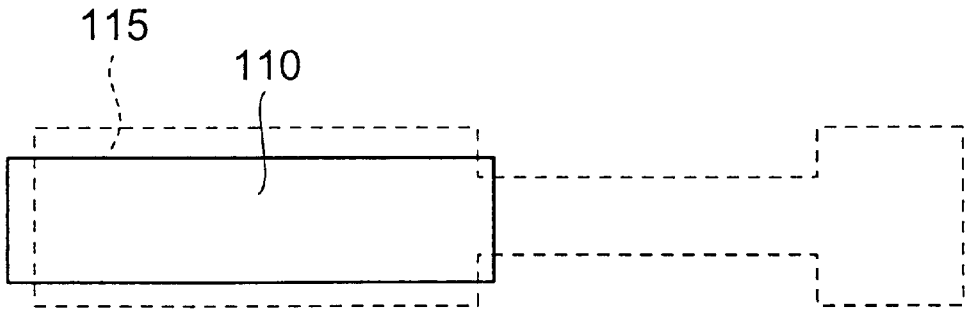
FIG. 18 is a diagram for explaining a relationship between an electrode and an oscillation plate in the ink-jet head of FIG. 15.

FIG. 15 is a cross-sectional view of another variation of the ink-jet head of FIG. 9 taken along a longitudinal line of the ink-jet head. FIG. 16 is a cross-sectional view of the ink-jet head of FIG. 15 taken along a lateral line of the ink-jet head. FIG. 17 is a diagram for explaining a configuration of the ink-jet head of FIG. 15. FIG. 18 is a plan view of the electrode and the oscillation plate for explaining a relationship between the electrode and the oscillation plate in the ink-jet head of FIG. 15.

As shown in FIG. 15 and FIG. 16, the ink-jet head of the present preferred embodiment is configured in a manner similar to the previous preferred embodiment of FIG. 9, except the cross-sections of the electrode 115. In FIG. 15 and FIG. 16, the elements which are essentially the same as corresponding elements in FIG. 9 are designated by the same reference numerals, and a description thereof will be omitted to avoid repetition.

In the ink-jet head of the present preferred embodiment, the electrode 115 preferably has a cross-section taken along the shorter sides of the oscillation plate 110, such that the gap 116 between the electrode 115 and the oscillation plate 110 is reduced in both directions from the middle point of the shorter sides to a first end (the left side of FIG. 16) of the shorter sides and to a second end (the right side of FIG. 16) of the shorter sides. The cross-section of the electrode 115 includes a bottom flat region 115*c* surrounding the middle point and a pair of slope regions 115*b* each extending from the bottom flat region 115c to one of the first and second ends of the shorter sides. Further, the cross-section of the electrode 115 includes a pair of upper flat regions 115*e* each extending from one of the slope regions 115*b*. The dielectric protective layer 117 at boundaries 120 between the upper flat regions 115*e* and the slope regions 115*b* is brought in contact with the oscillation plate 110 at the first and second ends of the shorter sides thereof.

In the ink-jet head of the present preferred embodiment, upon application of a driving voltage to the electrode 115, the electrode 115 actuates the oscillation plate 110 via an electrostatic force, so that the ink-jet head ejects an ink drop from the nozzle opening 104 by pressurizing the ink in the pressurizing chamber 106. After the ink drop is ejected, ink is supplied from the common ink cavity 108 through the ink-transfer passage 107 to the pressurizing chamber 106. The amount of ink ejected by the ink-jet head is controlled by the amount of displacement of the oscillation plate 110 by the actuation of the electrode 115.

In the ink-jet head of the present preferred embodiment, the oscillation plate 110 can be easily and properly actuated with a low driving voltage applied to the electrode 115 because the displacement of the oscillation plate 110 by electrostatic force can start from the peripheral positions where the distance (the gap) between the electrode 115 and the oscillation plate 110 is relatively small. Further, the dielectric layer 117 is provided between the electrode 115 and the oscillation plate 110, and the oscillation plate 110 can be strongly actuated upon application of the driving voltage to the electrode 115, so as to contact the electrode 115.

Accordingly, the ink-jet head of the present preferred embodiment is efficient in providing a low-voltage actuation of the oscillation plate 110 as well as a very accurate amount of ink ejected by the low-voltage actuation of the oscillation plate 110.

As shown in FIG. 17, in the ink-jet head of the present preferred embodiment, it is preferred to configure the ink-jet head such that a width "W" of the shorter sides of the oscillation plate 110, a width "w" of the bottom flat region 115*c* of the electrode 115 and a distance "H" between the oscillation plate 110 and the bottom flat region 115*c* of the electrode 115 meet the conditions: $w/W \geqq 1/10$ and $2H/(W-w) < 1/10$. If the above conditions are not met, the ink-jet head may have a difficulty in providing a low-voltage actuation of the oscillation plate 110 as well as a proper amount of ink ejected by the low-voltage actuation of the oscillation plate 110.

Figure 19:
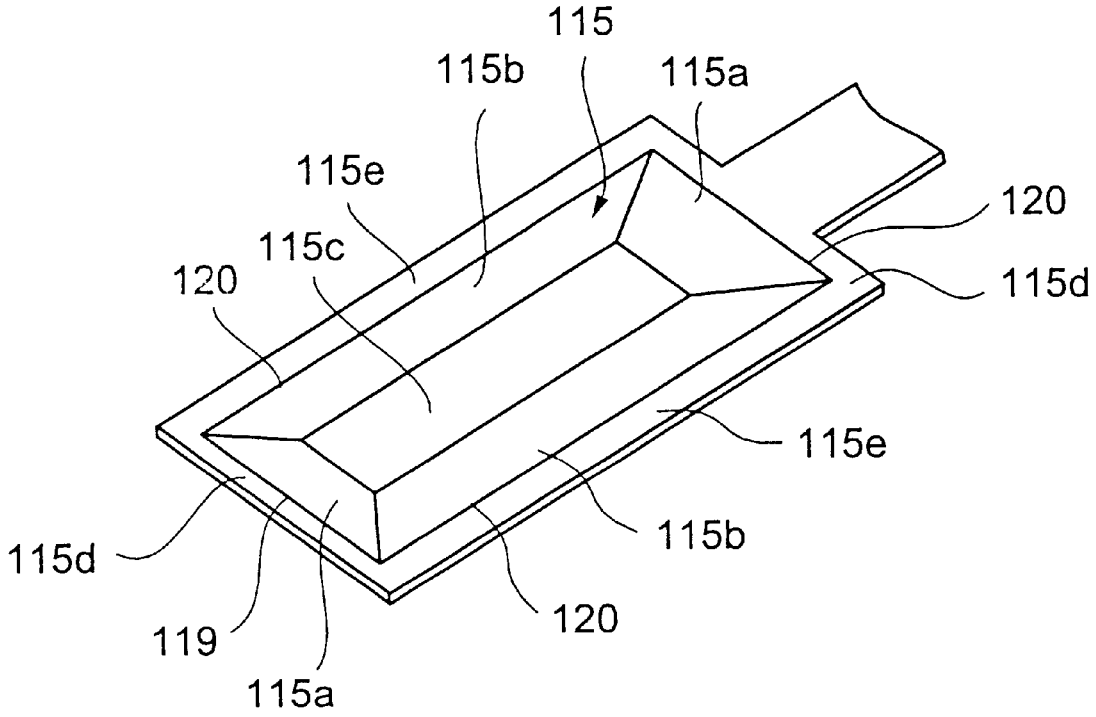
FIG. 19 is a perspective view of an electrode according to another variation of a preferred embodiment of the ink-jet head of FIG. 9.
Figure 20:
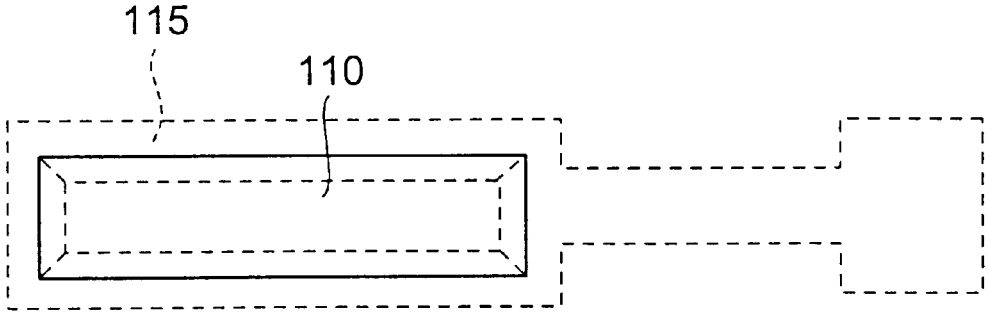
FIG. 20 is a diagram for explaining a relationship between the electrode and the oscillation plate in an ink-jet head according to a preferred embodiment of the present invention.

FIG. 19 is a perspective view of an electrode in another variation of the ink-jet head of FIG. 9. FIG. 20 is a plan view of the electrode and the oscillation plate for explaining a relationship between the electrode and the oscillation plate in the ink-jet head of FIG. 19.

As shown in FIG. 19, in the ink-jet head of the present preferred embodiment, the electrode 115 is configured with a first cross-section taken along the longer sides of the oscillation plate and a second cross-section taken along the shorter sides of the oscillation plate, such that the gap between the electrode 115 and the oscillation plate is reduced in both the directions from the middle point of the longer sides to a first end (the left-lower side of FIG. 19) of the longer sides and to a second end (the right-upper side of FIG. 19) of the longer sides and reduced in both the directions from the middle point of the shorter sides and to a third end (the left-upper side of the FIG. 19) of the shorter sides and to a fourth end (the right-lower side of the FIG. 19) of the shorter sides.

Further, in the ink-jet head of the present preferred embodiment, the first cross-section of the electrode 115 includes a first flat region 115*c* (or the bottom flat region 115*c*) surrounding the middle point and a pair of first slope regions 115*a* each extending from the first flat region 115*c* toward one of the first and second ends of the longer sides. The second cross-section of the electrode 115 includes a second flat region 115*c* (or the bottom flat region 115*c*) surrounding the middle point and a pair of second slope regions 115*b* each extending from the second flat region 115*c* toward one of the third and fourth ends of the shorter sides. The first cross-section of the electrode 115 further includes a pair of first upper flat regions 115*d* each extending from one of the first slope regions 115*a*. The second cross-section of the electrode 115 further includes a pair of second upper flat regions 115*e* each extending from one of the second slope regions 115*b*. The dielectric protective layer 117 at boundaries 119 between the first upper flat regions 115*d* and the first slope regions 115*a* and at boundaries 120 between the second upper flat regions 115*e* and the second slope regions 115*b* is arranged to contact the oscillation plate 110 at the respective ends of the longer sides and the shorter sides thereof.

In the ink-jet head of the present preferred embodiment, upon application of a driving voltage to the electrode 115, the electrode 115 actuates the oscillation plate 110 via an electrostatic force, so that the ink-jet head ejects an ink drop from the nozzle opening 104 by pressurizing the ink in the pressurizing chamber 106. After the ink drop is ejected, ink is supplied from the common ink cavity 108 through the ink-transfer passage 107 to the pressurizing chamber 106. The amount of ink ejected by the ink-jet head is controlled by the amount of displacement of the oscillation plate 110 by the actuation of the electrode 115.

In the ink-jet head of the present preferred embodiment, the oscillation plate 110 can be easily and properly actuated with a low driving voltage applied to the electrode 115 because the displacement of the oscillation plate 110 by electrostatic force can start from the peripheral positions where the distance (the gap) between the electrode 115 and the oscillation plate 110 is relatively small. Further, the dielectric layer 117 is provided between the electrode 115 and the oscillation plate 110, and the oscillation plate 110 can be strongly actuated upon application of the driving voltage to the electrode 115, so as to contact the electrode 115.

Accordingly, the ink-jet head of the present preferred embodiment is efficient in providing a low-voltage actuation of the oscillation plate 110 as well as a proper amount of ink ejected by the low-voltage actuation of the oscillation plate 110.

Figure 21:
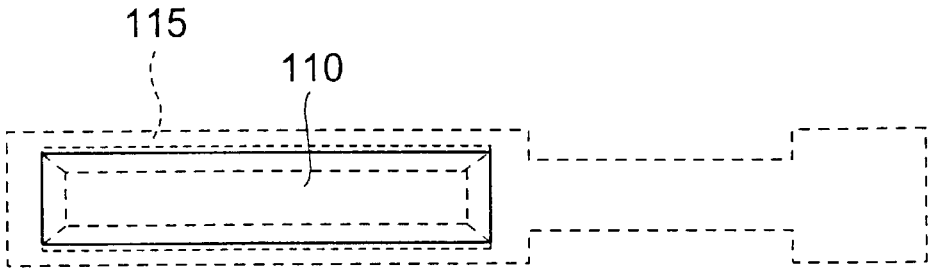
FIG. 21 is a diagram for explaining a relationship between the electrode and the oscillation plate in an ink-jet head according to a preferred embodiment of the present invention.

As shown in FIG. 20, in the ink-jet head of the present preferred embodiment, the first slope regions 115*a* of the electrode 115 have the outer peripheral ends that correspond with the first and second ends of the longer sides of the oscillation plate 110, and the second slope regions 115*b* of the electrode 115 have the outer peripheral ends that correspond with the third and fourth ends of the shorter sides of the oscillation plate 110. The ink-jet head of the present invention is not limited to the above-described preferred embodiments. For example, the relationship between the electrode and the oscillation plate may be modified as shown in FIG. 21 and FIG. 22.

FIG. 20 is a plan view of the electrode and the oscillation plate for explaining another relationship between the electrode and the oscillation plate in the ink-jet head of FIG. 19. In the relationship between the electrode 115 and the oscillation plate 110 shown in FIG. 20, the first slope regions 115*a* of the electrode 115 have the outer peripheral ends that correspond with the first and second ends of the longer sides of the oscillation plate 110, and the second slope regions 115*b* of the electrode 115 have the outer peripheral ends that are located outside of the third and fourth ends of the shorter sides of the oscillation plate 110.

Figure 22:
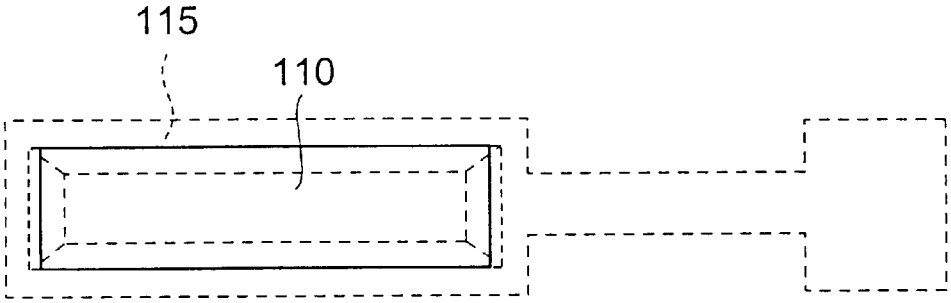
FIG. 22 is a diagram for explaining a relationship between the electrode and the oscillation plate in an ink-jet head according to a preferred embodiment of the present invention.

FIG. 22 is a plan view of the electrode and the oscillation plate for explaining another relationship between the electrode and the oscillation plate in the ink-jet head of FIG. 19. In the preferred embodiment of FIG. 22, the first slope regions 115*a* of the electrode 115 have the outer peripheral ends that are located outside of the first and second ends of the longer sides of the oscillation plate 110, and the second slope regions 115*b* of the electrode 115 have the outer peripheral ends that correspond with the third and fourth ends of the shorter sides of the oscillation plate 110.

Figure 23:
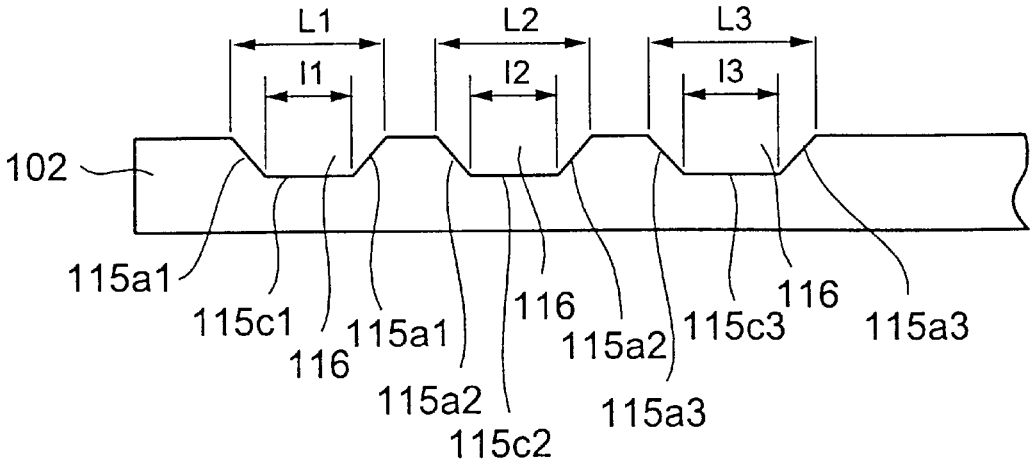
FIG. 23 is a cross-sectional view of an electrode substrate according to another variation of the ink-jet head of FIG. 9 according to a preferred embodiment of the present invention.

FIG. 23 is a cross-sectional view of an electrode substrate in another variation of the ink-jet head of FIG. 9. The cross-sectional view of FIG. 23 shows the electrode substrate 102 taken along a longitudinal line of the ink-jet head.

As shown in FIG. 23, the electrode substrate 102 in the present preferred embodiment is configured with a plurality of recessed portions 116 (or gaps 116) that define a plurality of internal spaces between the oscillation plate and the electrode substrate 102. The electrode 115 in the present preferred embodiment is configured with a plurality of bottom flat regions 115*c*1, 115*c*2, 115*c*3, . . . , and a plurality of pairs of slope regions 115*a*1, 115*a*2, 115*a*3, . . . Each of the bottom flat regions 115*c*1, 115*c*2, 115*c*3, . . . surrounds the middle point of one of the recessed portions 116. Each of the slope regions 115*a*1, 115*a*2, 115*a*3, . . . extends from one of the bottom flat regions in both the directions.

In the ink-jet head of the present preferred embodiment, the oscillation plate can be easily and properly actuated with a low driving voltage applied to the electrode in a more accurate manner that can be applied to the printing of a multiple graylevel image.

In order to provide a low-voltage actuation of the oscillation plate as well as a proper amount of ink ejected by the low-voltage actuation of the oscillation plate, it is preferred to configure the electrode substrate 102 such that the adjacent slope regions 115*a*(n−1) and 115*an* of the electrode 115 contact each other, and the gap at the contact points of the adjacent slope regions is zero.

Further, it is preferred to configure the ink-jet head of the present preferred embodiment such that respective lengths L1, L2, . . . , Ln of the divisional parts of the oscillation plate along the longer sides thereof, and respective lengths I1, I2, . . . , In of the bottom flat regions 115*c*1, 115*c*2, . . . , 115*cn* of the electrode 115 meet the condition: (I1+I2+. . . +In)/(L1+L2+. . . +Ln)≧1/10. If the above condition is not met, the ink-jet head may have a difficulty in providing a low-voltage actuation of the oscillation plate as well as a proper amount of ink ejected by the low-voltage actuation of the oscillation plate.

Figure 24:
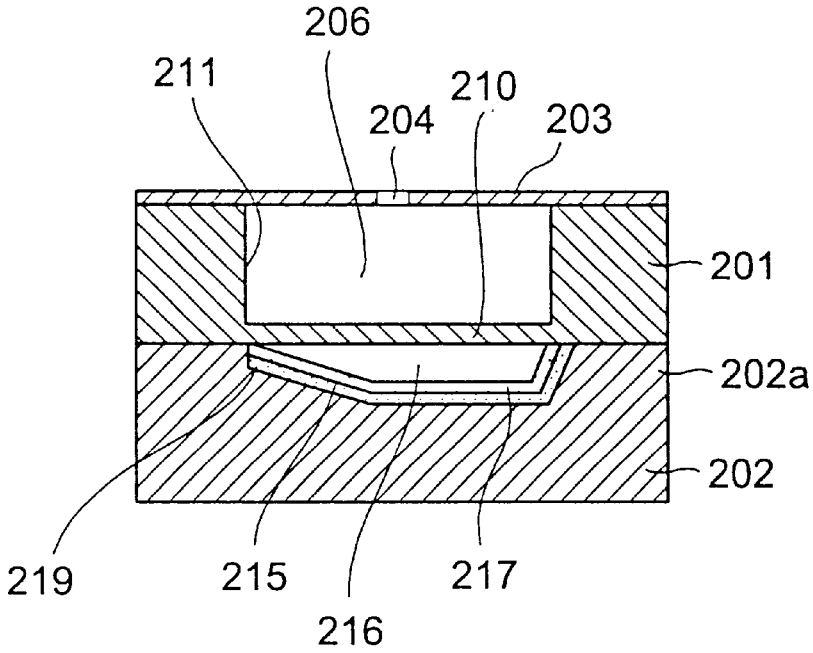
FIG. 24 is a cross-sectional view of another preferred embodiment of the ink-jet head of the invention taken along a lateral line thereof.
Figure 25:
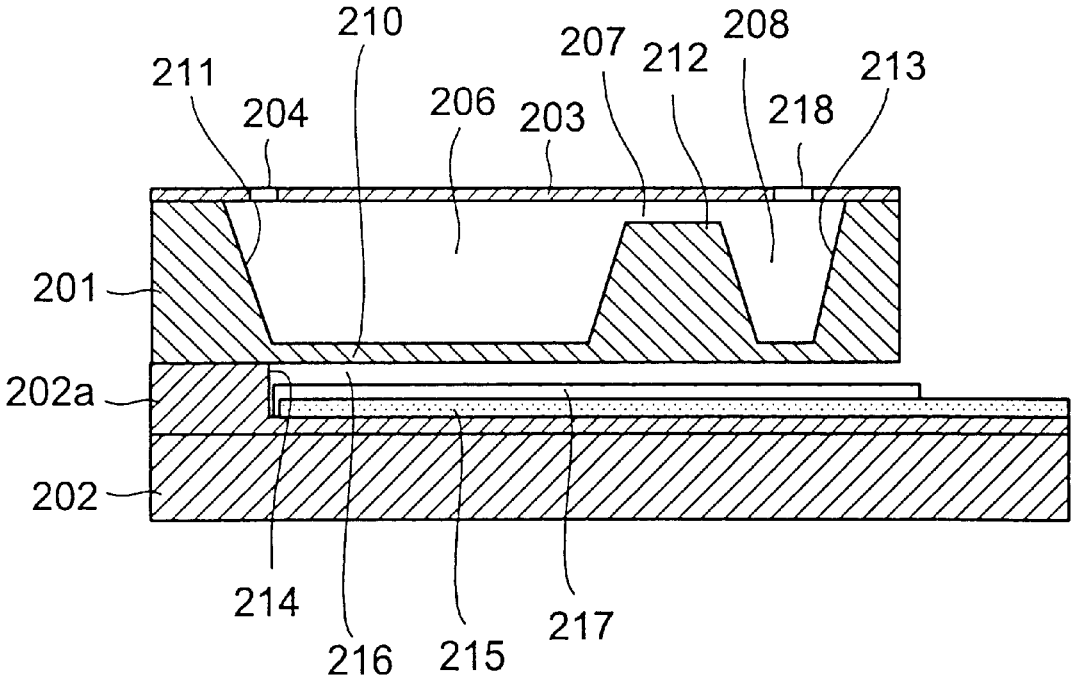
FIG. 25 is a cross-sectional view of the ink-jet head of another preferred embodiment taken along a longitudinal line thereof.

Next, FIG. 24 is a cross-sectional view of another preferred embodiment of the ink-jet head of the invention taken along a lateral line of the ink-jet head. FIG. 25 is a cross-sectional view of the ink-jet head of the present preferred embodiment taken along a longitudinal line thereof.

As shown in FIG. 24 and FIG. 25, the ink-jet head of the present preferred embodiment includes a pressurizing-chamber member 201 arranged to define a pressurizing chamber 206. A bottom of the pressurizing-chamber member 201 is partially formed as an oscillation plate 210. The pressurizing-chamber member 201 is produced by performing, for example, an anisotropic etching for a silicon [110] wafer. The oscillation plate 210 may be formed by using silicon single crystals.

An electrode substrate 202 is provided by using, for example, a silicon [100] wafer. The electrode substrate 202 includes a recessed portion that defines an internal space between the oscillation plate 210 and the electrode substrate 202. The recessed portion of the electrode substrate 202 is defined by inside walls 214 of an oxidation layer 202*a* of the substrate 202. The recessed portion of the electrode substrate 202 is configured to have a cross-section, taken along the shorter sides of the oscillation plate 210, such that a gap 216 between an electrode 215 and the oscillation plate 210 is reduced in both directions from the middle point to the peripheral ends of the shorter sides of the oscillation plate 210. More specifically, in the present preferred embodiment, the recessed portion of the electrode substrate 202 has the cross-section taken along the shorter sides of the oscillation plate 210, such that a rate of reduction of the gap 216 between the electrode 215 and the oscillation plate 210 in a first direction from the middle point to a first end (the left side of FIG. 24) of the shorter sides is less than a rate of reduction of the gap 216 in a second direction from the middle point to a second end (the right side of FIG. 24) of the shorter sides.

The electrode 215 is provided on the recessed portion of the electrode substrate 202. The electrode 215 is preferably made of either a metallic material (e.g., Al, Al alloys, Cr, Ni, Ni—Cr alloys, Pt, Au, Mo, Ti, TiN, W, etc.) or a conductive ceramic material (e.g., polysilicon), and the electrode 215 has a thickness that ranges from about 0.03 μm to about 1.0 μm. A dielectric protective layer 217 is provided on the electrode 215, and the protective layer 217 has a thickness that ranges from about 0.05 μm to about 5 μm. For example, the protective layer 217 may be formed by performing a plasma CVD (chemical vapor deposition) process. The gap 216 between the electrode 215 and the oscillation plate 210 at the middle point of the shorter sides thereof has a depth that ranges from about 0.1 μm to about 5.0 μm.

The pressurizing chamber 206 is provided to pressurize the ink in the pressurizing chamber 206 when the oscillation plate 210 is actuated. The pressurizing chamber 206 is defined by inside walls 211 of the member 201. The pressurizing chamber 206 preferably has a substantially rectangular shape with a longer-side length in a range of about 200 μm to about 4,000 μm and a shorter-side length of about 60 μm to about 500 μm. An ink-transfer passage 207 is provided to connect the pressurizing chamber 206 and a common ink cavity 208. The ink-transfer passage 207 is defined by a grooved portion 212 of the member 201. The common ink cavity 208 is arranged to supply ink to each of a plurality of individual pressurizing chambers provided in the ink-jet head. The common ink cavity 208 is defined by a nozzle plate 203 and inside walls 213 of the member 201.

The oscillation plate 210 is made of, for example, silicon single crystals. The oscillation plate 210 is formed by stopping the forming of the pressurizing chamber 206 using an anisotropic etching process when a corresponding depth of the pressurizing chamber for the oscillation plate 210 is reached. Before the etching process, the oscillation plate 210 is doped with p-type dopants or impurities, such as boron (B). When the depth for the oscillation plate 210 is reached during the etching process, the forming of the pressurizing chamber is stopped.

The oscillation plate 210 and the electrode substrate 202 are preferably bonded together at end portions of the oxidation layer 202*a*, and the oxidation layer 202*a* at the end portions is doped with p-type dopants or impurities, such as boron.

The nozzle plate 203 is provided on the pressurizing-chamber member 201. The nozzle plate 203 includes a nozzle opening 204 and an ink-supply opening 218. The nozzle plate 203 is produced by performing, for example, an electrocasting of Ni. A hydrophobic surface treatment is applied to the nozzle plate 203. The ink-supply opening 218 is open to the common ink cavity 208. The nozzle opening 204 is open to the pressurizing chamber 206. The nozzle opening 204 is provided to eject an ink drop therefrom onto recording paper.

As shown in FIG. 24 and FIG. 25, in the ink-jet head of the present preferred embodiment, the electrode 215 preferably has a cross-section taken along the shorter sides of the oscillation plate 210, such that a rate of reduction of the gap 216 between the electrode 215 and the oscillation plate 210 in the first direction from the middle point to the first end of the shorter sides of the oscillation plate 110 differs from a rate of reduction of the gap 216 in the second direction from the middle point to the second end of the shorter sides.

In the ink-jet head of the present preferred embodiment, upon application of a driving voltage to the electrode 215, the electrode 215 actuates the oscillation plate 210 via an electrostatic force, so that the ink-jet head ejects an ink drop from the nozzle opening 204 by pressurizing the ink in the pressurizing chamber 206. After the ink drop is ejected, ink is supplied from the common ink cavity 208 through the ink-transfer passage 207 to the pressurizing chamber 206. The amount of ink ejected by the ink-jet head is controlled by the amount of displacement of the oscillation plate 210 by the actuation of the electrode 215.

In the ink-jet head of the present preferred embodiment, the oscillation plate 210 can be easily and properly actuated with a low driving voltage applied to the electrode 215 because the displacement of the oscillation plate 210 via an electrostatic force can start from the peripheral positions where the distance (the gap) between the electrode 215 and the oscillation plate 210 is relatively small. Further, the dielectric layer 217 is provided between the electrode 215 and the oscillation plate 210, and the oscillation plate 210 can be strongly actuated upon application of the driving voltage to the electrode 215, so as to contact the electrode 215.

Accordingly, the ink-jet head of the present preferred embodiment is efficient in providing a low-voltage actuation of the oscillation plate 210 as well as a proper amount of ink ejected by the low-voltage actuation of the oscillation plate 210.

Figure 28:
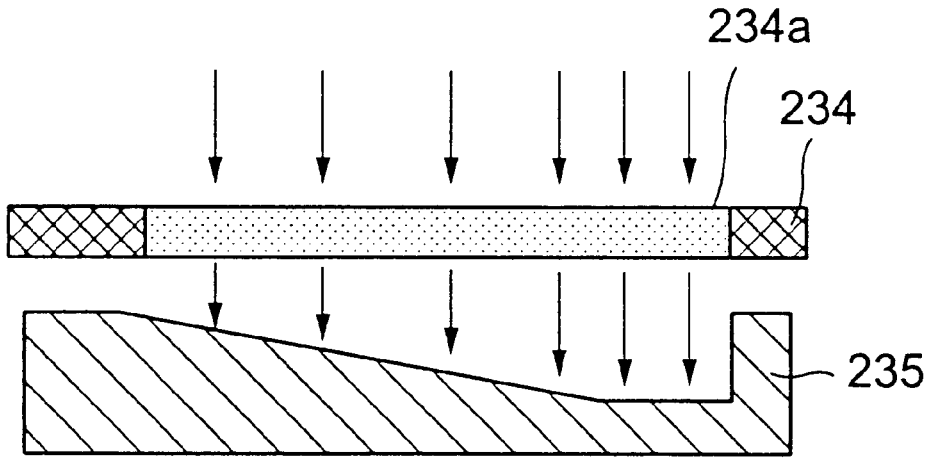
FIG. 28 is a diagram for explaining a process of forming a recessed portion in the production method of another preferred embodiment of the present invention.
Figure 29:
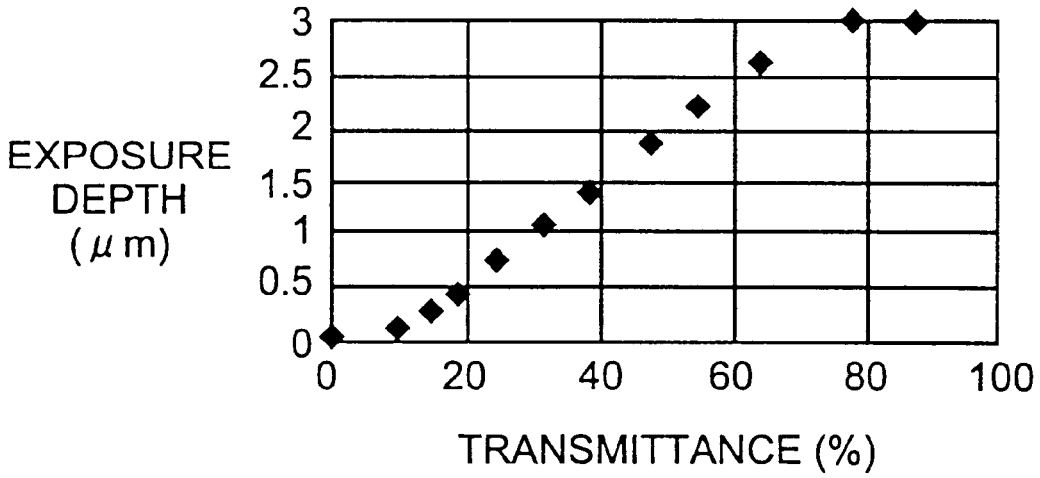
FIG. 29 is a diagram for explaining a relationship between transmittance of a photoresist and exposure depth in the production method of FIG. 28.
Figures 30A, 30B, 30C, 30D:
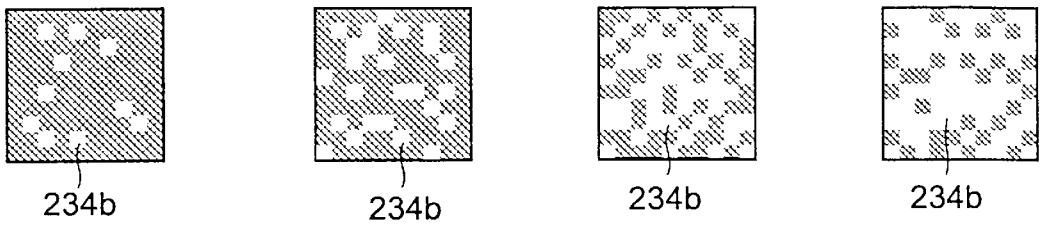
FIG. 30A, FIG. 30B, FIG. 30C and FIG. 30D are diagrams showing examples of photoresist patterns with different transmittances.

FIG. 26A, FIG. 26B, FIG. 26C, FIG. 26D and FIG. 26E are diagrams for explaining a process of forming a recessed portion of the electrode substrate in a method of production of the ink-jet head of a preferred embodiment of the present invention. FIG. 27A, FIG. 27B, FIG. 27C and FIG. 27D are diagrams for explaining a formation of a recessed portion of FIG. 26D in the production method of the present preferred embodiment of the present invention. FIG. 28 is a diagram for explaining a formation of a recessed portion in the production method of the present preferred embodiment of the present invention. FIG. 29 is a diagram for explaining a relationship between transmittance of a photoresist and exposure depth in the production method of FIG. 28.

Figure 26A:
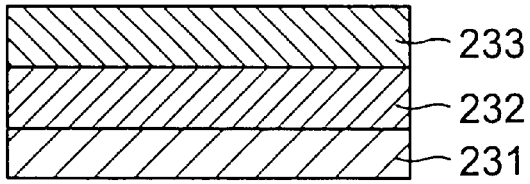
FIG. 26A, FIG. 26B, FIG. 26C, FIG. 26D and FIG. 26E are diagrams for explaining a method of production of the inkjet head according to a preferred embodiment of the present invention.

As shown in FIG. 26A, at a start of the forming process, an oxidation layer 232 (which corresponds to the oxidation layer 202*a* in FIG. 24) is formed on a silicon substrate 231 (which corresponds to the electrode substrate 202 in FIG. 24), and a photoresist layer 233 is formed on the oxidation layer 232.

Figure 26B:
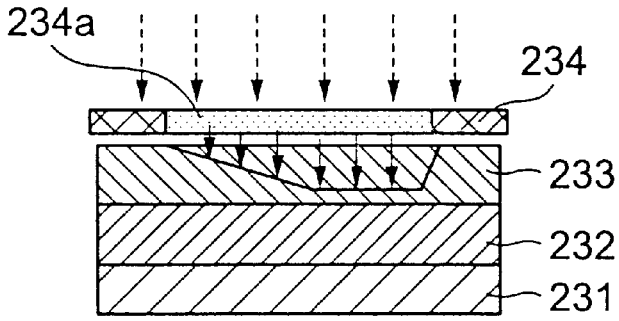

As shown in FIG. 26B, a photoresist 234 is formed on the photoresist layer 233, and the photoresist layer 233 is exposed to light through the photoresist 234. The photoresist 234 includes a light-transmitting portion 234*a* in the middle thereof, and the light-transmitting portion 234*a* has different transmittances allocated thereto. The photoresist 234 serves to perform such a function that the light incident to transparent regions of the light-transmitting portion 234*a* passes through the photoresist 234 but the light incident to opaque regions of the light-transmitting portion 234*a* is largely scattered.

In the present preferred embodiment, the photoresist layer 233 is preferably made of a positive photoresist OFPR-800 from Tokyo-Oka.

As shown in FIG. 28, the exposure depth of the photoresist layer 233 in this step is varied along the shorter sides of the oscillation plate by using the photoresist 234 having the light-transmitting portion 234*a* with the different transmittances. Generally, as shown in FIG. 29, the exposure depth of the photoresist layer 233 varies depending on the transmittance of the photoresist 234.

FIG. 30A, FIG. 30B, FIG. 30C and FIG. 30D show examples of photoresist patterns with different transmittances. As shown, each of the photoresist patterns used for the light-transmitting portion 234*a* of the photoresist 234 includes a number of apertures 234*b* which are arranged in a grid configuration. The larger the number of apertures 234*b,* the larger the transmittance of the photoresist.

Figures 31A, 31B, 31C:
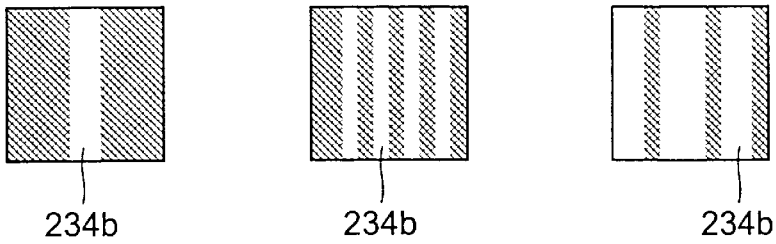

FIG. 31A, FIG. 31B and FIG. 31C show other examples of the photoresist patterns with different transmittances. As shown, each of the photoresist patterns used for the light-transmitting portion 234*a* of the photoresist 234 includes a number of slits 234*b* which are allocated with given widths and given intervals. The larger the number of slits 234*b* or the width of each slit in the light-transmitting portion 234*a* of the photoresist 234, the larger the transmittance of the photoresist 234.

As can be readily understood from FIG. 30A through FIG. 31C, the light-transmitting portion 234*a* of the photoresist 234 in the present preferred embodiment is configured with a transparent substrate and an opaque layer disposed on the transparent substrate, the opaque layer having different thicknesses that create the different transmittances of the light-transmitting portion 234*a*. The recessed portion of the electrode substrate 202 is formed by using the photoresist 234. Alternatively, the light-transmitting portion 234*a* of the photoresist 234 in the present preferred embodiment may be configured with a transparent substrate and an opaque layer formed on the transparent substrate, the opaque layer having aperture rates that create the different transmittances of the light-transmitting portion 234*a*. The recessed portion of the electrode substrate 202 is formed by using the photoresist 234.

Figure 26C:
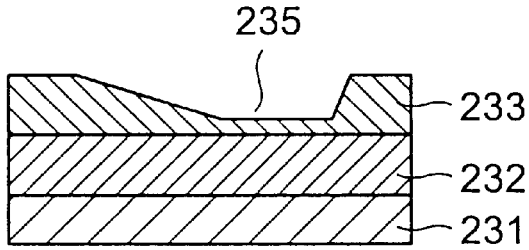

As shown in FIG. 26C, the unwanted portions of the photoresist layer 233 are removed by dissolving the photoresist 234, so that a recess 235 in the photoresist layer 233 is formed. Herein, the process of the formation of the recess 235 in the photoresist layer 233 is called a photolithographic process. The intensity and exposure time of the light are suitably adjusted so that the recess 235 in the photoresist layer 233 does not reach the oxidation layer 232 at the time of the development.

Figure 26D:
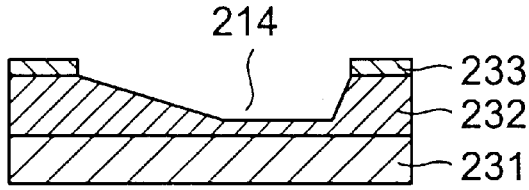

As shown in FIG. 26D, an anisotropic dry etching is performed on the photoresist layer 233 and the oxidation layer 232. The pattern of the recess 235 of the photoresist 233 is transferred to the oxidation layer 232 by the etching process. A mixture of $O_2$ and $SF_6$ gases is used as the etching gas. The etching conditions are adjusted so that the rate of etching of the photoresist 233 is substantially equal to the rate of etching of the oxidation layer 232. Hence, a recessed portion 214 of the oxidation layer 232 is formed.

Detailed conditions of the photoresist layer 233 and the oxidation layer 232, related to the formation of the recessed portion 214 in the step of FIG. 26D, are illustrated in FIG. 27A through FIG. 27D.

Figure 27A:
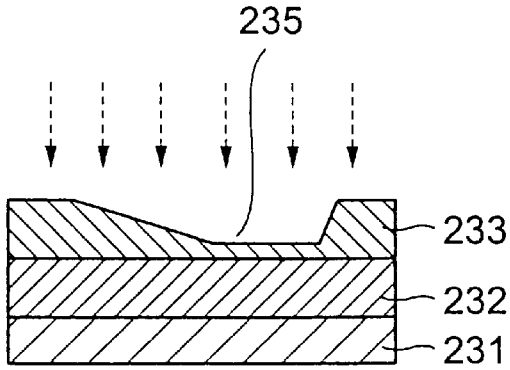
FIG. 27A, FIG. 27B, FIG. 27C and FIG. 27D are diagrams for explaining a process of forming a recessed portion of FIG. 26D in the production method of a preferred embodiment of the present invention.
Figure 27B:
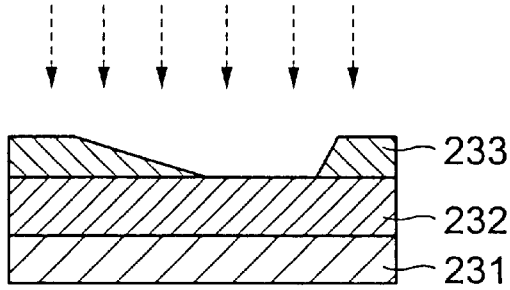
Figure 27C:
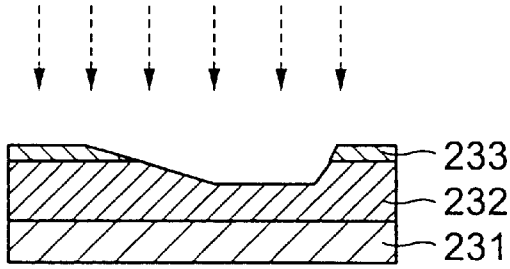
Figure 27D:
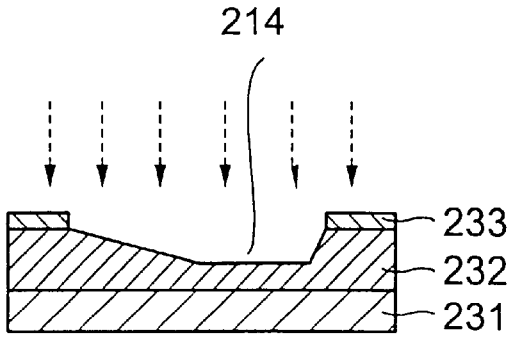

As shown in FIG. 27A, the anisotropic dry etching process using the above etching gas is started. As shown in FIG. 27B, the photoresist layer 233 is etched in the direction of the depth, and the top surface of the oxidation layer 232 is reached. As shown in FIG. 27C, the etching process is further performed, and the oxidation layer 232 is etched in the direction of the depth. The etching conditions are adjusted so that the rate of etching of the photoresist 233 is equal to the rate of etching of the oxidation layer 232, and the pattern of the recess 235 of the photoresist 233 is transferred to the oxidation layer 232 by the etching process. As shown in FIG. 27D, the recessed portion 214 of the oxidation layer 232 is formed.

Figure 26E:
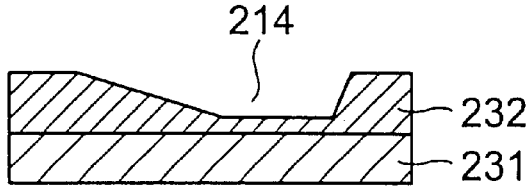

Hence, the formation of the recessed portion 214 of the oxidation layer 232 is performed by the etching process of FIG. 26D. Finally, as shown in FIG. 26E, the photoresist layer 233 remaining on the oxidation layer 232 is removed. In order to protect the peripheral surfaces of the electrode substrate 202 which are bonded to the oscillation plate, the photoresist layer 233 has been left there. If no problem arises on the bonding of the electrode substrate 202 and the oscillation plate, the photoresist 233 can be completely removed as shown in FIG. 26E.

Therefore, the method of production of the present preferred embodiment utilizes the photoresist 234 including the light-transmitting portion 234*a* having different transmittances arranged therein, and the recessed portion of the electrode substrate 202 preferably has the cross-section taken along the shorter sides of the oscillation plate 210, such that a rate of reduction of the gap 216 between the electrode 215 and the oscillation plate 210 in the first direction from the middle point to the first end of the shorter sides is different from a rate of reduction of the gap 216 in the second direction from the middle point to the second end of the shorter sides.

Figure 32:
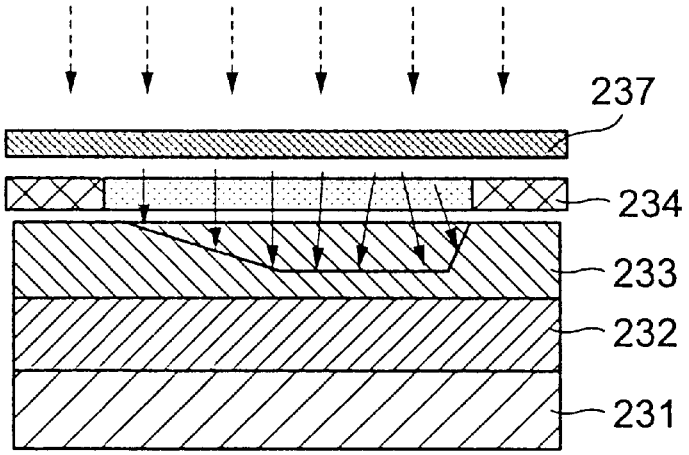
FIG. 32 is a diagram for explaining an exposure process in the production method of a preferred embodiment of the present invention.

FIG. 32 is a diagram for explaining an exposure process in the production method of the present preferred embodiment. The exposure process of FIG. 32 corresponds to the photolithographic process of FIG. 26B.

In the photolithographic process of FIG. 26B, when the photoresist layer 233 is exposed to light through the photoresist 234 including the light-transmitting portion 234*a* having different transmittances allocated, the bottom of the recess 235 in the photoresist layer 233 may have surface irregularities.

The exposure process of FIG. 32 eliminates the above problem of the process of FIG. 26B. In the exposure process of FIG. 32, a light diffraction unit 237 is placed over the photoresist 234. Parallel light rays before entering the photoresist 234 are diffracted by the light diffraction unit 237. The diffracted light rays are passed through the photoresist 234, and the photoresist layer 233 are exposed to such light rays through the photoresist 234. Hence, the exposure process of this preferred embodiment eliminates the above-described problem of the process of FIG. 26B.

Figure 33:
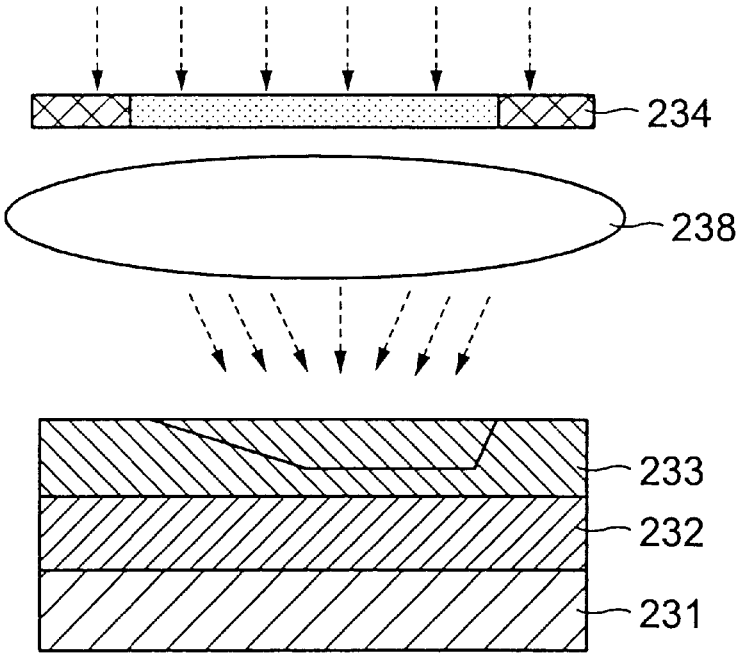
FIG. 33 is a diagram for explaining another exposure process in the production method of a preferred embodiment of the present invention.

FIG. 33 is a diagram for explaining another exposure process in the production method of the present preferred embodiment. The exposure process of FIG. 33 corresponds to the photolithographic process of FIG. 26B.

The exposure process of FIG. 33 also eliminates the above-mentioned problems of the process of FIG. 26B. In the exposure process of FIG. 33, an optical imaging system 238 is placed between the photoresist 234 and the photoresist layer 233. For the sake of convenience, only a convex lens in the optical imaging system 238 is shown in FIG. 33.

As shown in FIG. 33, the photoresist 234 is exposed to parallel light rays. The light rays, passed through the photoresist 234, are focused by the imaging system 238 at an intermediate position between the photoresist 234 and the photoresist layer 233. The photoresist layer 233 is exposed to such converging light rays from the optical imaging system 238. Hence, the exposure process of this preferred embodiment eliminates the above problem of the process of FIG. 26B.

Figure 34:
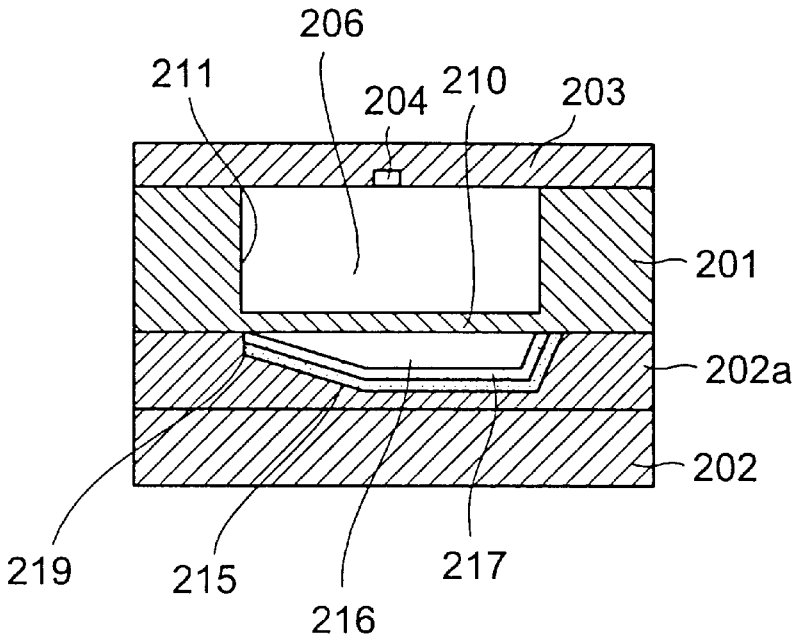
FIG. 34 is a cross-sectional view taken along a lateral line thereof according to a variation of the ink-jet head of a preferred embodiment of the present invention.
Figure 35:
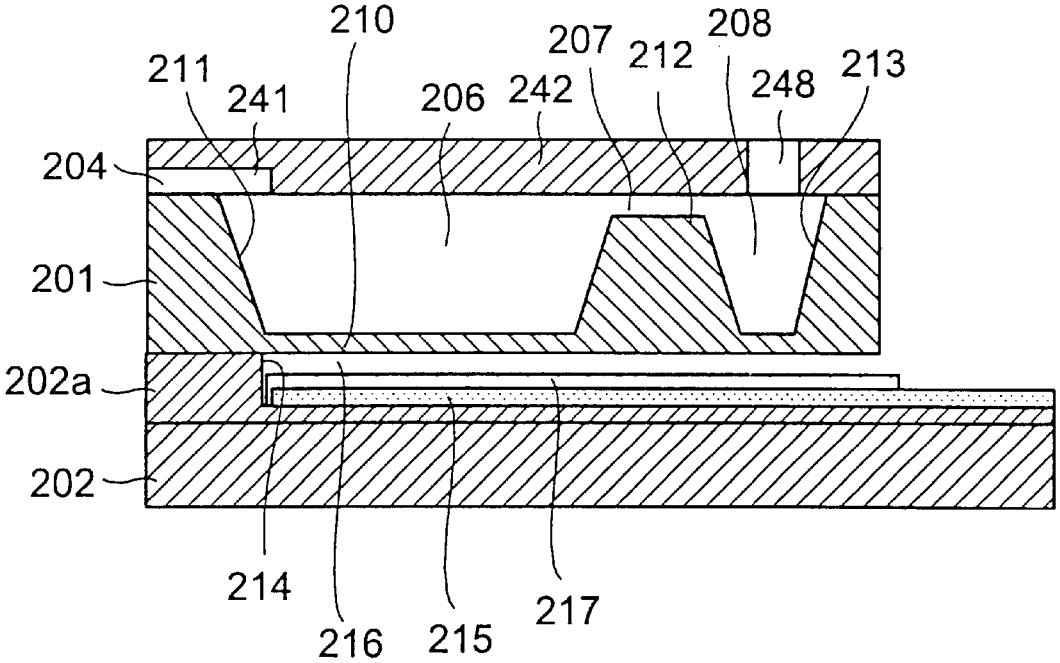
FIG. 35 is a cross-sectional view of the variation of the ink-jet head taken along a longitudinal line thereof.

FIG. 34 is a cross-sectional view of a variation of the ink-jet head of the present preferred embodiment taken along a lateral line thereof. FIG. 35 is a cross-sectional view of the variation of the ink-jet head taken along a longitudinal line thereof.

In FIG. 34 and FIG. 35, the elements which are essentially the same as corresponding elements in FIG. 24 and FIG. 25 are designated by the same reference numerals. The difference between the two preferred embodiments is that the nozzle opening 204 in the present preferred embodiment is provided at an edge position 241 of a nozzle plate 242, and an ink-supply opening 248 is provided in the nozzle plate 242 at a position that is the same as that of the previous preferred embodiment.

The ink-jet head of the present preferred embodiment (FIG. 34) is called an edge-shooter type. The edge-shooter ink-jet head ejects ink drops onto the recording paper in a direction that is substantially perpendicular to the direction of the displacement of the oscillation plate 210. In contrast, the ink-jet head of the previous embodiment (FIG. 24) is called a side-shooter type. The side shooter ink-jet head ejects ink drops onto the recording paper in a direction that is substantially parallel to the direction of the displacement of the oscillation plate 210.

As readily understood from the present preferred embodiment, the basic concepts and configurations of the invention can be applied to not only the side-shooter ink-jet heads but also the edge-shooter ink-jet heads without departing from the scope of the present invention.

Figure 36:
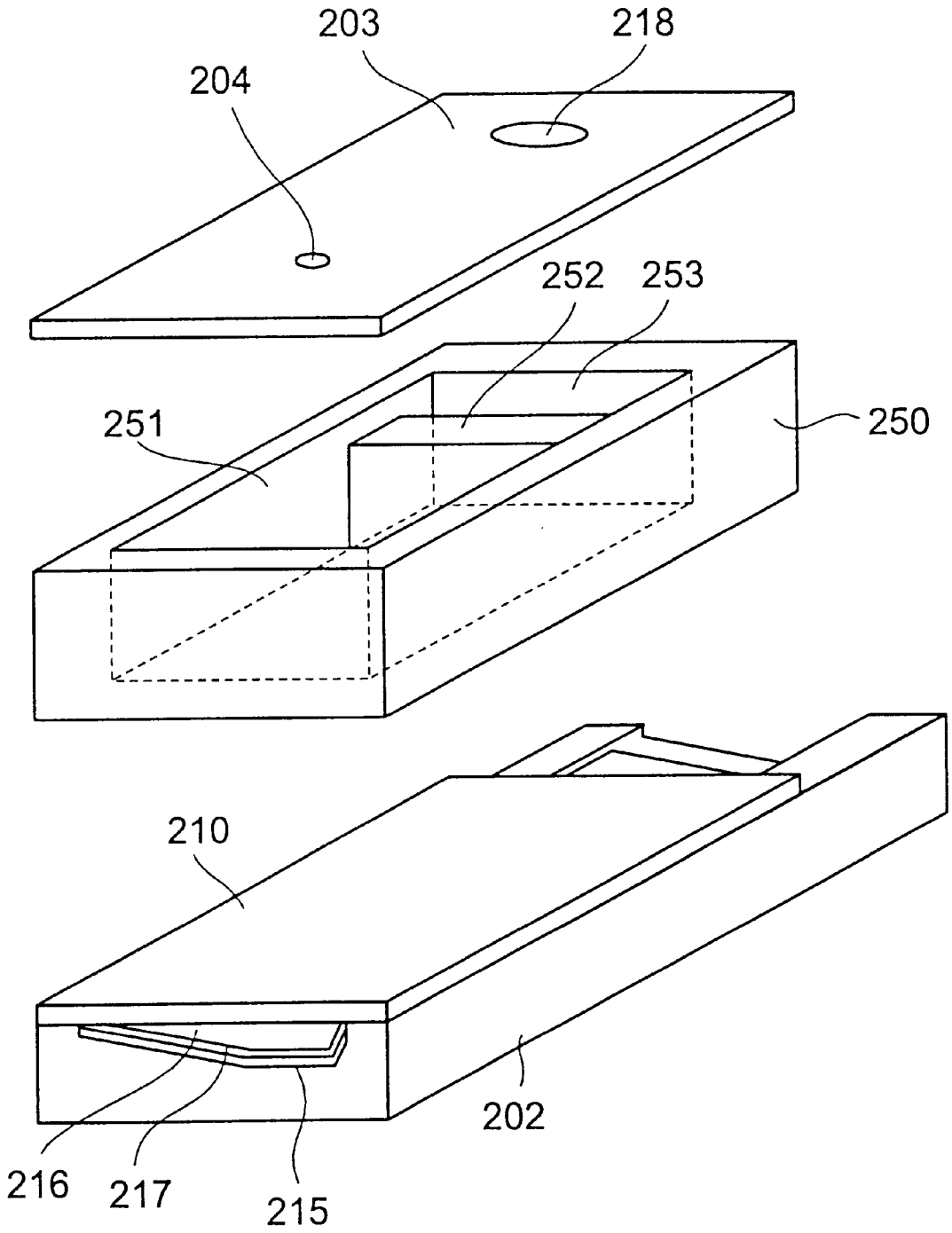
FIG. 36 is an exploded view of another variation of the ink-jet head of a preferred embodiment of the present invention.
Figure 37:
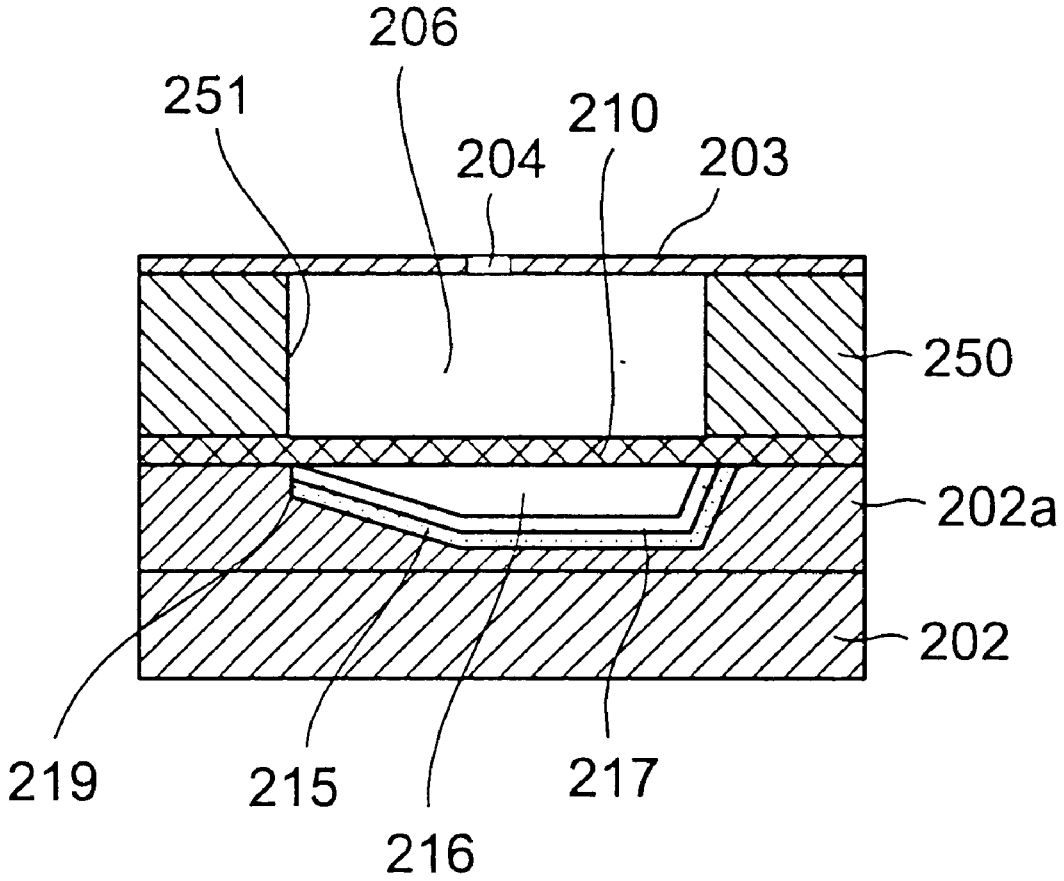
FIG. 37 is a cross-sectional view of the variation of the inkjet head taken along a lateral line thereof.

FIG. 36 is an exploded view of another variation of the ink-jet head of the present preferred embodiment. FIG. 37 is a cross-sectional view of the variation of the ink-jet head taken along a lateral line thereof.

As shown in FIG. 36 and FIG. 37, the ink-jet head of the present preferred embodiment includes a pressurizing-chamber member 250, the nozzle plate 203 and the electrode substrate 202. These elements are bonded together to define the ink-jet head. In the pressurizing-chamber member 250, a pressurizing chamber 251, an ink-transfer passage 252 and a common ink cavity 253 are configured in a manner similar to the previous preferred embodiment of FIG. 24.

Figure 38:
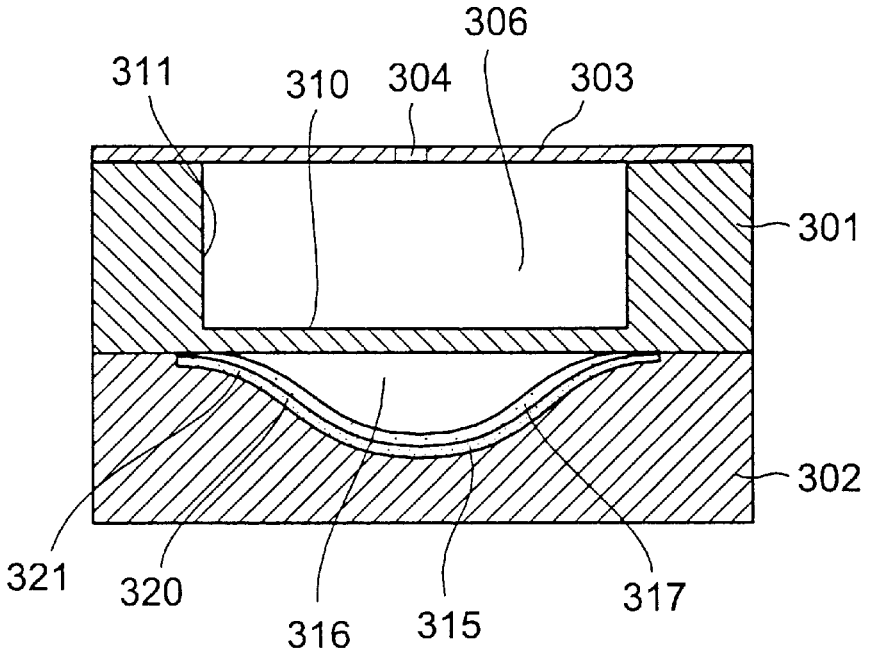
FIG. 38 is a cross-sectional view along a lateral line thereof according to another preferred embodiment of the ink-jet head of the present invention.
Figure 39:
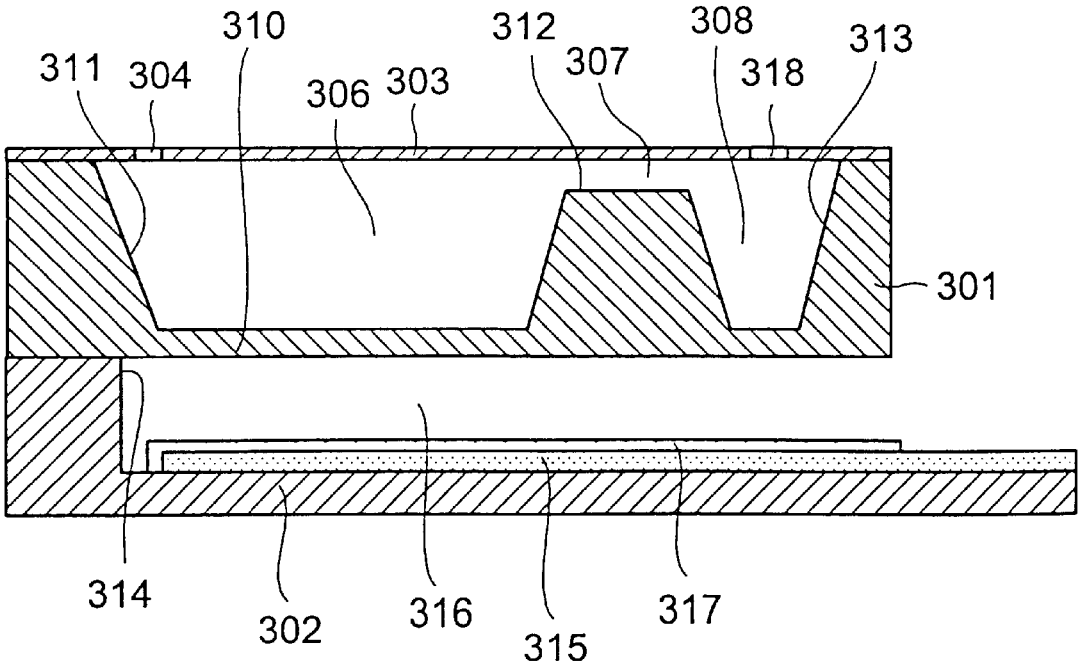
FIG. 39 is a cross-sectional view taken along a longitudinal line thereof according to an ink-jet head of a preferred embodiment of the present invention.

Next, FIG. 38 is a cross-sectional View of another preferred embodiment of the ink-jet head of the invention taken along a lateral line thereof. FIG. 39 is a cross-sectional view of the ink-jet head of the present preferred embodiment taken along a longitudinal line thereof.

As shown in FIG. 38 and FIG. 39, the ink-jet head of the present preferred embodiment preferably includes a pressurizing-chamber member 301, an electrode substrate 302, a nozzle plate 303, a nozzle opening 304, a pressurizing chamber 306, an oscillation plate 310, an electrode 315, and a gap 316 between the oscillation plate 310 and the electrode 315.

The pressurizing-chamber member 301 may be produced from a silicon substrate, such as a substrate of silicon single crystals, a polysilicon substrate or an SOI substrate. The electrode substrate 302 may be produced from any one of a silicon substrate, a Pyrex glass substrate or a ceramic substrate.

The nozzle opening 304 is provided in the nozzle plate 303 to eject an ink drop therefrom onto recording paper. The pressurizing chamber 306 is provided in the pressurizing-chamber member 301 and communicates with the nozzle opening 304. The pressurizing chamber 306 is defined by inside walls 311 of the member 301 and the nozzle plate 303. The pressurizing chamber contains ink therein, and the ink in the pressurizing chamber 306 is pressurized so as to eject an ink drop onto recording paper.

The pressurizing chamber 306 preferably has a substantially rectangular shape having longer sides and shorter sides. An ink-transfer passage 307 is arranged to connect the pressurizing chamber 306 and a common ink cavity 308. The ink-transfer passage 307 is defined by a grooved portion 312 of the member 301. The common ink cavity 308 is arranged to supply ink to each of a plurality of individual pressurizing chambers (not shown) provided in the ink-jet head. The common ink cavity 308 is defined by the nozzle plate 303 and inside walls 313 of the member 301. The nozzle plate 303 includes an ink-supply opening 318, which is open to the common ink cavity 308.

The oscillation plate 310 defines a bottom of the pressurizing chamber 306 and preferably has a substantially rectangular shape including the longer sides and the shorter sides. When the oscillation plate 310 is actuated by electrostatic force, the oscillation plate 310 pressurizes the ink in the pressurizing chamber 306.

The electrode substrate 302 is bonded to the oscillation plate 310 at the peripheral ends thereof. The electrode substrate 302 includes a recessed portion (or the gap 316) that defines an internal space between the electrode 315 and the oscillation plate 310. As shown in FIG. 38 and FIG. 39, the recessed portion of the electrode substrate 302 extends along the longer sides of the oscillation plate 310. The gap 316 is partially defined by an inside wall 314 of the electrode substrate 302. The recessed portion of the electrode substrate 302 preferably has a concave cross-section taken along the shorter sides of the oscillation plate 310, such that the gap 316 between the electrode 315 and the oscillation plate 310 is reduced in both the directions from the middle point to the peripheral ends of the shorter sides. Further, as shown in FIG. 38, the cross-section of the recessed portion of the electrode substrate 302 includes inflection points 320 on the recessed portion at intermediate positions between the middle point and the peripheral ends.

The electrode 315 is curved and provided on the recessed portion of the electrode substrate 302. The electrode 315 is covered with a protective layer 317. As shown in FIG. 38, at least one of the electrode 315 and the protective layer 317 is brought into tangential contact with the oscillation plate 310 at the peripheral ends of the shorter sides. The contact points between the oscillation plate 310 and at least one of the electrode 315 and the protective layer 317 are indicated by reference numeral 321 in FIG. 38.

Figure 40:
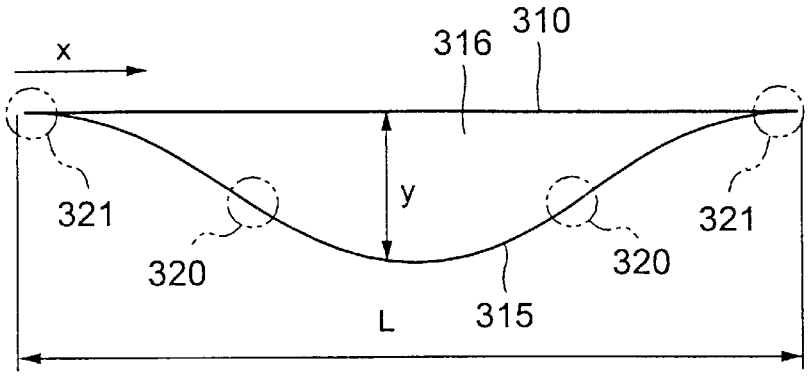
FIG. 40 is a diagram for explaining a configuration of the ink-jet head of a preferred embodiment of the present invention.

FIG. 40 is a diagram for explaining a configuration of the ink-jet head of the present preferred embodiment.

As shown in FIG. 40, the configuration of the electrode 315 in the ink-jet head of the present preferred embodiment is preferably such that a dimension y of the gap 316 between the oscillation plate 310 and the electrode 315 is a function of a distance x along the shorter sides of the oscillation plate 310 from one of the peripheral ends of the shorter sides, and the dimension y with respect to the entire gap 316 is represented by the equation $$y=A(x^4-2Lx^3+L^2x^2) \quad \text{(E)}$$

where A is a first constant and L is a second constant.

As the electrode 315 and the oscillation plate 310 in the ink-jet head of the present preferred embodiment are configured in accordance with the above-mentioned equation, the cross-section of the recessed portion of the electrode substrate 302, taken along the shorter sides of the oscillation plate 310, includes the inflection points 320 at the intermediate positions between the middle point and the peripheral ends of the shorter sides. The displacement of the oscillation plate 310 via an electrostatic force can start from the peripheral positions where there is a distance (the gap) between the oscillation plate 310 and the electrode 315. The oscillation place 310 can be easily and properly actuated with a low voltage applied to the electrode 315. Therefore, the ink-jet head of the present preferred embodiment is effective in providing a low-voltage actuation of the oscillation plate as well as a proper amount of ink ejected by the low-voltage actuation of the oscillation plate.

Further, the same features and advantages can be achieved by configuring the ink-jet head of the present preferred embodiment such that the dimension y of the gap 316 between the oscillation plate 310 and the electrode 315 is a function of the distance x along the shorter sides of the oscillation plate 310 from one of the peripheral ends of the shorter sides, and the dimension y with respect to a part of the gap 316 is represented by the equation $$y=A(x^4-2Lx^3+L^2x^2) \quad \text{(E)}$$

where A is the first constant and L is the second constant.

In order to confirm the above features and advantages of the ink-jet head of the present preferred embodiment, a relationship between the driving voltage of the electrode and the amount of displacement (or deflection) of the oscillation plate has been studied through experimental measurements for a few examples of the ink-jet head of various preferred embodiments of the present invention and a few comparative examples of the conventional ink-jet heads.

Example 1 of a preferred embodiment of the present invention is an ink-jet head which includes the oscillation plate 310 with shorter sides having a length of about 120 $\mu$m, the maximum gap 316 having a distance of about 0.3 m, and the cross-section of the recessed portion of the electrode substrate 302 having the inflection points 320.

Comparative example 1 is an ink-jet head which includes the oscillation plate with shorter sides having a length of 120 $\mu$m, the maximum gap having a distance of 0.3 $\mu$m, and the cross-section of the recessed portion of the electrode substrate having no inflection point.

Figure 41:
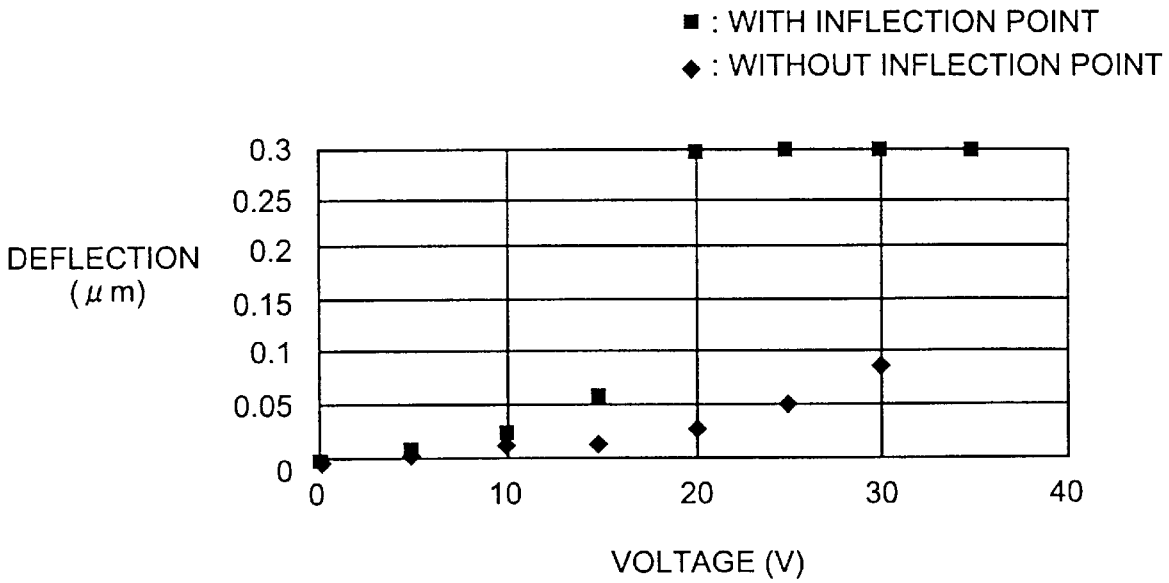
FIG. 41 is a diagram for explaining a relationship between driving voltage of the electrode and amount of displacement of the oscillation plate in the ink-jet head.

FIG. 41 shows the relationship between the driving voltage of the electrode and the amount of displacement (the deflection) of the oscillation plate which has been obtained through experimental measurements on the example 1 of a preferred embodiment of the present invention and the comparative example 1 of the existing ink-jet head. As shown in FIG. 41, it has been discovered that the oscillation place 310, in the case of the example 1, can be easily and properly actuated with a low voltage applied to the electrode 315.

Further, example 2 of a preferred embodiment of the present invention is an ink-jet head which includes the oscillation plate 310 with shorter sides having a length of about 65 $\mu$m, the maximum gap 316 having a distance of about 0.3 $\mu$m, and the cross-section of the recessed portion of the electrode substrate 302 having the inflection points 320.

Comparative example 2 is an ink-jet head which includes the oscillation plate with shorter sides having a length of about 65 $\mu$m, the maximum gap having a distance of about 0.3 $\mu$m, and the cross-section of the recessed portion of the electrode substrate having no inflection point.

Figure 42:
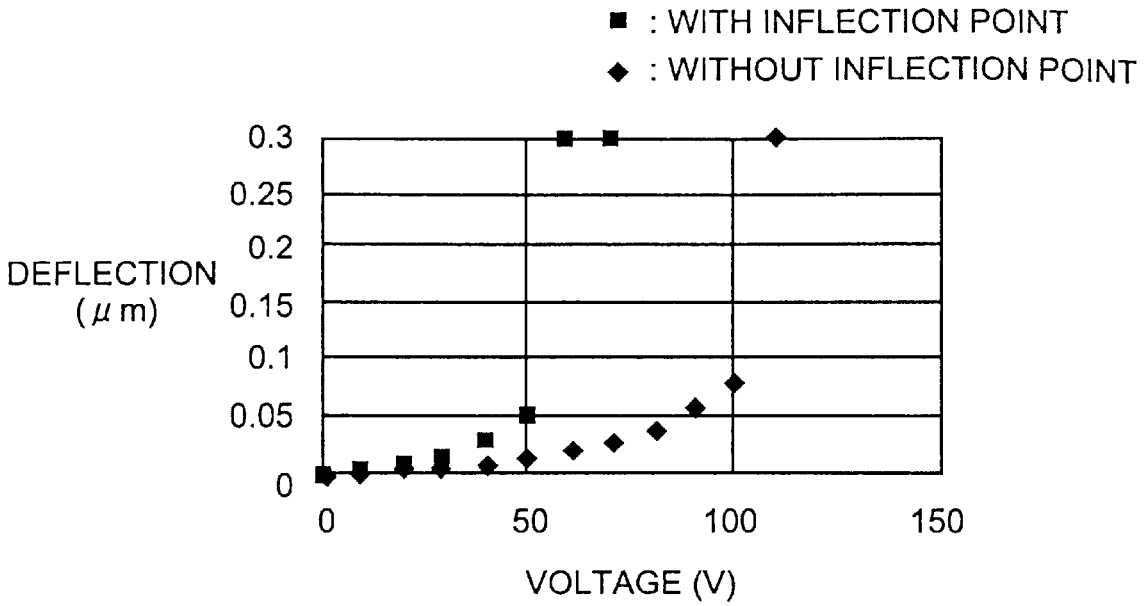
FIG. 42 is a diagram for explaining a relationship between driving voltage of the electrode and amount of displacement of the oscillation plate in the ink-jet head.

FIG. 42 shows the relationship between the driving voltage of the electrode and the amount of displacement (the deflection) of the oscillation plate which has been obtained through experimental measurements on the example 2 of a preferred embodiment of the present invention and the comparative example 2 of the existing ink-jet head. As shown in FIG. 42, it has been discovered that the oscillation place 310, in the case of the example 2, can be easily and properly actuated with a low voltage applied to the electrode 315.

Figure 43:
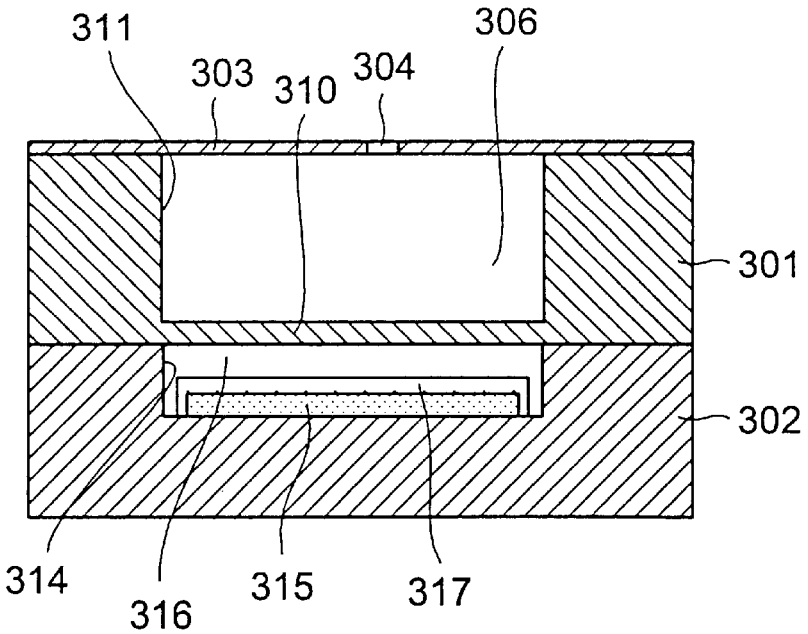
FIG. 43 is a cross-sectional view taken along a lateral line thereof according to a variation of the ink-jet head of a preferred embodiment of the present invention.
Figure 44:
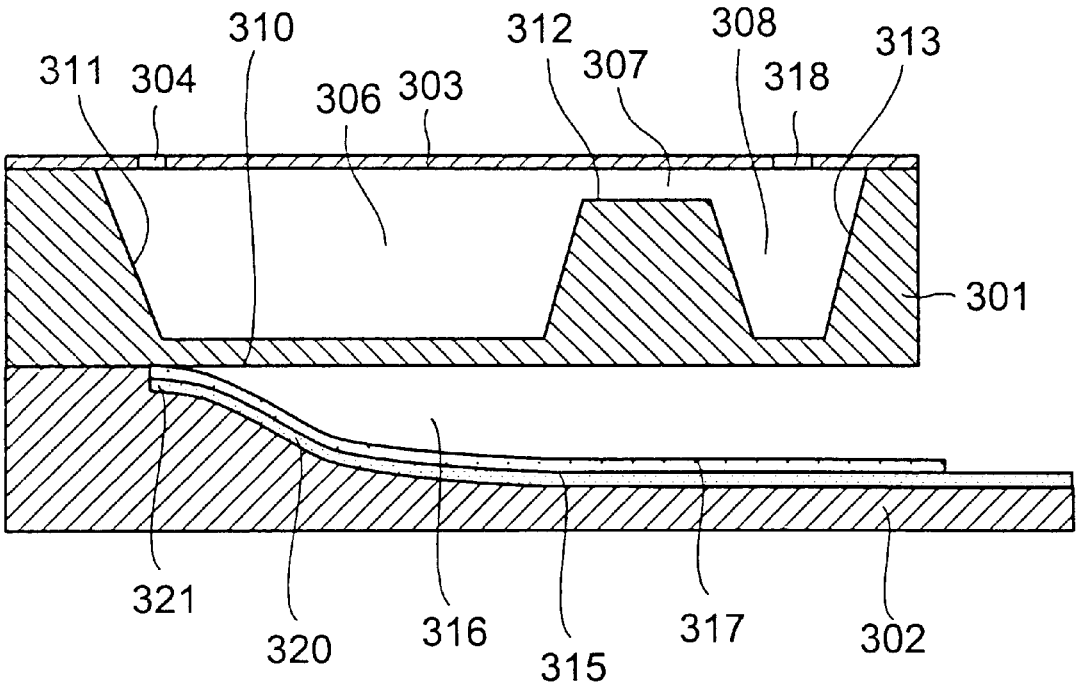
FIG. 44 is a cross-sectional view of the variation of the ink-jet head taken along a longitudinal line thereof.
Figure 45:
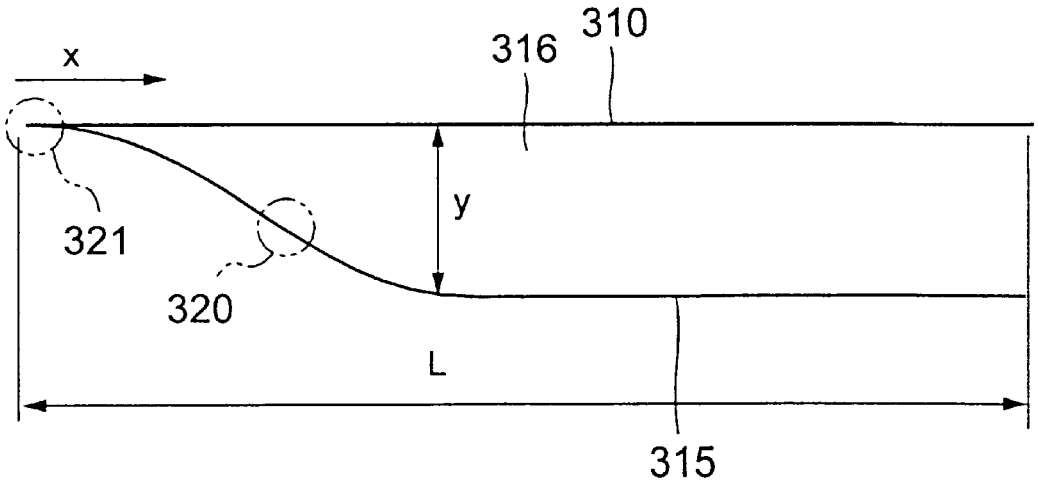
FIG. 45 is a diagram for explaining a configuration of the variation of the ink-jet head.

FIG. 43 is a cross-sectional view of a variation of the ink-jet head of the present embodiment taken along a lateral line thereof. FIG. 44 is a cross-sectional view of the variation of the ink-jet head taken along a longitudinal line thereof. FIG. 45 is a diagram for explaining a configuration of the variation of the ink-jet head.

In FIG. 43 through FIG. 45, the elements which are essentially the same as corresponding elements in FIG. 38 through FIG. 40 are designated by the same reference numerals, and a description thereof will be omitted to avoid repetition.

In the present preferred embodiment, as shown in FIG. 43, the recessed portion of the electrode substrate 302 extends along the shorter sides of the oscillation plate 310. The gap 316 is partially defined by the inside wall 314 of the electrode substrate 302. The recessed portion of the electrode substrate 302 preferably has a cross-section taken along the longer sides of the oscillation plate 310, such that the gap,316 between the electrode 315 and the oscillation plate 310 is reduced in one direction from the middle point to one of the peripheral ends of the longer sides. Further, as shown in FIG. 44 and FIG. 45, the cross-section of the recessed portion of the electrode substrate 302 includes an inflection point 320 on the recessed portion at an intermediate position between the middle point and the peripheral end of the longer sides.

Figure 46:
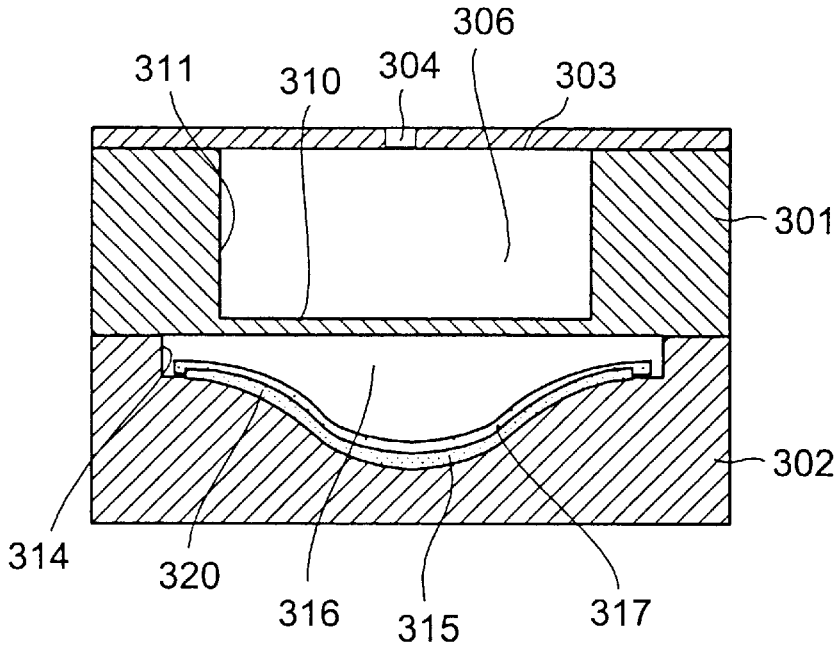
FIG. 46 is a cross-sectional view taken along a lateral line thereof according to another variation of a preferred embodiment of the present invention.
Figure 47:
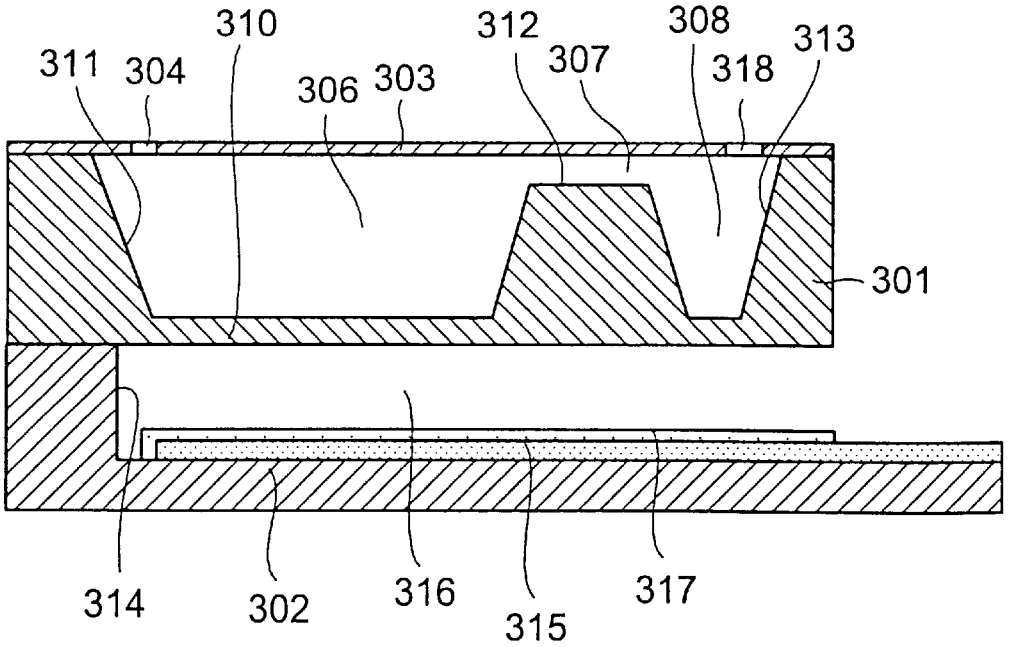
FIG. 47 is a cross-sectional view taken along a lateral line thereof according to another variation of a preferred embodiment of the present invention.

FIG. 46 is a cross-sectional view of another variation of the ink-jet head of the present preferred embodiment taken along a lateral-line thereof. FIG. 47 is a cross-sectional view of the variation of the ink-jet head taken along a longitudinal line thereof.

In FIG. 46 and FIG. 47, the elements which are essentially the same as corresponding elements in FIG. 38 and FIG. 39 are designated by the same reference numerals, and a description thereof will be omitted to avoid repetition.

In the present preferred embodiment, as shown in FIG. 46, the recessed portion of the electrode substrate 302 extends along the longer sides of the oscillation plate 310. The gap 316 is partially defined by the inside wall 314 of the electrode substrate 302. The recessed portion of the electrode substrate 302 preferably has a substantially cross-section taken along the shorter sides of the oscillation plate 310, such that the gap 316 between the electrode 315 and the oscillation plate 310 is reduced in both directions from the middle point to the peripheral ends of the shorter sides. Further, as shown in FIG. 46 and FIG. 47, the cross-section of the recessed portion of the electrode substrate 302 includes inflection points 820 on the recessed portion at intermediate positions between the middle point and the peripheral ends of the shorter sides. The oscillation plate 310 and the electrode 315 do not contact each other via the dielectric layer 317 at the peripheral ends.

The ink-jet head of the present preferred embodiment is also effective in providing a low-voltage actuation of the oscillation plate as well as a proper amount of ink ejected by the low-voltage actuation of the oscillation plate.

Figure 48:
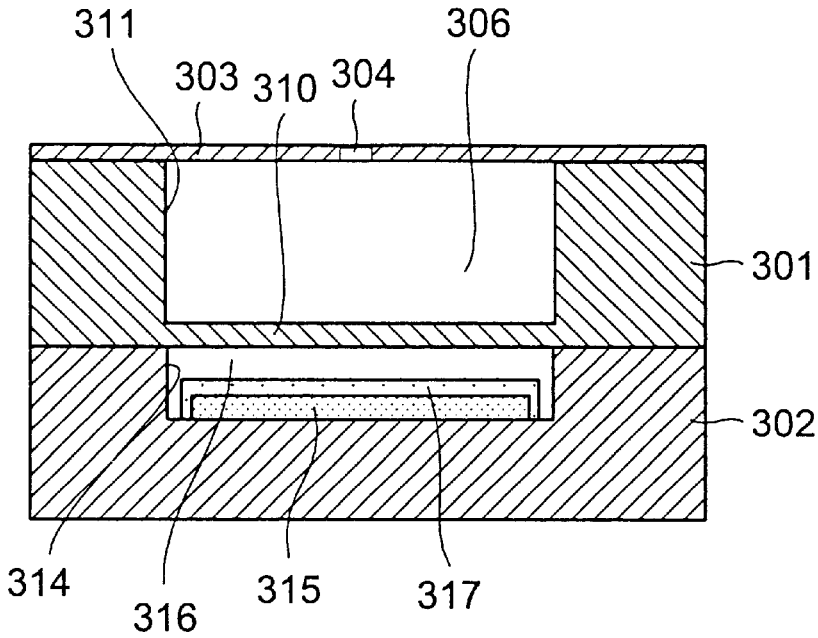
FIG. 48 is a cross-sectional view taken along a lateral line thereof according to another variation of a preferred embodiment of the present invention.
Figure 49:
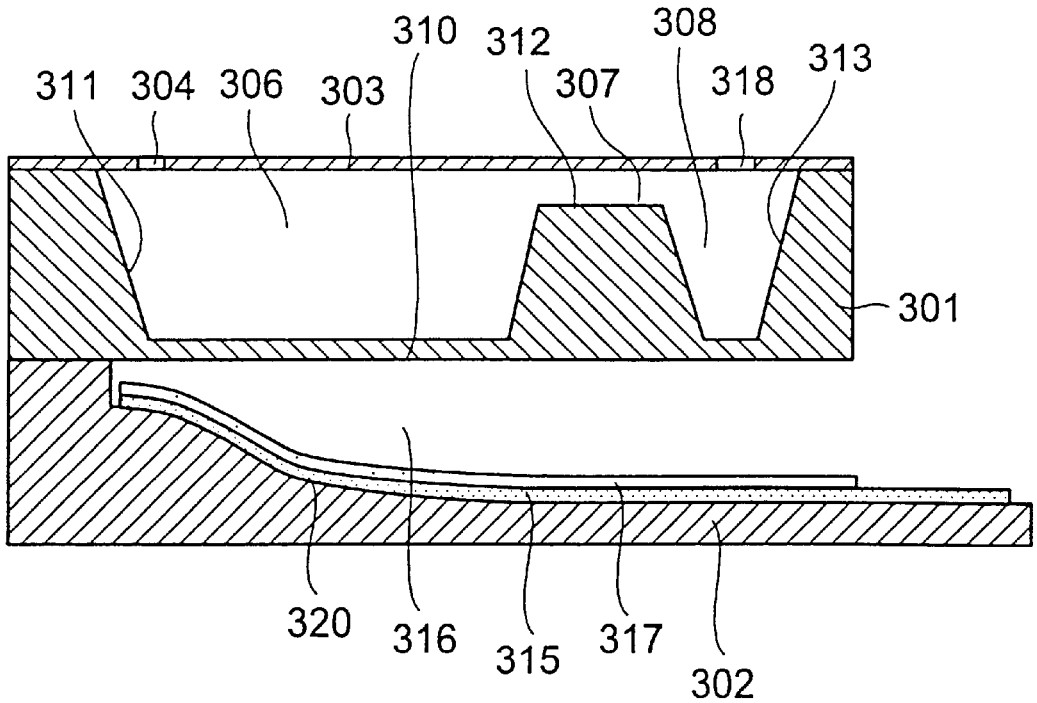
FIG. 49 is a cross-sectional view taken along a lateral line thereof according to another variation of a preferred embodiment of the present invention.

FIG. 48 is a cross-sectional view of another variation of the ink-jet head of the present preferred embodiment taken along a lateral line thereof. FIG. 49 is a cross-sectional view of the variation of the ink-jet head taken along a longitudinal line thereof.

In FIG. 48 and FIG. 49, the elements which are essentially the same as corresponding elements in FIG. 38 and FIG. 39 are designated by the same reference numerals, and a description thereof will be omitted to avoid repetition.

In the present preferred embodiment, as shown in FIG. 48, the recessed portion of the electrode substrate 302 extends along the shorter sides of the oscillation plate 310. The gap 316 is partially defined by the inside wall 314 of the electrode substrate 302. The recessed portion of the electrode substrate 302 preferably has a cross-section taken along the longer sides of the oscillation plate 310, such that the gap 316 between the electrode 315 and the oscillation plate 310 is reduced in one direction from the middle point to one of the peripheral ends of the longer sides. Further, as shown in FIG. 48 and FIG. 49, the cross-section of the recessed portion of the electrode substrate 302 includes an inflection point 320 on the recessed portion at an intermediate position between the middle point and the peripheral end of the longer sides. The oscillation plate 310 and the electrode 315 do not contact each other via the dielectric layer 317 at the peripheral ends.

The ink-jet head of the present preferred embodiment is also effective in providing a low-voltage actuation of the oscillation plate as well as a proper amount of ink ejected by the low-voltage actuation of the oscillation plate.

FIG. 50A, FIG. 50B, FIG. 50C, FIG. 50D and FIG. 50E are diagrams for explaining a forming process of a recessed portion of the electrode substrate in a method of production of the ink-jet head of FIG. 38.

Figure 50A:
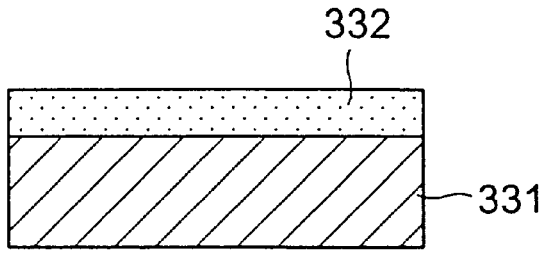
FIG. 50A, FIG. 50B, FIG. 50C, FIG. 50D and FIG. 50E are diagrams for explaining a method of production of the ink-jet head of FIG. 38.

As shown in FIG. 50A, at a start of the forming process, a photoresist (e.g., OFPR-800 from Tokyo-Oka) 332 is formed on an electrode substrate 331, which is prepared from a silicon wafer, and the photoresist 332 has a thickness of about 1 $\mu$m.

Figure 50B:
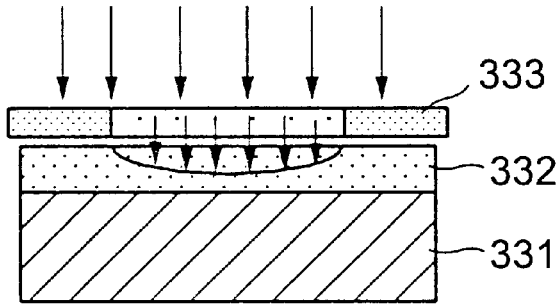

As shown in FIG. 50B, a photoresist 333 is formed on the photoresist 332, and the photoresist 32 is exposed to UV light through the photoresist 333. The photoresist 333 preferably includes a substantially rectangular transparent region in the middle thereof, and the photoresist 333 is formed so that the light incident to the middle point of the transparent region passes through the photoresist 333 but the light incident to the peripheral ends of the transparent region is largely scattered. Further, the transparent region of the photoresist 333 is configured so as to be in accordance with the above equation (E).

Figure 50C:
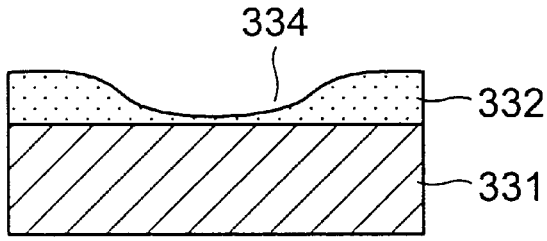

As shown in FIG. 50C, the unwanted portions of the photoresist 332 are removed by dissolving the photoresist 333. The intensity and exposure time of the light are suitably adjusted so that the recessed portion of the photoresist 332 does not reach the electrode substrate 331 at the time of the development.

Figure 50D:
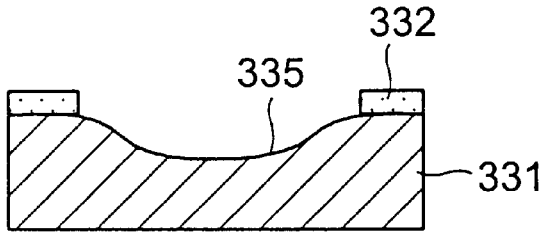

As shown in FIG. 50D, an anisotropic dry etching is performed to the photoresist 332 and the electrode substrate 331. The pattern of the recessed portion of the photoresist 332 is transferred to the electrode substrate 331 by the etching process. A mixture of $O_2$ and $SF_6$ gases is used as the etching gas. The etching conditions are adjusted so that the rate of etching of the photoresist 332 is equal to the rate of etching of the electrode substrate 331. Hence, a recessed portion 335 of the electrode substrate 331 is formed, and the recessed portion 335 of the electrode substrate 331 in FIG. 50D is equivalent to the recessed portion 316 of the electrode substrate 302 in FIG. 38.

Figure 50E:
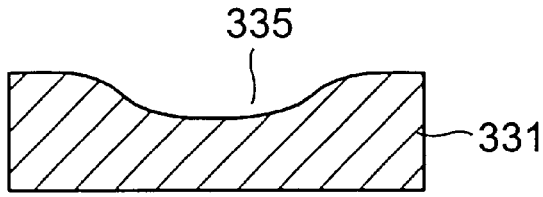

As shown in FIG. 50E, after the etching is performed, the photoresist 332 remaining on the electrode substrate 331 is removed. In order to protect the peripheral surfaces of the electrode substrate 331 which are bonded to the oscillation plate, the photoresist 332 has been left there. If no problem arises on the bonding of the electrode substrate 331 and the oscillation plate, the photoresist 332 can be completely removed as shown in FIG. 50E.

FIG. 51A, FIG. 51B, FIG. 51C, FIG. 51D, FIG. 51E and FIG. 51F are diagrams for explaining a variation of the method of production of the ink-jet head of FIG. 38.

Figure 51A:
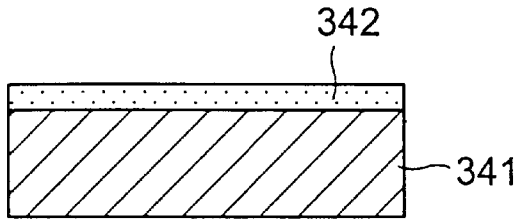
FIG. 51A, FIG. 51B, FIG. 51C, FIG. 51D, FIG. 51E and FIG. 51F are diagrams for explaining a variation of the method of production of the ink-jet head of FIG. 38.

As shown in FIG. 51A, at a start of the forming process, a photoresist (OFPR-800) 342 is formed on an electrode substrate 341, which is prepared from a silicon [100] wafer of silicon single crystals, and the photoresist 342 has a thickness of about 1 $\mu$m.

Figure 51B:
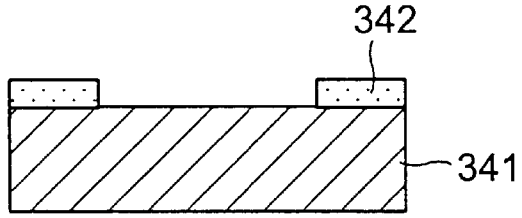

As shown in FIG. 51B, a photoresist (not shown) is formed on the photoresist 342, and the photoresist 342 is exposed to UV light through the photoresist. The unwanted portion of the photoresist 342 is removed by dissolving the photoresist. In this case, the removed portion of the photoresist 342 reaches the electrode substrate 341, and the corresponding portion of the electrode substrate 341 appears.

Figure 51C:
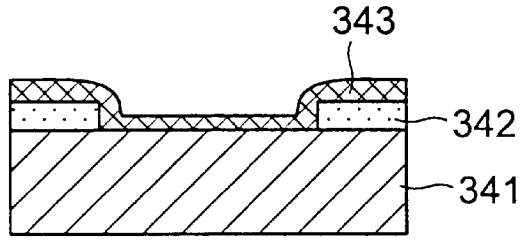

As shown in FIG. 51C, a photoresist 343 is formed on the remaining photoresist 342 and the portion of the electrode substrate 341, and the photoresist 343 is heated to a temperature that allows a flow of the photoresist 343 to take place.

Figure 51D:
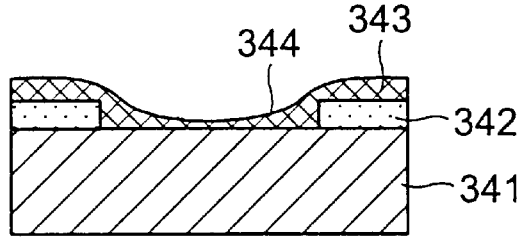

As shown in FIG. 51D, due to the heating, the photoresist 343 has a smoothly concave cross-section. Then, the corresponding portion of the electrode substrate 341 is exposed to UV light through the photoresist 343. The photoresist 343 includes a substantially rectangular transparent region in the middle thereof, and the photoresist 343 is formed so that the light incident to the middle point of the transparent region passes through the photoresist 343 but the light incident to the peripheral ends of the transparent region is largely scattered. Further, the photoresist 343 includes an arc-like region 344 surrounding the middle point and convex regions at the peripheral positions corresponding to the remaining portions of the photoresist 342. Further, the transparent region of the photoresist 343 is configured so as to be in accordance with the above equation (E).

Figure 51E:
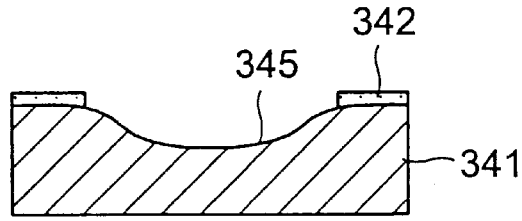

As shown in FIG. 51E, an anisotropic dry etching is performed on the photoresist (342, 343) and the electrode substrate 331. The pattern of the photoresist 343 is transferred to the electrode substrate 331 by the etching process. A mixture of $O_2$ and $SF_6$ gases is used as the etching gas. The etching conditions are adjusted so that the rate of etching of the photoresist (342, 343) is equal to the rate of etching of the electrode substrate 341. Hence, a recessed portion 345 of the electrode substrate 341 preferably has a substantially concave cross-section, and the recessed portion 345 of the electrode substrate 341 in FIG. 51E is equivalent to the recessed portion 316 of the electrode substrate 302 in FIG. 38.

Figure 51F:
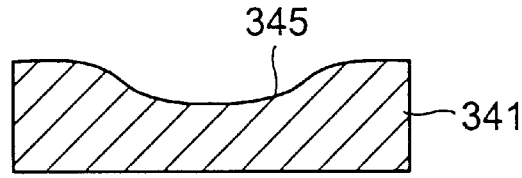

As shown in FIG. 51F, after the etching is performed, the photoresist 342 remaining on the electrode substrate 341 is removed. In order to protect the peripheral surfaces of the electrode substrate 341 which are bonded to the oscillation plate, the photoresist 342 has been left there. If no problem arises on the bonding of the electrode substrate 341 and the oscillation plate, the photoresist 342 can be completely removed as shown in FIG. 51F.

The present invention is not limited to the above-described preferred embodiments, and variations and modifications may be made without departing from the scope of the present invention.

Further, the present invention is based on Japanese priority application No. 11-107490, filed on Apr. 15, 1999, Japanese priority application No. 11-199746, filed on Jul. 14, 1999, Japanese priority application No. 11-210858, filed on Jul. 26, and Japanese priority application No. 11-224797, filed on Aug. 9, 1999, the entire contents of which are hereby incorporated by reference.

What is claimed is:

1. An ink-jet head provided with an electrostatic actuator, the electrostatic actuator comprising:

an oscillation plate defining a bottom of a pressurizing chamber of the ink-jet head, the oscillation plate being shaped in a generally rectangular formation with a long-side line and a short-side line, the short-side line having a middle point and peripheral ends;

an electrode substrate bonded to the oscillation plate, the electrode substrate having a recessed portion that forms an internal space between the oscillation plate and the electrode substrate, wherein the recessed portion of the electrode substrate has a generally concave cross section taken along the short-side line of the oscillation plate; and a curved electrode provided on the recessed portion of the electrode substrate to face the oscillation plate via the internal space, thereby forming a gap between the curved electrode and the oscillation plate, wherein, upon application of a driving voltage to the electrode, the electrode actuates the oscillation plate by electrostatic force, so as to pressurize ink in the pressurizing chamber, thereby ejecting an ink drop onto recording paper, and wherein the curved electrode is curved such that the gap between the curved electrode and the oscillation plate is reduced from the middle point to the ends of the short-side line of the oscillation plate, wherein a dielectric layer is provided on at least one of the electrode and the oscillation plate.

2. The ink-jet head according to claim 1, wherein the cross-section of the recessed portion of the electrode substrate includes an arc-like region substantially extending from one of the ends of the shorter sides to the other end of the shorter sides.

3. The ink-jet head according to claim 1, wherein the cross-section of the recessed portion of the electrode substrate includes a flat region surrounding the middle point and convex regions each extending from the flat region to one of the ends of the shorter sides.

4. The ink-jet head according to claim 1, wherein the cross-section of the recessed portion of the electrode substrate includes a central arc-like region surrounding the middle point and convex regions each extending from the arc-like region to one of the ends of the shorter sides.

5. The ink-jet head according to claim 1, wherein the oscillation plate and the electrode substrate are made of silicon single crystals.

6. The ink-jet head according to claim 1, wherein the oscillation plate is made of silicon single crystals and the electrode substrate is made of a dielectric material, the oscillation plate and the electrode being bonded together at end portions, said end portions being doped with p-type dopants.

7. The ink-jet head according to claim 1, wherein the dielectric layer is provided between the electrode and the oscillation plate, and the electrostatic actuator is configured so that, when the oscillation plate is actuated, the oscillation plate contacts the electrode on the recessed portion of the electrode substrate.

8. The ink-jet head according to claim 1, wherein a pressurizing-chamber member is provided on the electrostatic actuator to define the pressurizing chamber therein, and the oscillation plate defines the bottom of the pressurizing chamber.

9. A method of production of an ink-jet head, the ink-jet head provided with an electrostatic actuator comprising an oscillation plate defining a bottom of a pressurizing chamber of the ink-jet head, the oscillation plate being shaped in a generally rectangular formation with a long-side line and a short-side line, an electrode substrate bonded to the oscillation plate, the electrode substrate having a recessed portion that forms an internal space between the oscillation plate and the electrode substrate, and a curved electrode provided on the recessed portion of the electrode substrate to face the oscillation plate via the internal space, the method comprising the steps of:

forming a photo-resist layer on the electrode substrate;

forming a recess in the photo-resist layer through a photolithography process, the recess corresponding to the recessed portion of the electrode substrate; and producing the recessed portion of the electrode substrate through an etching process by using the resulting photo-resist layer with the recess as a mask, wherein the recessed portion of the electrode substrate is configured with a generally concave cross section taken along the short-side line of the oscillation plate; wherein the curved electrode is curved, such that a gap between the electrode and the oscillation plate is reduced from a middle point to peripheral ends of the short-side line.

10. An ink-jet head comprising:

a nozzle opening for ejecting an ink drop therefrom onto recording paper;

a pressurizing chamber attached to the nozzle opening for containing ink therein;

an oscillation plate, provided to define a bottom of the pressurizing chamber, for pressurizing the ink in the pressurizing chamber when the oscillation plate is actuated, the oscillation plate being shaped in a generally rectangular formation with a long-side line and a short-side line, the long-side line having a middle point, a first end and a second end;

an electrode substrate bonded to the oscillation plate, the electrode substrate having a recessed portion that forms an internal space between the oscillation plate and the electrode substrate; and an electrode provided on the recessed portion to face the oscillation plate via the internal space, thereby forming a gap between the curved electrode and the oscillation plate, wherein, upon application of a driving voltage to the electrode, the electrode actuating the oscillation plate by electrostatic force, so that the ink-jet head ejects an ink drop from the nozzle opening onto the recording paper by pressurizing the ink in the pressurizing chamber, wherein the electrode is configured with a cross section taken along the long-side line of the oscillation plate, such that the gap between the electrode and the oscillation plate is reduced from the middle point to at least one of the first and second ends of the long-side line, and the cross section of the electrode includes a bottom flat region surrounding the middle point and at least one slope region extending from the bottom flat region to one of the first and second ends of the long-side line.

11. The ink-jet head according to claim 10, wherein a length L of the longer sides of the oscillation plate, a length I of the bottom flat region of the electrode and a distance H between the oscillation plate and the bottom flat region of the electrode meet the conditions $I/L \geqq 1/10$ and $2H/(L-I) < 1/10$.

12. The ink-jet head according to claim 10, wherein a dielectric layer is provided on the electrode, and the cross-section of the electrode further includes an upper flat region extending from the slope region, and the dielectric layer at a boundary between the upper flat region and the slope region of the electrode is arranged to contact the oscillation plate.

13. The ink-jet head according to claim 10, wherein the electrode is made of at least one of a metallic material and a conductive ceramic material, and a dielectric protective layer is provided on the electrode, the protective layer having a thickness that ranges from about 0.05 $\mu$m to about 5.0 $\mu$m.

14. An ink-jet head comprising:

a nozzle opening for ejecting an ink drop therefrom onto recording paper;

a pressurizing chamber attached to the nozzle opening for containing ink therein;

an oscillation plate, provided to define a bottom of the pressurizing chamber, for pressurizing the ink in the pressurizing chamber when the oscillation plate is actuated, the oscillation plate being shaped in a generally rectangular formation with a long-side line and a short-side line, the short-side line having a middle point, a first end and a second end;

an electrode substrate bonded to the oscillation plate, the electrode substrate having a recessed portion that forms an internal space between the oscillation plate and the electrode substrate; and an electrode provided on the recessed portion to face the oscillation plate via the internal space, thereby forming a gap between the curved electrode and the oscillation plate, wherein, upon application of a driving voltage to the electrode, the electrode actuating the oscillation plate by electrostatic force, so that the ink-jet head ejects an ink drop from the nozzle opening onto the recording paper by pressurizing the ink in the pressurizing chamber, wherein the electrode is configured with a cross section taken along the short-side line of the oscillation plate, such that the gap between the electrode and the oscillation plate is reduced in both directions from the middle point to the first end and the second end, and the cross section of the electrode includes a bottom flat region surrounding the middle point, and a pair of slope regions each extending from the flat region to one of the first and second ends of the short-side line.

15. The ink-jet head according to claim 14, wherein a width W of the shorter sides of the oscillation plate, a width w of the bottom flat region of the electrode and a distance H between the oscillation plate and the bottom flat region of the electrode meet the conditions $w/W \geqq 1/10$ and $2H/(W-w) < 1/10$.

16. The ink-jet head according to claim 14, wherein a dielectric layer is provided on the electrode, and the cross-section of the electrode further includes an upper flat region extending from the slope region, and the dielectric layer at a boundary between the upper flat region and the slope region of the electrode is brought in contact with the oscillation plate.

17. An ink-jet head comprising:

a nozzle opening for ejecting an ink drop therefrom onto recording paper;

a pressurizing chamber attached to the nozzle opening for containing ink therein;

an oscillation plate, provided to define a bottom of the pressurizing chamber, for pressurizing the ink in the pressurizing chamber when the oscillation plate is actuated, the oscillation plate being shaped in a generally rectangular formation with a long-side line and a short-side line, the long-side line having a middle point, a first end and a second end, the short-side line having the middle point, a third end and a fourth end;

an electrode substrate bonded to the oscillation plate, the electrode substrate having a recessed portion that forms an internal space between the oscillation plate and the electrode substrate; and an electrode provided on the recessed portion to face the oscillation plate via the internal space, thereby forming a gap between the curved electrode and the oscillation plate, wherein, upon application of a driving voltage to the electrode, the electrode actuating the oscillation plate by electrostatic force, so that the ink-jet head ejects an ink drop from the nozzle opening onto the recording paper by pressurizing the ink in the pressurizing chamber, wherein the electrode is configured with a first cross section taken along the long-side line of the oscillation plate and a second cross section taken along the short-side line, such that the gap between the electrode and the oscillation plate is reduced in both directions from the middle point to the first end and the second end of the long-side line and reduced in both directions from the middle point to the third end and the fourth end of the short-side line, and wherein the first cross section of the electrode includes a first flat region surrounding the middle point and a pair of first slope regions each extending from the first flat region toward one of the first and second ends of the long-side line, and the second cross section of the electrode includes a second flat region surrounding the middle point and a pair of second slope regions each extending from the second flat region toward one of the third and fourth ends of the short-side line.

18. The ink-jet head according to claim 17, wherein the first slope regions of the electrode have outer peripheral ends that correspond with the first and second ends of the longer sides of the oscillation plate, and the second slope regions of the electrode have outer peripheral ends that correspond with the third and fourth ends of the shorter sides of the oscillation plate.

19. The ink-jet head according to claim 17, wherein the first slope regions of the electrode have outer peripheral ends that correspond with the first and second ends of the longer sides of the oscillation plate, and the second slope regions of the electrode have outer peripheral ends that are located outside the third and fourth ends of the shorter sides of the oscillation plate.

20. The ink-jet head according to claim 17, wherein the first slope regions of the electrode have outer peripheral ends that are located outside the first and second ends of the longer sides of the oscillation plate, and the second slope regions of the electrode have outer peripheral ends that correspond with the third and fourth ends of the shorter sides of the oscillation plate.

21. An ink-jet head comprising:

a nozzle opening for ejecting an ink drop therefrom onto recording paper;

a pressurizing chamber attached to the nozzle opening for containing ink therein;

a generally rectangular oscillation plate, provided to define a bottom of the pressurizing chamber, for pressurizing the ink in the pressurizing chamber when the oscillation plate is actuated, the oscillation plate having a long-side line and a short-side line, the short-side line having a middle point, a first end and a second end;

an electrode substrate bonded to the oscillation plate, the electrode substrate having a recessed portion that forms an internal space between the oscillation plate and the electrode substrate; and a curved electrode provided on the recessed portion to face the oscillation plate via the internal space, thereby forming a gap between the curved electrode and the oscillation plate, wherein, upon application of a driving voltage to the electrode, the electrode actuates the oscillation plate by electrostatic force, so that the ink-jet head ejects an ink drop from the nozzle opening onto the recording paper by pressurizing the ink in the pressurizing chamber, wherein the recessed portion of the electrode substrate is configured with a cross section taken along the short-side line of the oscillation plate, such that a rate of reduction of the gap between the electrode and the oscillation plate in a first direction from the middle point to the first end of the short-side line differs from a rate of reduction of the gap in a second direction from the middle point to the second end.

22. The ink-jet head according to claim 21, wherein the oscillation plate and the electrode substrate are made of silicon single crystals.

23. The ink-jet head according to claim 21, wherein the oscillation plate and the electrode substrate are bonded together at end portions, said end portions being doped with p-type dopants.

24. A method of production of an ink-jet head, the ink-jet head comprising a generally rectangular oscillation plate, provided to define a bottom of a pressurizing chamber, an electrode substrate bonded to the oscillation plate, the electrode substrate having a recessed portion that forms an internal space between the oscillation plate and the electrode substrate, and a curved electrode provided on the recessed portion to face the oscillation plate via the internal space, the method of production comprising the steps of:

forming a photoresist layer on the electrode substrate;

performing a photolithographic process to form a recess in the photoresist layer by using a photomask, the photomask including a light-transmitting portion having different transmittances allocated; and producing the recessed portion of the electrode substrate through an etching process by using the photo-resist layer with the recess, wherein the oscillation plate has a short-side line with a middle point, a first end and a second end, and the recessed portion of the electrode substrate is configured with a cross section taken along the short-side line of the oscillation plate, thereby providing a rate of reduction of a gap between the electrode and the oscillation plate in a first direction from the middle point to the first end of the short-side line differs from a rate of reduction of the gap in a second direction from the middle point to the second end of the short-side line.

25. The method according to claim 24, wherein the photolithographic process exposes the photoresist layer to converging light rays through the photoresist, the light rays being focused at an intermediate position between the photoresist and the photoresist layer.

26. The method according to claim 24, wherein the photolithographic process exposes the photoresist layer to parallel light rays through the photoresist, the light rays, before entering the photoresist, being diffracted by a light diffraction unit.

27. The method according to claim 24, wherein the oscillation plate and the electrode substrate are made of silicon single crystals.

28. The method according to claim 24, wherein the light-transmitting portion of the photoresist includes a transparent substrate and an opaque layer formed on the transparent substrate, the opaque layer having different thicknesses, and the recessed portion of the electrode substrate being formed by using the photoresist.

29. The method according to claim 24, wherein the light-transmitting portion of the photoresist includes a transparent substrate and an opaque layer formed on the transparent substrate, the opaque layer having different aperture rates, and the recessed portion of the electrode substrate being formed by using the photoresist.

30. An ink-jet head comprising:

a nozzle opening for ejecting an ink drop therefrom onto recording paper;

a pressurizing chamber attached to the nozzle opening for containing ink therein;

a generally rectangular oscillation plate, provided to define a bottom of the pressurizing chamber, for pressurizing the ink in the pressurizing chamber when the oscillation plate is actuated;

an electrode substrate bonded to the oscillation plate, the electrode substrate having a recessed portion that forms an internal space between the oscillation plate and the electrode substrate; and a curved electrode provided on the recessed portion to face the oscillation plate via the internal space, thereby forming a gap between the curved electrode and the oscillation plate, wherein, upon application of a driving voltage to the electrode, the electrode actuating the oscillation plate by electrostatic force, wherein the recessed portion of the electrode substrate is configured with a first cross section taken along a short-side line of the oscillation plate, such that the gap between the electrode and the oscillation plate is reduced from a middle point to peripheral ends of the short-side line, the first cross section including inflection points on the recessed portion at intermediate positions between the middle point and the peripheral ends.

31. The ink-jet head according to claim 30, wherein a protective layer is provided on the electrode, and one of the protective layer and the electrode contacts the oscillation plate at the peripheral ends of the shorter sides.

32. The ink-jet head according to claim 30, wherein the recessed portion of the electrode substrate has a second cross-section along the longer sides of the oscillation plate, such that the second cross-section includes an inflection point on the recessed portion at an intermediate position between a middle point and a peripheral end of the longer sides.

33. The ink-jet head according to claim 30, wherein the inflection points are provided only in the first cross-section of the recessed portion.

34. The ink-jet head according to claim 30, wherein a dimension y of the gap between the oscillation plate and the electrode is a function of a distance x along the short-side line from one of the peripheral ends thereof, the dimension y with respect to the entire gap being represented by the equation $y=A(x^4-2Lx^3+L^2x^2)$ where A is a first constant and L is a second constant.

35. The ink-jet head according to claim 30, wherein both the electrode and the oscillation plate are made of silicon single crystals and bonded together at end portions, said end portions being doped with p-type dopants.

36. The ink-jet head according to claim 30, wherein the oscillation plate is made of silicon single crystals, and the electrode and the oscillation plate are bonded together at end portions thereof, said end portions being doped with p-type dopants.

37. An ink-jet head comprising:

a nozzle opening for ejecting an ink drop therefrom onto recording paper;

a pressurizing chamber attached to the nozzle opening for containing ink therein;

a generally rectangular oscillation plate, provided to define a bottom of the pressurizing chamber, for pressurizing the ink in the pressurizing chamber when the oscillation plate is actuated;

an electrode substrate bonded to the oscillation plate, the electrode substrate having a recessed portion that forms an internal space between the oscillation plate and the electrode substrate; and a curved electrode provided on the recessed portion to face the oscillation plate via the internal space, thereby forming a gap between the curved electrode and the oscillation plate, wherein, upon application of a driving voltage to the electrode, the electrode actuating the oscillation plate by electrostatic force, wherein the recessed portion of the electrode substrate is configured with a first cross section taken along a short-side line of the oscillation plate, such that the gap between the electrode and the oscillation plate is reduced from a middle point to peripheral ends of the short-side line, and wherein a protective layer is provided on the electrode, and at least one of the protective layer and the electrode is brought into tangential contact with the oscillation plate at the peripheral ends of the short-side line.

38. The ink-jet head according to claim 37, wherein the electrode contacts the oscillation plate at a peripheral end of the longer sides.

39. The ink-jet head according to claim 37, wherein the electrode contacts the oscillation plate only at the peripheral ends of the shorter sides.

40. The ink-jet head according to claim 37, wherein a dimension y of the gap between the oscillation plate and the electrode is a function of a distance x along the short-side line from one of the peripheral ends thereof, the dimension y with respect to a part of the gap being represented by the equation $y=A(x^4-2Lx^3+L^2x^2)$, where A is a first constant and L is a second constant.

41. An ink-jet head comprising:

a nozzle opening for ejecting an ink drop therefrom onto recording paper;

a pressurizing chamber attached to the nozzle opening for containing ink therein;

an oscillation plate, provided to define a bottom of the pressurizing chamber, for pressurizing the ink in the pressurizing chamber when the oscillation plate is actuated, the oscillation plate being shaped in a generally rectangular formation with a long-side line and a short-side line, the long-side line having a middle point, a first end and a second end;

an electrode substrate bonded to the oscillation plate, the electrode substrate having a recessed portion that forms an internal space between the oscillation plate and the electrode substrate; and an electrode provided on the recessed portion to face the oscillation plate via the internal space, upon application of a driving voltage to the electrode, the electrode actuating the oscillation plate by electrostatic force, so that the ink-jet head ejects an ink drop from the nozzle opening onto the recording paper by pressurizing the ink in the pressurizing chamber, wherein the electrode is configured with a cross section taken along the long-side line of the oscillation plate, such that a gap between the electrode and the oscillation plate is reduced from the middle point to at least one of the first and second ends of the long-side line, and the cross section of the electrode includes a bottom flat region surrounding the middle point and at least one slope region extending from the bottom flat region to one of the first and second ends of the long-side line, and wherein a length L of the long-side line of the oscillation plate, a length I of the bottom flat region of the electrode and a distance H between the oscillation plate and the bottom flat region of the electrode meet the conditions $I/L \geqq 1/10$ and $2H/(L-I) < 1/10$.

42. An ink-jet head comprising:

a nozzle opening for ejecting an ink drop therefrom onto recording paper;

a pressurizing chamber attached to the nozzle opening for containing ink therein;

an oscillation plate, provided to define a bottom of the pressurizing chamber, for pressurizing the ink in the pressurizing chamber when the oscillation plate is actuated, the oscillation plate being shaped in a generally rectangular formation with a long-side line and a short-side line, the short-side line having a middle point, a first end and a second end;

an electrode substrate bonded to the oscillation plate, the electrode substrate having a recessed portion that forms an internal space between the oscillation plate and the electrode substrate; and an electrode provided on the recessed portion to face the oscillation plate via the internal space, upon application of a driving voltage to the electrode, the electrode actuating the oscillation plate by electrostatic force, so that the ink-jet head ejects an ink drop from the nozzle opening onto the recording paper by pressurizing the ink in the pressurizing chamber, wherein the electrode is configured with a cross section taken along the short-side line of the oscillation plate, such that a gap between the electrode and the oscillation plate is reduced in both directions from the middle point to the first end and the second end, and the cross section of the electrode includes a bottom flat region surrounding the middle point, and a pair of slope regions each extending from the flat region to one of the first and second ends of the short-side line, and wherein a width W of the short-side line of the oscillation plate, a width w of the bottom flat region of the electrode and a distance H between the oscillation plate and the bottom flat region of the electrode meet the conditions $w/W \geqq 1/10$ and $2H/(W-w) < 1/10$.

43. An ink-jet head comprising:

a nozzle opening for ejecting an ink drop therefrom onto recording paper;

a pressurizing chamber attached to the nozzle opening for containing ink therein;

a generally rectangular oscillation plate, provided to define a bottom of the pressurizing chamber, for pressurizing the ink in the pressurizing chamber when the oscillation plate is actuated;

an electrode substrate bonded to the oscillation plate, the electrode substrate having a recessed portion that forms an internal space between the oscillation plate and the electrode substrate; and a curved electrode provided on the recessed portion to face the oscillation plate via the internal space, upon application of a driving voltage to the electrode, the electrode actuating the oscillation plate by electrostatic force, wherein the recessed portion of the electrode substrate is configured with a first cross section taken along a short-side line of the oscillation plate, such that a gap between the electrode and the oscillation plate is reduced from a middle point to peripheral ends of the short-side line, the first cross section including inflection points on the recessed portion at intermediate positions between the middle point and the peripheral ends, and wherein a dimension y of the gap between the oscillation plate and the electrode is a function of a distance x along the short-side line from one of the peripheral ends thereof, the dimension y with respect to the entire gap being represented by the equation $y=A(x^4-2Lx^3+L^2x^2)$ where A is a first constant and L is a second constant.

44. An ink-jet head comprising:

a nozzle opening for ejecting an ink drop therefrom onto recording paper;

a pressurizing chamber attached to the nozzle opening for containing ink therein;

a generally rectangular oscillation plate, provided to define a bottom of the pressurizing chamber, for pressurizing the ink in the pressurizing chamber when the oscillation plate is actuated;

an electrode substrate bonded to the oscillation plate, the electrode substrate having a recessed portion that forms an internal space between the oscillation plate and the electrode substrate; and a curved electrode provided on the recessed portion to face the oscillation plate via the internal space, upon application of a driving voltage to the electrode, the electrode actuating the oscillation plate by electrostatic force, wherein the recessed portion of the electrode substrate is configured with a first cross section taken along a short-side line of the oscillation plate, such that the gap between the electrode and the oscillation plate is reduced from a middle point to peripheral ends of the short-side line, and wherein a protective layer is provided on the electrode, and at least one of the protective layer and the electrode is brought into tangential contact with the oscillation plate at the peripheral ends of the short-side line, and wherein a dimension y of the gap between the oscillation plate and the electrode is a function of a distance x along the short-side line from one of the peripheral ends thereof, the dimension y with respect to a part of the gap being represented by the equation $y=A(x^4-2Lx^3+L^2x^2)$, where A is a first constant and L is a second constant.

* * * * *